US008147751B2

(12) United States Patent
Oishi

(10) Patent No.: US 8,147,751 B2
(45) Date of Patent: Apr. 3, 2012

(54) SILVER-WHITE COPPER ALLOY AND PROCESS FOR PRODUCING THE SAME

(75) Inventor: Keiichiro Oishi, Yao (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 0 days.

(21) Appl. No.: 12/921,686

(22) PCT Filed: Mar. 9, 2009

(86) PCT No.: PCT/JP2009/054420

§ 371 (c)(1),
(2), (4) Date: Dec. 17, 2010

(87) PCT Pub. No.: WO2009/113489

PCT Pub. Date: Sep. 17, 2009

(65) Prior Publication Data

US 2011/0097238 A1 Apr. 28, 2011

(30) Foreign Application Priority Data

Mar. 9, 2008 (JP) ..... 2008-058855

(51) Int. Cl.
*C22C 30/02* (2006.01)
*C22F 1/16* (2006.01)

(52) U.S. Cl. ..... 420/587; 148/707

(58) Field of Classification Search ..... 420/587, 420/481; 148/707

See application file for complete search history.

(56) References Cited

FOREIGN PATENT DOCUMENTS

| | | |
|---|---|---|
| JP | 57-054239 | 3/1982 |
| JP | 01-177327 | 7/1989 |
| JP | 05-345939 | 12/1993 |
| JP | 09-087793 | 3/1997 |
| JP | 10-036927 | 2/1998 |
| JP | 2828418 | 11/1998 |
| JP | 2005-325413 | 11/2005 |

OTHER PUBLICATIONS

Search Report issued in corresponding International application No. PCT/JP2009/054420, completed May 21, 2009 and mailed Jun. 2, 2009.

JIS Handbook, published by the Japanese Standards Association, "Non-Ferrous Metals and Metallurgy," 2008, pp. 825-827.

*Primary Examiner* — Jessee R. Roe

(74) *Attorney, Agent, or Firm* — Griffin & Szipl, P.C.

(57) ABSTRACT

To provide a silver-white copper alloy which represents a silver-white color equivalent to that of nickel silver and is excellent in hot workability and the like. The silver-white copper alloy includes 47.5 to 50.5 mass % of Cu, 7.8 to 9.8 mass % of Ni, 4.7 to 6.3 mass % of Mn, and the remainder including Zn, and the silver-white copper alloy has an alloy composition satisfying relationships of f1=[Cu]+1.4×[Ni]+0.3×[Mn]=62.0 to 64.0, f2=[Mn]/[Ni]=0.49 to 0.68, and f3=[Ni]+[Mn]=13.0 to 15.5 among a content [Cu] mass % of Cu, a content [Ni] mass % of Ni, and a content [Mn] mass % of Mn, and has a metal structure in which β phases at an area ratio of 2 to 17% are dispersed in an α-phase matrix. The copper alloy is provided as a hot processing material or continuous casting material formed by performing one or more heat treatments and cold processes on a hot processing raw material formed by performing a hot process on an ingot or a casting raw material obtained by continuous casting.

16 Claims, 5 Drawing Sheets

SILVER-WHITE COPPER ALLOY AND PROCESS FOR PRODUCING THE SAME

This is a National Phase Application in the United States of International Patent Application No. PCT/2009/054420 filed Mar. 9, 2009, which claims priority on Japanese Patent Application No. 2008-058855, filed Mar. 9, 2008. The entire disclosures of the above patent applications are hereby incorporated by reference.

TECHNICAL FIELD

The present invention relates to a copper alloy having a silver-white color equivalent to that of nickel silver and a method of producing the same.

BACKGROUND ART

Copper alloys such as brass are variously used for piping materials, building materials, electric and electronic devices, machine parts, and the like. In gaming tokens, keys, Western tableware, hardware for decoration and construction, and the like, a white (silver-white) color tone may be required. To cope with such requirements, copper alloy products are subjected to a plating process such as nickel-chrome plating. However, the plated products have the problem that the plating layer of the surface is peeled off with extended use, and there is a problem in the case of reuse, since when the plated products are re-melted the plating material mixes with the copper alloy and decreases quality. Thus, a Cu—Ni—Zn alloy representing a lustrous white color on its own has been proposed.

For example, in JIS C7941 (Non-Patent Citation 1), free-cutting nickel silver containing Cu (60.0 to 64.0 mass %), Ni (16.5 to 19.5 mass %), Pb (0.8 to 1.8 mass %), Zn (remainder), and the like is prescribed. In Japanese Patent Publication No. 2828418 (Patent Citation 1), a white-based copper alloy containing Cu (41.0 to 44.0 mass %), Ni (10.1 to 14.0 mass %), Pb (0.5 to 3.0 mass %), and Zn (remainder) is disclosed.

[Patent Citation 1] Japanese Patent Publication No. 2828418

[Non-Patent Citation 1] JIS Handbook Published by Japanese Standards Association

DISCLOSURE OF THE INVENTION

Problem that the Invention is to Solve

The copper alloy contains a large amount of Ni and Pb causing health and sanitation problems, and the use thereof is restricted. That is, among metal allergies Ni is the cause of a particularly fierce Ni allergy, and Pb is a known hazardous substance. Accordingly, there is a problem with use in direct contact with the skin of a human body as a key or a similar object. The copper alloy contains a large amount of Ni. Accordingly, workability such as its hot rolling properties, machinability, and pressing properties deteriorates; Ni is expensive, raising production costs, and thus its use is restricted from these viewpoints.

An object of the invention is to provide a silver-white copper alloy which represents a silver-white color equivalent to that of nickel silver and has excellent hot processing properties and the like, and to provide a method of producing a silver-white copper alloy capable of appropriately producing the silver-white copper alloy.

Technical Solution

To solve the above-described problems, the invention proposes the following silver-white cooper alloy and a method of producing the same.

That is, according to a first aspect of the invention, there is provided a silver-white copper alloy (hereinafter, referred to as "first copper alloy") including: 47.5 to 50.5 mass % of Cu (preferably 47.9 to 49.9 mass %); 7.8 to 9.8 mass % of Ni (preferably 8.2 to 9.6 mass %, and more preferably 8.4 to 9.5 mass %); 4.7 to 6.3 mass % of Mn (preferably 5.0 to 6.2, more preferably 5.2 to 6.2 mass %); and the remainder including Zn, wherein the silver-white copper alloy has an alloy composition satisfying relationships of $f1=[Cu]+1.4\times[Ni]+0.3\times[Mn]=62.0$ to 64.0 (preferably $f1=62.3$ to 63.8 mass %), $f2=[Mn]/[Ni]=0.49$ to 0.68 (preferably $f2=0.53$ to 0.67, and more preferably $f2=0.56$ to 0.66), and $f3=[Ni]+[Mn]=13.0$ to 15.5 (preferably $f3=13.4$ to 15.4 mass %, and more preferably $f3=13.9$ to 15.4) among a content [Cu] mass % of Cu, a content [Ni] mass % of Ni, and a content [Mn] mass % of Mn, and has a metal structure in which β phases at an area ratio of 2 to 17% are dispersed in an α-phase matrix.

According to a second aspect of the invention, as a copper alloy further containing one or more elements selected from Pb, Bi, C, and S in addition to the constituent element of the first copper alloy, there is provided a silver-white copper alloy (hereinafter, referred to as "second copper alloy") including: 47.5 to 50.5 mass % of Cu (preferably 47.9 to 49.9 mass %); 7.8 to 9.8 mass % of Ni (preferably 8.2 to 9.6 mass %, and more preferably 8.4 to 9.5 mass %); 4.7 to 6.3 mass % of Mn (preferably 5.0 to 6.2 mass %, and more preferably 5.2 to 6.2 mass %); one or more elements selected from 0.001 to 0.08 mass % of Pb (preferably 0.0015 to 0.03 mass %, and more preferably 0.002 to 0.014 mass %), 0.001 to 0.08 mass % of Bi (preferably 0.0015 to 0.03 mass %, and more preferably 0.002 to 0.014 mass %), 0.0001 to 0.009 mass % of C (preferably 0.0002 to 0.006 mass %, and more preferably 0.0005 to 0.003 mass %), and 0.0001 to 0.007 mass % of S (preferably 0.0002 to 0.003 mass %, and more preferably 0.0004 to 0.002); and the remainder including Zn, wherein the silver-white copper alloy has an alloy composition satisfying the relationships f1, f2, and f3 among a content [Cu] mass % of Cu, a content [Ni] mass % of Ni, and a content [Mn] mass % of Mn, and has a metal structure in which β phases at an area ratio of 2 to 17% are dispersed in an α-phase matrix.

According to a third aspect of the invention, as a copper alloy further containing one or more elements selected from Al, P, Zr, and Mg in addition to the constituent element of the first copper alloy, there is provided a silver-white copper alloy (hereinafter, referred to as "third copper alloy") including: 47.5 to 50.5 mass % of Cu (preferably 47.9 to 49.9 mass %); 7.8 to 9.8 mass % of Ni (preferably 8.2 to 9.6 mass %, and more preferably 8.4 to 9.5 mass %); 4.7 to 6.3 mass % of Mn (preferably 5.0 to 6.2 mass %, and more preferably 5.2 to 6.2 mass %); one or more elements selected from 0.01 to 0.5 of Al mass % (preferably 0.02 to 0.3 mass %), 0.001 to 0.09 mass % of P (preferably 0.003 to 0.08 mass %), 0.005 to 0.035 mass % of Zr (preferably 0.007 to 0.029 mass %), and 0.001 to 0.03 mass % of Mg (preferably 0.002 to 0.01 mass %); and the remainder including Zn, wherein the silver-white copper alloy has an alloy composition satisfying the relationships f1, f2, and f3 among a content [Cu] mass % of Cu, a content [Ni] mass % of Ni, and a content [Mn] mass % of Mn, and has a metal structure in which β phases at an area ratio of 2 to 17% are dispersed in an α-phase matrix. In the third copper alloy, when P and Zr are added together, the content of P is 0.03 to 0.09 mass % and the content of Zr is 0.007 to 0.035 mass %. In addition, it is preferable that a value obtained by dividing the content of P by the content of Zr is $[P]/[Zr]=1.4$ to 7.

According to a fourth aspect of the invention, as a copper alloy further containing one or more elements selected from Al, P, Zr, and Mg in addition to the constituent element of the second copper alloy, there is provided a silver-white copper alloy (hereinafter, referred to as "fourth copper alloy") including: 47.5 to 50.5 mass % of Cu (preferably 47.9 to 49.9 mass %); 7.8 to 9.8 mass % of Ni (preferably 8.2 to 9.6 mass %, and more preferably 8.4 to 9.5 mass %); 4.7 to 6.3 mass % of Mn (preferably 5.0 to 6.2 mass %, and more preferably 5.2 to 6.2 mass %); one or more elements selected from 0.001 to 0.08 mass % of Pb (preferably 0.0015 to 0.03 mass %, and more preferably 0.002 to 0.014 mass %), 0.001 to 0.08 mass % of Bi (preferably 0.0015 to 0.03 mass %, and more preferably 0.002 to 0.014 mass %), 0.0001 to 0.009 mass % of C (preferably 0.0002 to 0.006 mass %, and more preferably 0.0005 to 0.003 mass %), and 0.0001 to 0.007 mass % of S (preferably 0.0003 to 0.003 mass %, and more preferably 0.0005 to 0.002); one or more elements selected from 0.01 to 0.5 mass % of Al (preferably 0.02 to 0.3 mass %), 0.001 to 0.09 mass % of P (preferably 0.003 to 0.08 mass %), 0.005 to 0.035 mass % of Zr (preferably 0.007 to 0.029 mass %), and 0.001 to 0.03 mass % of Mg (preferably 0.002 to 0.01 mass %); and the remainder including Zn, wherein the silver-white copper alloy has an alloy composition satisfying the relationships f1, f2, and f3 among contents of Cu, Ni, and Mn, and has a metal structure in which β phases at an area ratio of 2 to 17% are dispersed in an α-phase matrix. In the fourth copper alloy, when P and Zr are added together, the content of P is 0.03 to 0.09 mass % and the content of Zr is 0.007 to 0.035 mass %. In addition, it is preferable that a value obtained by dividing the content of P by the content of Zr is [P]/[Zr]=1.4 to 7.

In the description of the invention, [a] denotes a dimensionless value of a content of an element a, the content of the element a is represented by [a] mass %. For example, a content of Cu is [Cu] mass %. The content of β phases depends on an area ratio, and a dimensionless value of the content is represented by [β]. That is, the content (area ratio or area containing ratio) of the β phases is represented by [β]%. The area ratio that is the content of the β phases is measured by image analysis. Specifically, the area ratio is obtained by binarizing a 100-fold magnification optical microscope photography as for a hot processing material and a casting material, and binarizing a 200-fold or 500-fold magnification optical microscope structure, mainly, a metal structure analyzed by FE-SEM-EBSP for a final product (hot processing material, continuous casting material), using the image processing software "WinROOF" (Tech-Jam Co. Ltd). The area ratio is an average value of an area ratio measured at two predetermined positions and three fields of view.

In preferred embodiments of the first to fourth copper alloys, the copper alloy is provided as a hot processing material formed by performing one or more heat treatments and cold processes (rolling process, drawing process) on a hot processing raw material subjected to a hot process (rolling process, extruding process), or as a continuous casting material formed by performing one or more heat treatments and cold processes on a casting raw material (continuous casting raw material) obtained by continuous casting. For example, the copper alloy is appropriately used as a constituent material of a key, a key blank, or a press product. In the first to fourth copper alloys, when the copper alloy is the hot processing material, it is most preferable that the content of Cu is 48.0 to 49.6 mass %, and it is most preferable to satisfy the relationship of f1=62.4 to 63.4. When the copper alloy is the continuous casting material, it is most preferable that the content of Cu is 48.2 to 49.8 mass %, and it is most preferable to satisfy the relationship of f1=62.6 to 63.6.

In the first to fourth copper alloys, in addition to the relationships f1 to f3, it is preferable to satisfy a relationship of f4=[Ni]+0.65×[Mn]=11.5 to 13.2 (preferably f4=11.8 to 13.1).

In the second and fourth copper alloys containing Pb, Bi, C, and S, it is preferable to satisfy a relationship of $f5=[\beta]+10\times([Pb]-0.001)^{1/2}+10\times([Bi]-0.001)^{1/2}+15\times([C]-0.0001)^{1/2}+15\times([S]-0.0001)^{1/2}=2$ to 19, among the content of β phases and the contents of Pb, Bi, C, and S. In the relational expression f5, [a] of the element a that is an element (including a case where it is not contained and a case where it is contained as an inevitable impurity) less than the lower limit of the content among Pb, Bi, C, and S is considered as [a]=0.

In the first to fourth copper alloys, it is preferable that an average grain size of α phases is 0.003 to 0.018 mm, an average area (hereinafter, referred to as "β phase area") of β phases is $4\times10^{-6}$ to $80\times10^{-6}$ $mm^2$, and an average value (hereinafter, referred to as "long side/short side ratio") of long side/short side of β phases is 2 to 7. The average area (β phase area) of β phases is a value obtained by dividing the total area of β phases by the number of β phases in a specific cross section of the copper alloy. Generally, a plurality (generally two) of specific cross sections are set, an average value of β phases is calculated for each specific cross section, and the average value (value obtained by dividing the sum of the average values of β phases in the whole specific cross sections by the number of specific cross sections) is considered as the average area of the β phases. When the copper alloy is a plate-shaped material such as a hot rolling plate, the specific cross section is a cross section parallel in a lengthwise direction (rolling direction) of the plate-shaped material and perpendicular to a surface (or back surface) of the plate-shaped material. For example, two specific cross sections are cross sections at positions of t/3 and t/6 (t is a plate thickness) from the surface of the plate-shaped material. When the copper alloy is a cylindrical material such as a hot extruding rod and a drawn wire, a cross section (cross section parallel in an extruding direction and a drawing direction) parallel to an axial line of the cylindrical material is set as the specific cross section. For example, two specific cross sections are parallel cross sections at positions d/3 and d/6 (d is a diameter of a circular cross section perpendicular to the axial line of the cylindrical material). The long side of β phases is a length of a longitudinal direction (direction parallel to the longitudinal direction (rolling direction) in plate-shaped material, and direction parallel to the axial direction (extruding direction, drawing direction) in the cylindrical material) of the specific cross section, and the short side of β phases is a length of a direction perpendicular to the long side in the specific cross section. The average value of long side/short side of β phases is an average value of long side/short side of β phases obtained in each specific cross section.

In addition, in the specific cross section, it is preferable that a ratio (hereinafter, referred to as a 12 or less β phase ratio) of β phases in which the value of long side/short side is 12 or less to the whole β phases is 95% or more, or the number of β phases having the long side of 0.06 mm or more is not more than 10 per 0.1 $mm^2$. The length (long side, short side) of β phases is observed and measured with a 200-fold or 500-fold magnification optical microscope structure, mainly, a metal structure analyzed by FE-SEM-EBSP with respect to the final product (hot processing material, continuous casting material), when the specific cross section is observed (field of view of 50×100 mm) with a metal structure measured by a 100-fold magnification optical microscope with respect to a hot processing material and a casting material.

In the first to fourth copper alloys, it is preferable that the content (area ratio) of β phases in the hot processing raw material or continuous casting raw material is 12 to 40%. In addition, when the hot processing raw material or continuous casting raw material is subjected to a heat treatment (first heat treatment performed before a cold process), it is preferable that the content (area ratio) of β phases in the heat treatment material (first-order heat treatment material) is 3 to 24%, the average value of long side/short side of β phases is 2 to 18, and the ratio of β phases in which the value of long side/short side is 20 or more to the whole β phases is 30% or less (or the number of β phases having the long side of 0.5 mm or more is not more than 10 per 1 $mm^2$ of the specific cross section).

In the first to fourth copper alloys, Fe and/or Si are contained as inevitable impurities. In such a case, it is preferable that the content of Fe is 0.3 mass % or less and the content of Si is 0.1 mass % or less. In addition, a small amount of Co is considered as being encompassed in Ni according to JIS or the like. Accordingly, for example, when the content of Co is about 0.1%, Co is considered as inevitable impurities.

As a fourth aspect of the invention, a method of producing the first to fourth copper alloys is provided. That is, the invention provides a method of producing a silver-white copper alloy (hereinafter, referred to as "rolling production method"), by which a hot processing material that is the copper alloy is obtained by performing one or more heat treatments (heating temperature: 550 to 760° C., heating time: 2 to 36 hours, average cooling rate down to 500° C.: 1° C./minute or less) and cold processes on a hot processing raw material formed by performing a hot process (hot rolling, hot extruding, etc.) on an ingot, and provides a method of a silver-white copper alloy (hereinafter, "casting production method"), by which a continuous casting material that is the copper alloy is obtained by performing one or more heat treatments (heating temperature: 550 to 760° C., heating time: 2 to 36 hours, average cooling rate down to 500° C.: 1° C./minute or less) and a cold process on a casting raw material obtained by continuous casting.

In such a rolling production method or casting production method, the first heat treatment performed on the hot processing raw material or continuous casting raw material includes a heating process performed under the conditions of heating temperature: 600 to 760° C. and heating time: 2 to 36 hours, and a cooling process of slowly cooling a material at an average cooling rate of 1° C./minute or less to at least 500° C. It is preferable that a processing rate in the first cold process performed on the first heat treatment material subjected to the heat treatment is 25% or more. In this cooling process, it is preferable to slowly cool the material at the average cooling rate of 1° C./minute or less down to 500 to 550° C. and then keep the material at that temperature for 1 to 2 hours. The material is made into a predetermined size and shape by the first heat treatment while reducing β phases generated in the producing step (step of hot rolling or casting) of the raw material. A slight cold process in which a processing rate does not reach 25% may be performed on the raw material (hot processing raw material, casting raw material) before performing the first heat treatment. However, such a cold process is not a first cold process in the rolling production method or casting production method. In addition, a hot process may be performed on the raw material after performing the slight cold process in which the processing rate does not reach 25%. However, in the invention, this heat treatment is considered as the first heat treatment.

In the rolling production method or casting production method, it is preferable to perform the heating process in the second heat treatment or the later heat treatment (heat treatment performed after the first cold process) under the conditions of heating temperature: 550 to 625° C. and heating time: 2 to 36 hours. In addition, the processing rate of the cold process performed after the last heat treatment is 50% or less.

In the first to fourth copper alloys, Cu is a primary element that is the basis of determining all characteristics in the copper alloy, and is balanced with the other contained elements Zn, Ni, and Mn. However, when the content of Cu is less than 47.5 mass %, β phases are excessively increased and thus ductility or cold processing property (cold rolling property) deteriorates. As a result, there is some hardness, but strength against impact is decreased. In addition, tarnish resistance and stress corrosion cracking resistance are decreased, and also press formability is decreased. Meanwhile, when the content of Cu exceeds 50.5 mass %, the amount of β phases is reduced, strength is decreased, torsion strength, wear resistance, press formability, and machinability are decreased, and hot ductility or hot casting property is decreased. From these viewpoints, the content of Cu is necessarily 47.5 to 50.5 mass %, and preferably 47.9 to 49.9 mass %. Particularly, when the copper alloy is obtained by the hot rolling production method, the content of Cu is most preferably 48.0 to 49.6 mass %, and when the copper alloy is obtained by casting production method, the content of Cu is most preferably 48.2 to 49.8 mass %.

In the first to fourth copper alloys, Zn is a primary element equivalent to Cu and is an important element to secure characteristics of the copper alloy. For example, Zn improves mechanical strength such as tensile strength and proof strength, and Zn is the remainder remaining by subtracting the content of the other contained elements from the whole content, considering the relationship with the other contained elements. The remainder does not include inevitable impurities.

In the first to fourth copper alloys, Ni is an important element to secure the white color (silver-white color) of the copper alloy. However, Ni is contained exceeding a predetermined amount, yield (surface crack, edge crack) of hot rolling deteriorates even when there are a great number of β phases. Accordingly, flowability/castability at the time of casting deteriorates, and press formability and machinability are decreased. When the content of Ni is excessive, soft yellow tone of the copper alloy is damaged by getting whiter, even though it depends also on a composition amount of Mn. Ni is an expensive element, and an allergen (Ni allergy). Accordingly, it is preferable to reduce the content of Ni. However, there is a limit in reducing the content of Ni to secure color tone, tarnish resistance, and stress corrosion cracking resistance of the copper alloy. From this viewpoint, the content of Ni is necessarily 7.8 to 9.8 mass %, preferably 8.2 to 9.6 mass %, and most preferably 8.4 to 9.5 mass %.

In the first to fourth copper alloys, color tone of the copper alloy depends on a composition ratio of Mn with Ni, but Mn serves as a Ni substituting element to obtain white color property while a slight yellow tone remains. Mn improves torsion strength and wear resistance, and improves press property and machinability though depending on the relation with β phases. Independent Mn hardly contributes to tarnish resistance or stress corrosion cracking resistance, and has a large negative effect. Accordingly, a combination with Ni is important. In addition, when Mn is contained in a copper alloy, flowability of melt flow can be improved and the β phase area is enlarged in the hot rolling area to improve hot rolling property of the copper alloy. From these viewpoints, the content of Mn is necessarily 4.7 to 6.3 mass %, preferably 5.0 to 6.2 mass %, and most preferably 5.2 to 6.2 mass %.

In the first to fourth copper alloys, it is necessary to consider correlation of the contents of Cu, Ni, and Mn to determine the contents of Cu, Ni, and Mn. Particularly, the relationship of f1 is important for securing hot processing property (hot rolling, hot extruding) and cold processing property (cold rolling), while improving press formability, machinability, torsion strength, bending processing property, tarnish resistance, and stress corrosion cracking resistance.

That is, when a value of f1=[Cu]+1.4×[Ni]+0.3×[Mn] is low, tarnish resistance, stress corrosion cracking resistance, torsion strength, and impact resistance deteriorate and ductility or cold processing property (cold rolling) deteriorates. In addition, surface cracks may be caused at the time of casting or hot rolling. On the other hand, when the value of f1 is high, press formability and machinability deteriorate and torsion strength is decreased. In addition, since β phases are little in the hot area, hot processing property (rolling property) is decreased and thus a producing yield is decreased. From this viewpoint, the contents of Cu, Ni, and Mn are determined necessarily to be f1=62.0 to 64.0, and preferably f1=62.3 to 63.8 within the content range as described above. Particularly, when the first to fourth copper alloys are produced by a rolling production method, the contents are determined most preferably to be f1=62.4 to 63.4, and when the copper alloys are produced by a casting production method, the contents are determined most preferably to be f1=62.6 to 63.6.

To secure the above-described properties, the correlation of the contents of Ni and Mn, and particularly, a ratio f2 (=[Mn]/[Ni]) of the content [Mn] mass % of Mn to the content [Ni] mass % of Ni is important. That is, when f2 is equal to or less than a predetermined value, torsion strength is decreased and wear resistance, press formability, and machinability deteriorate. In addition, the area of β phases with abundant hot ductility is not expanded and the amount of β phases is small. Accordingly, surface cracks or edge cracks easily occur and yield deteriorates in hot rolling. On the other hand, when f2 is higher than the predetermined value, the effect of Mn is too strong and thus tarnish resistance, stress corrosion cracking resistance, and impact resistance are decreased. In color tone, the copper alloy loses yellow tone and becomes reddish, and thus the color tone gets away from a silver-white color. In addition, ductility or cold processing property (cold rolling property) deteriorates. In addition, solidus temperature is decreased, the amount of β phases is excessively increased, and surface cracks easily occur in a hot state. Meanwhile, for example, a ratio occupied by β phases in a high temperature structure in an optimal composition is about 70% (55 to 85%) at 800° C. corresponding to the initial temperature of a hot rolling process. The ratio is about 40% (25 to 60%) at 700° C. corresponding to the middle period of the hot rolling process, and is about 20% (3 to 40%) at 600° C. corresponding to the final rolling temperature. As described above, according to the change of β phases caused by the change in temperature, the hot process of Cu—Zn alloy including Ni is easily performed (improves the hot processing property) and characteristics of the final products are improved. Accordingly, when f2 is less than 0.49, the β phases are not greatly changed as described above. That is, there is a little change of β phases with respect to the change in temperature. For example, the ratio occupied by β phases is 45% at 800° C., 35% at 700° C., and 25% at 600° C. When f2 is a proper value, there is a large amount of β phases which are excellent in deformability at high temperature. In addition, there is a small amount of β phases at 600° C. corresponding to the hot rolling finished temperature, the hot processing property is good, and the characteristics of the final products are improved. In a casting material, when there is a small amount of β phases at high temperature at the step of solidification, a thermal conductivity is bad in the first to fourth copper alloys including a large amount of Ni and Mn. Accordingly, cracks easily occur, and thus the production is subjected to various constraints (a casting rate is delayed, etc.) in casting. From this viewpoint, it is necessary that [Ni]:[Mn] is basically 2:1 to 3:2, f2=0.049 to 0.68 is necessary, f2=0.53 to 0.67 is preferable, and f2=0.56 to 0.66 is most preferable.

The contents of Ni and Mn are specified in a considerably narrow range from the relationship of f2, and further, it is necessary to apply a limit by the total contents of Ni and Mn as defined in f3. That is, when f3 (=[Ni]+[Mn]) is equal to or less than a predetermined value, the yellow tone is too strong, it is difficult to obtain a silver-white color, and there is a problem in tarnish resistance and stress corrosion cracking resistance. On the other hand, when f3 is equal to or more than the predetermined value, the yellow tone disappears, brightness is reduced, cost is increased, and yield at the time of hot rolling deteriorates. From this viewpoint, f3=13.0 to 15.5 is necessary, f3=13.4 to 15.4 is preferable, and f3=13.9 to 15.4 is most preferable. In addition, it is preferable to consider f4=[Ni]+0.65×[Mn] as described above in consideration of interaction of Ni and Mn having an influence on characteristics and properties of the copper alloys, f4=11.5 to 13.2 is preferable, and f4=11.8 to 13.1 is more preferable. When the value of f4 is less than the lower limit of the range, the yellow tone is too strong, it is difficult to obtain a proper silver-white color, and there are problems in tarnish resistance and stress corrosion cracking resistance. On the other hand, when the value of f4 is over the upper limit of the range, the yellow tone disappears, brightness is decreased, cost is increased, and yield at the time of hot rolling deteriorates. When the value of f4 is out of the range, it is difficult to secure satisfactory pressing properties and machinability, although depending on the compositions of Cu and Zn as well.

A zinc concentration of β phases of Cu—Zn alloy is higher than that of α phases by 6%, and a crystal structure thereof is different from that of α phases. For this reason, hardness of β phases is high (several ten points in Vickers hardness), but β phases are softer than α phases (elongation value of β phases is 1/10 of α phases). However, such property of β phases is changed by an additional element of several % or more according to the added element. As described above, when a large amount of Ni and/or Mn is added at 10% or more in total, the property of β phases is inevitably changed. When [Mn]:[Ni] is in the range of 2:1 to 3:2, a large amount of Mn and Ni is solid-solution in β phases than in α phases of matrix (about 1.1 times). Accordingly, β phases in the first to fourth copper alloys are harder than α phases. However, as the content of Zn is reduced by the increased amount of Ni and Mn, they (the first to fourth copper alloys) do not become brittle. As a result, as described later, β phases become a stress concentration source at the time of cutting, improve chip-discharging property, reduce cutting resistance, and improve press formability. In the composition, the content ratio ([Mn]/[Ni]≈1/2 to 2/3) of Ni and Mn has a large influence on characteristics of β phases as described above. In the metal structure, there is naturally a problem in distribution of β phases. A predetermined regular size and the uniform distribution thereof are important (in machinability, press formability, strength, torsion strength, wear resistance, ductility, and the like). β phases are subjected more to corrosion than α phases, so the continuous presence of β phases causes corrosion or tarnish. A ratio occupied by β phases has an influence on all characteristics such as press formability and machinability. It is insufficient to determine only the ratio occupied by β phases, and thus formation and distribution of β phases are important. When the ratio of β phases is less than 2%, press formability and machinability are insufficient. At the time of press forming, a ratio occupied by a shear face is increased, a problem in precision and shear droop easily occur, and a burr easily occurs at the time of cutting. Meanwhile, when the ratio occupied by β phases is more than 17%, there are problems in precision at the time of forming, burrs easily occur and tarnish resistance deteriorates. In addition, strength against impact is decreased. Press formability also deteriorates, and ductility or cold processing property (cold rolling property) deteriorates. Accordingly, as described above, it is necessary to form a metal structure in which β phases of 2 to 17% at an area ratio are distributed in matrix of α phases.

The shape of β phases is one of the most important factors. Press formability and machinability are not significantly improved but for the reason of only the large amount of β phases. Rather, when there is too large an amount of hard β phases, durability and the like of a cutting tool are decreased, and further naturally, bending property, strength against impact, and cold processing property are decreased. Immediately after a hot process, β phases represent a network-shaped metal structure continuously in a rolling direction or extruding direction, and the amount thereof is large. The same holds true for a casting material. The stress concentration source with regard to machinability is hard β phases at the time of cutting, and thus dividing or shearing deformation of chips caused by β phases is made easy. Accordingly, in consideration of balance of ductility and the like, while reducing the amount of β phases, it is necessary for β phases to have a considerable size to some extent, but not to be continuous. At the time of pressing, shear breaking easily occurs by uniformly distributed minute β phases. As a result, uniform fracture surface occurs, precision in size is improved, and few burrs occur after the last fracture. Shear droop occurring at the initial period of pressing hardly occurs because the strength is increased by the uniformly distributed minute β phases, and because the material is not sticky, and thus fracture immediately proceeds. When β phases are included in a prescribed amount as described above and are uniformly distributed, torsion strength, wear resistance, strength against impact, ductility, bending property, strength are increased. In addition, there are hardly any problems with tarnish resistance and stress corrosion cracking resistance.

From this viewpoint, a ratio (hereinafter, referred to as "β phase ratio") occupied by β phases in the whole phase structure of the copper alloy is necessarily 2 to 17%, preferably 3 to 15%, and most preferably 4 to 12%. As described above, an average area of β phases is preferably $4\times10^{-6}$ to $80\times10^{-6}$ $mm^2$, more preferably $6\times10^{-6}$ to $40\times10^{-6}$ $mm^2$, and most preferably $8\times10^{-6}$ to $32\times10^{-6}$ $mm^2$. As described above, as for a shape of β phase, a ratio of long side/short side (average value of long side/short side) is preferably 2 to 7, more preferably 2.3 to 5, and most preferably 2.5 to 4. In addition, as for the shape of β phase, when there are grains having a high ratio of long side/short side, it is difficult to obtain satisfactory machinability and press property. Accordingly, the β phase ratio equal to or less than 12 (ratio of β phases having a value of long side/short side equal to or less than 12 to the total β phases) is preferably 95% or more, and more preferably 97% or more. Simply, the number of β phases having a long side of 0.06 mm or more per 0.1 $mm^2$ in the specific cross section is not more than 10 (preferably below 5). As described above, when the β phases are minute and the grain size of β phases is controlled, it can be considered that the β phases are uniformly distributed in matrix. When the shape of β phases as well as the amount of β phases does not fall within the range, it is difficult to obtain the above-described satisfactory pressing property and characteristics.

When α phase grains become minute, the strength of materials is improved with β phases, shear droop and burr (see page. 9 of "shearing process" published (Jul. 10, 1992) by Korona Publishing Co., Ltd.)) hardly occurs at the time of pressing. Surface roughness caused by shear droop depends on a grain size. A grain boundary also becomes a stress concentration source at the time of cutting although an action thereof is weaker than that of β phases. Accordingly, the grain boundary reduces cutting resistance to suppress shear droop and burr from occurring at the time of the cutting process. However, when the α phase are too small, the β phase rather become too minute, thereby causing a problem in machinability and press property. From this viewpoint, an average grain size of α phases (hereinafter, referred to as "α phase size" is preferably 0.003 to 0.018 mm, more preferably 0.004 to 0.015 mm, and most preferably 0.005 to 0.012 mm.

A metal structure (metal structure of hot processing raw material or continuous casting raw material) after the hot rolling, hot extruding, and continuous casting is a net-like shape (network shape) in which β phases are connected. β phases are excessively present (remained) to obtain satisfactory hot processing property. However, in this state, it is difficult to obtain satisfactory press formability, machinability, torsion strength, and wear resistance as well as impact resistance, corrosion resistance, and tarnish resistance. In addition, when a cold process (rolling) at a large processing rate is performed, cracks easily occur. However, even when there are continuously connected β phases at the step of hot rolling or the like, and when the ratio occupied by β phases is 12 to 40% (preferably 15 to 36%, more preferably 18 to 32%), the net-like β phases are finely dispersed at the final step of the process of the rolling production method or casting production method, and thus excellent press formability or the like is obtained. To precipitate α phases according to disappearance of β phases by dissolving the net-like shaped β phase structure, it is preferable that the raw material (hot processing raw material, continuous casting raw material) or the cold processing material is subjected to a heat treatment at 550 to 745° C. for 2 to 36 hours and is then slowly cooled at an average cooling rate of 1° C./minute or less down to 500° C. The temperature of the heat treatment is higher than an annealing temperature of general copper alloys, because the net-shaped metal structure is not easily dissolved once it is no longer at a high temperature. Of course, the second heat treatment or the later heat treatment performed after a cold process also serves as recrystallization annealing of the cold processing material. The first to fourth copper alloys have a metal structure including β phases. Since the β phase area is expanded on the high temperature side due to the addition of Mn, coarsening of α phase does not occur. In a case of a plate-shaped material having a plate thickness of about 2 to 3.5 mm, it is preferable to perform this heat treatment more than twice including the first heat treatment. Particularly, there is a big advantage in the first heat treatment, that is, a heat treatment of a hot processing raw material or continuous casting raw material. The advantage is that only one more process of heat treatment is required in a case of hot rolling or horizontal continuous casting where, as the next process, there is a milling process (sculpting) to mechanically cut away oxidized coating and in a case of hot extrusion, a process to clean it away. The first heat treatment is performed on a raw material having almost no distortion, resulting in a low diffusion rate and a low rate of change in structure. The heat treatment is performed at 550 to 745° C. as described above, but it is performed preferably at 610 to 730° C., and more preferably the material should be kept at 630 to 690° C. for 4 to 24 hours, and then be slowly cooled down to 500° C. at a cooling rate of 1° C./minute or less (preferably 0.5° C./minute or less). In addition, it is also preferable that the material is slowly cooled down to 500 to 550° C. and then is kept at the temperature (500 to 550° C.) for 1 to 2 hours. By such a heat treatment, the net-shaped β phases are divided by the precipitation of α phases, the area ratio occupied by the β phases is decreased, and the grain size of the α phase becomes about 0.015 to 0.050 mm. By this heat treatment, the aforesaid ratio occupied by the β phases should be 3 to 24% (preferably 4 to 19%, more preferably 5 to 15%) since after the net-shaped structure of β phases is broken by the precipitation of α phases. Basically at this stage, the net-shaped structure should be broken, an average value of long side/short side of the β phases be 2 to 18 (preferably 2.5 to 15), and the area ratio of β phases having the value of long side/short side more than 20 be 30% or less (preferably 20% or less). To simplify, in the aforesaid specific cross section, the number of β phases per 1 $mm^2$ having a length of 0.5 mm or more should be within less than 10 (preferably within less than 5). In the case of a continuous casting material, a diffusion rate is lower, and thus it is preferable to perform a heat treatment at 620 to 760° C. for 4 to 24 hours. More preferably, the heat treatment is performed at 630 to 750° C., and then the material is slowly cooled down to at least 500° C. at an average cooling rate of 1° C./minute or less (preferably 0.5° C./minute or less). After the slow cooling down to 500 to 550° C., it is effective to keep the material at that temperature for 1 to 2 hours. Since a thickness of a hot rolling plate and continuous casting material is generally about 10 to 15 mm or about 20 mm, the thickness is reduced by cold rolling to be thinner and another heat treatment is performed. The temperature at that time is preferably 550 to 625° C. for 2 to 16 hours, and more preferably 555 to 610° C. In addition to the general recrystallization annealing to make a material soft, the divided β phases are elongated again in the rolling direction by cold rolling, and the β phases are uniformly divided again by this heat treatment while reducing the β phase amount by the precipitation of α phases. The growth of grains is suppressed by the addition of Ni and/or Mn in a predetermined condition and the proper amount of β phases. In addition, there are a large amount of β phases surrounding α phases. Accordingly, the average grain sizes of α phases is controlled to be 0.003 to 0.018 mm (preferably 0.004 to 0.015 mm, and more preferably 0.005 to 0.012 mm). The average grain size of α phases is necessarily 0.018 mm or less, and preferably 0.015 mm or less in consideration of press formability (particularly shear droop, surface roughness), machinability, ductility, and the other properties. When the grains of α phases are excessively minute, the β phases around them also become too minute to obtain a predetermined property. In the case of performing the second heat treatment, when the heat treatment temperature is less than 550° C., β phases, which are longitudinally elongated by a previously performed cold process, are not divided sufficiently. In addition, the α phases are in a non-recrystallization state at a temperature at 540° C. or lower (particularly 500° C. or lower). When a heat treatment is performed at 500° C. or lower, for example, for more than 3 hours, rather, β phases precipitates around grain boundaries. The precipitated β phases are not so much effective in press property and machinability, and rather deteriorate bendability and impact properties. Over 625° C., α phases become too large and β phases are further divided. However, the β phases become excessively refined (long side/short side ratio (average value of long side/short side) becomes too small), and particularly have a negative influence on press formability and machinability. Accordingly, it is necessary to perform the heat treatment under the above-described conditions, the material should be kept at 550 to 625° C. for 2 to 16 hours, preferably at 555 to 610° C. for 2 to 16 hours, then be cooled down to 500° C. at a cooling rate of 1° C./minute or less and, most preferably, be kept at 560 to 600° C. for 2 to 16 hours, then slowly cooled down to 500° C. preferably at a cooling rate of 0.5° C./minute or less.

Pb, Bi, C, and S contained in the second and fourth copper alloys have a function of effectively improving press formability and machinability at a lower concentration by the heat treatment. Originally, Pb, Bi, C, and S are hardly solid-solution into Cu—Zn—Ni alloy. However, a very small amount could be solid-solution. At the time of high-temperature hot processing or in a high temperature state after solidification, these elements exist in the phase boundaries of α and β or mostly in β phases in a solid solution state. Mainly in phase boundaries of α phases and β phases, some or most of these elements are subjected to solid solution and/or uneven distribution in an over-saturated state, for a hot rolling material, hot extruding material, and a casting material having the claimed composition, particularly, close to the lower limit. When the temperature is raised up to about 650° C. for another heat treatment, β phases are reorganized by the precipitation of α phases. In addition, the unevenly distributed elements in solid solution such as Pb are precipitated as particles of Pb, Bi, and C, and as compounds of Mn and S in case of S. In addition, larger amounts of these elements are additionally precipitated in the vicinity of α-β phase boundaries of or in α phases with the increase of α phases due to slow cooling at a rate of at least 1° C./minute or less or by being kept at a lower temperature. When the heat treatment temperature is less than 550° C., a precipitating rate of α phases is low and the reorganization of β phases is insufficient. Accordingly, theses elements are not sufficiently precipitated. On the other hand, when the heat treatment temperature is higher than 745° C., the amount of β phases are increased during the heat treatment, theses elements are solid-solution again into β phases, and effective precipitation is not performed. From this viewpoint, in the casting material and hot processing material, it is understood that it is preferable to perform the heat treatment at about 670° C. (620 to 710° C.). In the second heat treatment, because the amount of β phases is decreased as compared with the first heat treatment, the β phases are divided and a plasticity process is added, the precipitation of Pb, Bi, C, and the like from β phases is further promoted by performing the heat treatment at a lower temperature (about 580° C.), and minute grains are formed.

In the second and fourth copper alloys, Pb, Bi, C, and S have a function of further improving machinability, press formability, and wear resistance with a small amount. When the contents are equal to or more than a predetermined value, basically, these elements are minutely precipitated or crystallized as Pb particles, Bi particles, and C particles, and as MnS compounds by coupling with mainly Mn with respect to S. When these particles (Pb particles, Bi particles, C particles, and MnS compounds) are increased too much, there is a negative influence on impact property, torsion strength, ductility, and hot/cold processing property. Particularly, when a large amount of Pb and Bi are added, problems occur to human bodies of, for example, key users. On the other hand, when the contents are equal to or less than the predetermined value, the improving effect in press formability, machinability, and the like are not exhibited but there is no negative influence on properties such as strength and ductility. From these viewpoints, and in consideration of effectively existing amounts as Pb particles and the like, it is preferable that one or more of Pb, Bi, C, and S are contained within predetermined content ranges. That is, the content of Pb is 0.001 to 0.08 mass %, preferably 0.0015 to 0.03 mass %, and more preferably 0.002 to 0.014 mass %. The content of Bi is 0.001 to 0.08 mass %, preferably 0.0015 to 0.03 mass %, and more preferably 0.002 to 0.014 mass %. The content of C is 0.0001 to 0.009 mass %, preferably 0.0002 to 0.006 mass %, and more preferably 0.0005 to 0.003 mass %. The content of S is 0.0001 to 0.007 mass %, preferably 0.0002 to 0.003 mass %, and more preferably 0.0004 to 0.002 mass %. In addition, as described above, it is possible to mainly precipitate large amounts of these elements at the phase boundaries of α phases and β phases in the step of a raw material, particularly, by performing a heat treatment. That is, in the combination with a heat treatment, it is possible to improve press formability and machinability with a smaller amount of addition without damaging impact property and the like. From these points, in the relationship of machinability, press formability, and the other properties, it is preferable to satisfy the relationship of f5 in the relationship of β phases having the influence and the effect, and Pb that is an influence and effect element. Specifically, it is preferable to satisfy the followings. That is, it is preferably to satisfy the relationship of $f5=[\beta]+10\times([Pb]-0.001)^{1/2}+10\times([Bi]-0.001)^{1/2}+15\times([C]-0.0001)^{1/2}+15\times([S]-0.0001)^{1/2}=2$ to 19, more preferably f5=4 to 17, and most preferably f5=5 to 14. In the relational expression f5, it means that a value obtained by multiplying a square root of the content % of Pb and the like by a coefficient of 10 or 15 corresponds to the amount of β phases. In the above expression, a numerical value "0.001" of a minus value, for example, a value of "−0.001" substantially corresponds to a solid solution amount (0.001 mass %) in industrial production of Pb, Bi, C, S, and the like through the heat treatment processes of the invention, that is, in practical use of the invention, and a plus square root over the solid solution amount contributes to properties. In addition, when the value is less than the lower limit, press formability or machinability is not industrially satisfied even when the influence element such as Pb is added. When the value is more than the upper limit, impact property or bending property deteriorates and thus it is not suitable for a key or the like.

Al, P, Zr, and Mg contained in the third and fourth copper alloys have a function of improving properties in the step of casting materials, for example, improving fluidity of melt flow, as well as improving strength and tarnish resistance, improving a refinement of metal structure, and uniformly distributing β phases. To exhibit theses effects, the content of P is 0.001 to 0.09 mass %, and preferably 0.003 to 0.08 mass %, the content of Zr is 0.005 to 0.035 mass %, and preferably 0.007 to 0.029 mass %, and the content of Al is 0.01 to 0.5 mass %, and preferably 0.02 to 0.3 mass %. At the upper limits of these elements, the functions of improving fluidity of melt flow, tarnish resistance and strength are saturated. Rather, ductility or torsion strength deteriorates, and thus cracks easily occur in a cold process. Meanwhile, when Zr and P among these elements are added together, a macrostructure becomes refined particularly in the step of a casting material and β phases become uniformly distributed. In this case, P is contained preferably by 0.03 to 0.09 mass %, Zr is contained preferably by 0.007 to 0.035 mass %, and a value of [P]/[Zr] is 1.4 to 7, and preferably 1.7 to 5.1. In the step of a casting material, when grains are refined, a size or shape of β phases of a final product is in a more preferable state. Particularly, a continuous casting raw material is not subjected to a hot process, and thus coarsened net-shaped β phases are easily formed. Accordingly, it is effective to add P and Zr together.

In the first to fourth copper alloys, Si and Fe may be inevitably mixed as impurities. However, when Fe is precipitated in a content of more than 0.3 mass %, Fe has a negative influence on press formability, machinability, and the other properties. However, when the precipitation of Fe is equal to or less than 0.2 mass %, there is no influence on the properties. In addition, when the content of Si is equal to or more than 0.1 mass %, Si is coupled with Ni or Mn to form a silicon compound, thereby having a negative influence on press formability, machinability, and the other properties. However, when the content of Si is equal to or less than 0.05 mass %, there is no influence on the properties.

Advantageous Effects

The first to fourth copper alloys as a silver-white copper alloy of the invention represents a silver-white color equivalent to that of nickel silver while drastically reducing the content of Ni, and thus can suppress Ni allergy as much as possible even in the use subject to direct human contact. Press formability, machinability, torsion strength, tarnish resistance, bending property, impact resistance, stress corrosion cracking resistance, wear resistance, and the like are excellent, a hot process (hot rolling process, hot extruding process) can be performed, cost performance is excellent and a practical value is high. As for Pb and Bi in general, when the content is equal to or less than 0.1 mass %, they are not harmful to human bodies. When the content is equal to or less than 0.014 mass %, the upper limit of a more preferable range, there is hardly any problem. The second and fourth copper alloys containing no Pb or a very small amount of Pb even though contained can be applied to the applications where health and sanitary are particularly important, similar to the first and third copper alloys containing no Pb, and it is possible to further improve machinability or the like.

According to the production method of the invention, in any case of a rolling production method and a casting production method, it is possible to appropriately produce the first to fourth copper alloys.

EXAMPLES

Figure 1:
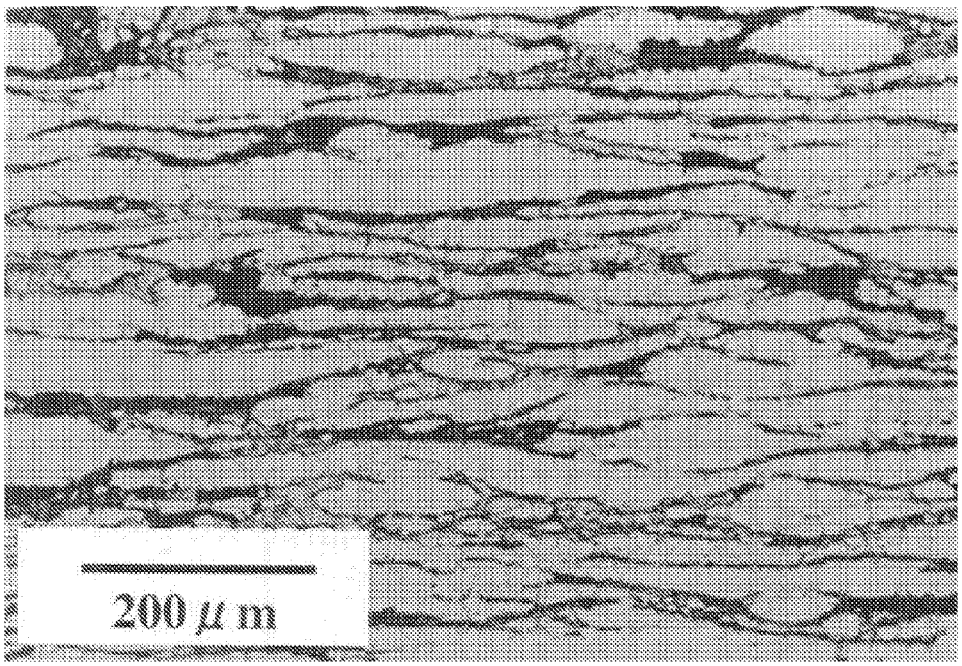
FIG. 1 is a photograph of an etching surface illustrating a metal structure of a hot processing raw material A used to produce Example Alloy No. 201.

As examples, hot processing raw materials A and B, and continuous casting raw materials C and D are subjected to heat treatment and cold process more than once in accordance with the processes M1 to M25 as described below, thereby obtaining silver-white copper alloys (hereinafter, referred to as "Example Alloy") No. 101 to No. 104, No. 201 to No. 215, No. 301 to No. 303, No. 401, No. 402, No. 501 to No. 503, No. 601, No. 602, No. 701, No. 702, No. 801, No. 802, No. 901, No. 902, No. 1001 to No. 1007, No. 1101 to No. 1108, No. 1201, No. 1202, No. 1301, No. 1302, No. 1401 to No. 1408, No. 1501 to No. 1509, No. 1601, No. 1602, No. 1701 to No. 1706, No. 1801 to No. 1813, No. 1901, No. 1902, No. 2001 to No. 2003, No. 2101 to No. 2105, No. 2201, No. 2202, No. 2301, No. 2302, No. 2401 to No. 2403, No. 2501, and No. 2502 according to the invention.

Each of the hot processing raw material A has an alloy composition shown in Table 1 or Table 2, and is a rolled plate material with a thickness of 12 mm obtained by heating a plate-shaped ingot with a thickness of 190 mm, a width of 630 mm, and a length of 2000 mm to 800° C. and performing a hot rolling process.

Each of the hot processing raw material B has an alloy composition shown in Table 2 or Table 3, and is a hot extruded rod material with a diameter of 23 mm obtained by performing face milling on a cylindrical ingot with a diameter of 100 m and a length of 150 mm to be a diameter of 96 mm, heating it to 800° C., and performing a hot extruding process.

Each of the continuous casting raw material C has an alloy composition shown in Table 3 or Table 4, and is a cast plate with a thickness of 40 mm, a width of 100 mm, and a length of 200 mm obtained by performing a continuous casting process using a horizontal continuous casting machine.

Each of the continuous casting raw material D has an alloy composition shown in Table 4 or Table 5, and is a cast plate with a thickness of 15 mm, a width of 100 mm, and a length of 200 mm obtained by performing a continuous casting process using a horizontal continuous casting machine.

(Process M1)

The hot processing raw material A was subjected to a first heat treatment, and a first heat treatment material A1-1 was obtained. This heat treatment includes a heating process of heating the raw material A at 650° C. for 12 hours, and a cooling process of slowly cooling it at an average cooling rate of 0.4° C./minute down to 500° C.

Next, the first heat treatment material A1-1 was subjected to face milling to be as thick as 11 mm, it was subjected to a cold rolling process that is a first cold process, and a first cold processing material A2-1 with a thickness of 3.25 mm was obtained. In this case, the processing rate is 70%.

The first cold processing material A2-1 was subjected to a second heat treatment (final heat treatment), and a second heat treatment material A3-1 was obtained. This heat treatment includes a heating process of heating the first cold processing material A2-1 at 565° C. for 16 hours, and a cooling process of slowly cooling it at an average cooling rate of 0.3° C./minute down to 500° C.

The second heat treatment material A3-1 was subjected to a second cold rolling process, and Example Alloys No. 101 to No. 104 with a thickness of 2.6 mm were obtained. In this case, the processing rate is 20%.

Alloy compositions of Example Alloys No. 101 to No. 104 which are the hot processing materials (hot rolled materials) obtained as described above are as shown in Table 1.

(Process M2)

The hot processing raw material A was subjected to a first heat treatment, and a first heat treatment material A1-2 was obtained. This heat treatment includes a heating process of heating the raw material A at 675° C. for 6 hours, and a cooling process of slowly cooling it at an average cooling rate of 0.4° C./minute down to 500° C.

Next, the first heat treatment material A1-2 was subjected to face milling to be as thick as 11 mm, it was subjected to a first cold rolling process, and a first cold processing material A2-2 with a thickness of 3.25 mm was obtained. In this case, the processing rate is 70%.

The first cold processing material A2-2 was subjected to a second heat treatment (final heat treatment), and a second heat treatment material A3-2 was obtained. This heat treatment includes a heating process of heating the first cold processing material A2-2 at 575° C. for 3 hours, and a cooling process of slowly cooling it at an average cooling rate of 0.3° C./minute down to 500° C.

The second heat treatment material A3-2 was subjected to a second cold rolling process, and Example Alloys No. 201 to No. 215 with a thickness of 2.6 mm were obtained. In this case, the processing rate is 20%.

Alloy compositions of Example Alloys No. 201 to No. 215 which are the hot processing materials (hot rolled materials) obtained as described above are as shown in Table 1.

(Process M3)

The hot processing raw material A was subjected to a first heat treatment, and a first heat treatment material A1-3 was obtained. This heat treatment includes a heating process of heating the raw material A at 675° C. for 6 hours, and a cooling process of slowly cooling it at an average cooling rate of 0.4° C./minute down to 500° C. and keeping it at 530° C. for 1 hour during the cooling (it is kept at 530° C. during cooling down to 500° C. and is cooled at 0.4° C./minute down to 500° C. Re-heating to 530° C. is not performed.).

Next, the first heat treatment material A1-3 was subjected to face milling to be as thick as 11 mm, it was subjected to a first cold rolling process, and a first cold processing material A2-3 with a thickness of 3.25 mm was obtained. In this case, the processing rate is 70%.

The first cold processing material A2-3 was subjected to a second heat treatment (final heat treatment), and a second heat treatment material A3-3 was obtained. This heat treatment includes a heating process of heating the first cold processing material A2-3 at 575° C. for 3 hours, and a cooling process of slowly cooling it at an average cooling rate of 0.3° C./minute down to 530° C., keeping it at 530° C. for 1 hour, and cooling it at an average cooling rate of 0.3° C./minute down to 500° C. (the same as the part described in the paragraph [0058]), that is, a cooling process of slowing cooling it at an average cooling rate of 0.3° C./minute down to 500° C.

The second heat treatment material A3-3 was subjected to a second cold rolling process, and Example Alloys No. 301 to No. 303 with a thickness of 2.6 mm were obtained. In this case, the processing rate is 20%.

Alloy compositions of Example Alloys No. 301 to No. 303 obtained as described above are as shown in Table 1.

(Process M4)

The hot processing raw material A was subjected to a first heat treatment, and a first heat treatment material A1-4 was obtained. This heat treatment includes a heating process of heating the raw material A at 650° C. for 12 hours, and a cooling process of slowly cooling it at an average cooling rate of 0.4° C./minute down to 500° C.

Next, the first heat treatment material A1-4 was subjected to face milling to be as thick as 11 mm, it was subjected to a first cold rolling process, and a first cold processing material A2-4 with a thickness of 5 mm was obtained. In this case, the processing rate is 55%.

The first cold processing material A2-4 was subjected to a second heat treatment, and a second heat treatment material A3-4 was obtained. This heat treatment includes a heating process of heating the first-order cold processing material A2-4 at 575° C. for 3 hours, and a cooling process of slowly cooling it at an average cooling rate of 0.3° C./minute down to 500° C.

Next, the second heat treatment material A3-4 was subjected to a second cold rolling process, and a second cold processing material A4-4 with a thickness of 3.25 mm was obtained. In this case, the processing rate is 35%.

The second cold processing material A4-4 was subjected to a third heat treatment (final heat treatment), and a third heat treatment material A5-4 was obtained. This heat treatment includes a heating processing of heating the second cold processing material A4-4 at 565° C. for 8 hours, and a cooling process of slowing cooling it at an average cooling rate 0.3° C./minute down to 500° C.

The third heat treatment material A5-4 was subjected to a third cold rolling process, and Example Alloys No. 401 and No. 402 with a thickness of 2.6 mm were obtained. In this case, the processing rate is 20%.

Alloy compositions of Example Alloys No. 401 and No. 402 which are the hot processing materials (hot rolled materials) obtained as described above are as shown in Table 2.

(Process M5)

The hot processing raw material A was subjected to a first cold rolling process without performing a heat treatment, unlike Processes M1 to M4. That is, the raw material A was subjected to face milling to be as thick as 11 mm, it was subjected to the first cold rolling process, and a first cold processing material A2-5 with a thickness of 3.25 mm was obtained. In this case, the processing rate is 70%.

The first cold processing material A2-5 was subjected to a heat treatment, and a heat treatment material A3-5 was obtained. This heat treatment includes a heating processing of heating the first cold processing material A2-5 at 575° C. for 3 hours, and a cooling process of slowing cooling it at an average cooling rate 0.3° C./minute down to 500° C.

The heat treatment material A3-5 was subjected to a second cold rolling process, and Example Alloys No. 501 to No. 503 with a thickness of 2.6 mm were obtained. In this case, the processing rate is 20%.

Alloy compositions of Example Alloys No. 501 to No. 503 which are the hot processing materials (hot rolled materials) obtained as described above are as shown in Table 2.

(Process M6)

The hot processing raw material A was subjected to a first heat treatment, and a first heat treatment material A1-6 was obtained. This heat treatment includes a heating process of heating the raw material A at 540° C. for 6 hours, and a cooling process of slowly cooling it at an average cooling rate of 0.4° C./minute down to 500° C.

Next, the first heat treatment material A1-6 was subjected to face milling to be as thick as 11 mm, it was subjected to a first cold rolling process, and a first cold processing material A2-6 with a thickness of 3.25 mm was obtained. In this case, the processing rate is 70%.

The first cold processing material A2-6 was subjected to a second heat treatment, and a second heat treatment material A3-6 was obtained. This heat treatment includes a heating process of heating the first cold processing material A2-6 at 575° C. for 3 hours, and a cooling process of slowly cooling it at an average cooling rate of 0.3° C./minute down to 500° C.

The second heat treatment material A3-6 was subjected to a second cold rolling process, and Example Alloys No. 601 and No. 602 with a thickness of 2.6 mm were obtained. In this case, the processing rate is 20%.

Alloy compositions of Example Alloys No. 601 and No. 602 which are the hot processing materials (hot rolled materials) obtained as described above are as shown in Table 2.

(Process M7)

The hot processing raw material A was subjected to a first heat treatment, and a first heat treatment material A1-7 was obtained. In this heat treatment, the raw material A was heated at 675° C. for 6 hours and was air-cooled. In this air cooling, an average cooling rate down from 675° C. to 500° C. was 10° C./minute.

Next, the first heat treatment material A1-7 was subjected to face milling to be as thick as 11 mm, it was subjected to a first cold rolling process, and a first cold processing material A2-7 with a thickness of 3.25 mm was obtained. In this case, the processing rate is 70%.

The first cold processing material A2-7 was subjected to a second heat treatment, and a second heat treatment material A3-7 was obtained. This heat treatment includes a heating process of heating the first cold processing material A2-7 at 575° C. for 3 hours, and a cooling process of slowly cooling it at an average cooling rate of 0.3° C./minute down to 500° C.

The second heat treatment material A3-7 was subjected to a second cold rolling process, and Example Alloys No. 701 and No. 702 with a thickness of 2.6 mm were obtained. In this case, the processing rate is 20%.

Alloy compositions of Example Alloys No. 701 and No. 702 which are the hot processing materials (hot rolled materials) obtained as described above are as shown in Table 2.

(Process M8)

The hot processing raw material A was subjected to a first heat treatment, and a first heat treatment material A1-8 was obtained. This heat treatment includes a heating process of heating the raw material A at 675° C. for 6 hours, and a cooling process of slowly cooling it at an average cooling rate of 0.4° C./minute down to 500° C.

Next, the first heat treatment material A1-8 was subjected to face milling to be as thick as 11 mm, it was subjected to a first cold rolling process, and a first cold processing material A2-8 with a thickness of 3.25 mm was obtained. In this case, the processing rate is 70%.

The first cold processing material A2-8 was subjected to a second heat treatment (490° C., 8 hours), and a second heat treatment A3-8 was obtained.

The second heat treatment material A3-8 was subjected to a second cold rolling process, and Example Alloys No. 801 and No. 802 with a thickness of 2.6 mm were obtained. In this case, the processing rate is 20%.

Alloy compositions of Example Alloys No. 801 and No. 802 which are the hot processing materials (hot rolled materials) obtained as described above are as shown in Table 2.

(Process M9)

The hot processing raw material A was subjected to a first heat treatment, and a first heat treatment material A1-9 was obtained. This heat treatment includes a heating process of heating the raw material A at 675° C. for 6 hours, and a cooling process of slowly cooling it at an average cooling rate of 0.4° C./minute down to 500° C.

Next, the first heat treatment material A1-9 was subjected to face milling to be as thick as 11 mm, it was subjected to a first cold rolling process, and a first cold processing material A2-9 with a thickness of 3.25 mm was obtained. In this case, the processing rate is 70%.

The first cold processing material A2-9 was subjected to a second heat treatment, and a second heat treatment material A3-9 was obtained. This heat treatment includes a heating process of heating the first-order cold processing material A2-9 at 530° C. for 3 hours, and a cooling process of slowly cooling it at an average cooling rate of 0.3° C./minute down to 500° C.

The second heat treatment material A3-9 was subjected to a second cold rolling process, and Example Alloys No. 901 and No. 902 with a thickness of 2.6 mm were obtained. In this case, the processing rate is 20%.

Alloy compositions of Example Alloys No. 901 and No. 902 which are the hot processing materials (hot rolled materials) obtained as described above are as shown in Table 2.

(Process M10)

The hot processing raw material B was subjected to a first heat treatment, and a first heat treatment material B1-1 was obtained. This heat treatment includes a heating process of heating the raw material B at 620° C. for 12 hours, and a cooling process of slowly cooling it at an average cooling rate of 0.4° C./minute down to 500° C.

Next, the first heat treatment material B1-1 was subjected to pickling, it was subjected to a drawing process that is a first cold process, and a first cold processing material B2-1 with a diameter of 16.5 mm was obtained. In this case, the processing rate is 49%.

The first cold processing material B2-1 was subjected to a second heat treatment, and a second heat treatment material B3-1 was obtained. This heat treatment includes a heating process of heating the first cold processing material B2-1 at 560° C. for 16 hours, and a cooling process of slowly cooling it at an average cooling rate of 0.3° C./minute down to 500° C.

The second heat treatment material B3-1 was subjected to a second drawing process, and Example Alloys No. 1001 to No. 1007 with a diameter of 14.5 mm were obtained. In this case, the processing rate is 23%.

Alloy compositions of Example Alloys No. 1001 to No. 1007 which are the hot processing materials (hot extruded materials) obtained as described above are as shown in Table 2.

(Process M11)

The hot processing raw material B was subjected to a first heat treatment, and a first heat treatment material B1-2 was obtained. This heat treatment includes a heating process of heating the raw material B at 635° C. for 6 hours, and a cooling process of slowly cooling it at an average cooling rate of 0.4° C./minute down to 500° C.

Next, the first heat treatment material B1-2 was subjected to pickling, it was subjected to a first drawing process, and a first cold processing material B2-2 with a diameter of 16.5 mm was obtained. In this case, the processing rate is 49%.

The first cold processing material B2-2 was subjected to a second heat treatment, and a second heat treatment material B3-2 was obtained. This heat treatment includes a heating process of heating the first cold processing material B2-2 at 575° C. for 6 hours, and a cooling process of slowly cooling it at an average cooling rate of 0.3° C./minute down to 500° C.

The second heat treatment material B3-2 was subjected to a second drawing process, and Example Alloys No. 1101 to No. 1108 with a diameter of 14.5 mm were obtained. In this case, the processing rate is 23%.

Alloy compositions of Example Alloys No. 1101 to No. 1108 which are the hot processing materials (hot extruded materials) obtained as described above are as shown in Table 2 or Table 3.

(Process M12)

The hot processing raw material B was subjected to a first drawing process without performing a heat treatment, unlike Processes M11 and M12. That is, the raw material B was subjected to pickling, it was subjected to the first drawing process, and a first cold processing material B2-3 with a diameter of 16.5 mm was obtained. In this case, the processing rate is 49%.

The first cold processing material B2-3 was subjected to a heat treatment, and a heat treatment material B3-3 was obtained. This heat treatment includes a heating process of heating the first cold processing material B2-3 at 560° C. for 16 hours, and a cooling process of slowly cooling it at an average cooling rate of 0.3° C./minute down to 500° C.

The second heat treatment material B3-3 was subjected to a second drawing process, and Example Alloys No. 1201 and No. 1202 with a diameter of 14.5 mm were obtained. In this case, the processing rate is 23%.

Alloy compositions of Example Alloys No. 1201 and No. 1202 which are the hot processing materials (hot extruded materials) obtained as described above are as shown in Table 3.

(Process M13)

The hot processing raw material B was subjected to a first heat treatment (490° C., 12 hours), and a first heat treatment material B1-4 was obtained.

Next, the first heat treatment material B1-4 was subjected to pickling, it was subjected to a first drawing process, and a first cold processing material B2-4 with a diameter of 16.5 mm was obtained. In this case, the processing rate is 49%.

The first cold processing material B2-4 was subjected to a second heat treatment, and a second heat treatment material B3-4 was obtained. This heat treatment includes a heating process of heating the first cold processing material B2-4 at 560° C. for 16 hours, and a cooling process of slowly cooling it at an average cooling rate of 0.3° C./minute down to 500° C.

The second heat treatment material B3-4 was subjected to a second drawing process, and Example Alloys No. 1301 and No. 1302 with a diameter of 14.5 mm were obtained. In this case, the processing rate is 23%.

Alloy compositions of Example Alloys No. 1301 and No. 1302 which are the hot processing materials (hot extruded materials) obtained as described above are as shown in Table 3.

(Process M14)

The casting raw material C was subjected to a first heat treatment, and a first heat treatment material C1-1 was obtained. This heat treatment includes a heating process of heating the raw material C at 670° C. for 12 hours, and a cooling process of slowly cooling it at an average cooling rate of 0.4° C./minute down to 500° C.

Next, the first heat treatment material C1-1 was subjected to face milling to be as thick as 36 mm, it was subjected to a cold rolling process that is a first cold process, and a first cold processing material C2-1 with a thickness of 18 mm was obtained. In this case, the processing rate is 50%.

The first cold processing material C2-1 was subjected to a second heat treatment (final heat treatment), and a second heat treatment material C3-1 was obtained. This heat treatment includes a heating process of heating the first cold processing material C2-1 at 565° C. for 16 hours, and a cooling process of slowly cooling it at an average cooling rate of 0.3° C./minute down to 500° C.

The second heat treatment material C3-1 was subjected to a second cold rolling process, and Example Alloys No. 1401 to No. 1408 with a thickness of 14.5 mm were obtained. In this case, the processing rate is 19%.

Alloy compositions of Example Alloys No. 1401 to No. 1408 which are the continuous casting materials obtained as described above are as shown in Table 3.

(Process M15)

The casting raw material C was subjected to a first heat treatment, and a first heat treatment material C1-2 was obtained. This heat treatment includes a heating process of heating the raw material C at 700° C. for 6 hours, and a cooling process of slowly cooling it at an average cooling rate of 0.4° C./minute down to 500° C.

Next, the first heat treatment material C1-2 was subjected to face milling to be as thick as 36 mm, it was subjected to a first cold rolling process, and a first cold processing material C2-2 with a thickness of 18 mm was obtained. In this case, the processing rate is 50%.

The first cold processing material C2-2 was subjected to a second heat treatment (final heat treatment), and a second heat treatment material C3-2 was obtained. This heat treatment includes a heating process of heating the first cold processing material C2-2 at 580° C. for 6 hours, and a cooling process of slowly cooling it at an average cooling rate of 0.3° C./minute down to 500° C.

The second heat treatment material C3-2 was subjected to a second cold rolling process, and Example Alloys No. 1501 to No. 1509 with a thickness of 14.5 mm were obtained. In this case, the processing rate is 19%.

Alloy compositions of Example Alloys No. 1501 to No. 1509 which are the continuous casting materials obtained as described above are as shown in Table 3 or Table 4.

(Process M16)

The hot processing raw material C was subjected to a first cold rolling process without performing a heat treatment, unlike Processes M14 and M15. That is, the raw material C was subjected to face milling to be as thick as 36 mm, it was subjected to the first cold rolling process, and a first cold processing material C2-3 with a thickness of 18 mm was obtained. In this case, the processing rate is 50%.

The first cold processing material C2-3 was subjected to a heat treatment, and a heat treatment material C3-3 was obtained. This heat treatment includes a heating processing of heating the first cold processing material C2-3 at 580° C. for 6 hours, and a cooling process of slowing cooling it at an average cooling rate 0.3° C./minute down to 500° C.

The heat treatment material C3-3 was subjected to a second cold rolling process, and Example Alloys No. 1601 and No. 1602 with a thickness of 14.5 mm were obtained. In this case, the processing rate is 19%.

Alloy compositions of Example Alloys No. 1601 and No. 1602 which are the continuous casting materials obtained as described above are as shown in Table 4.

(Process M17)

The casting raw material D was subjected to a first heat treatment, and a first heat treatment material D1-1 was obtained. This heat treatment includes a heating process of heating the raw material D at 650° C. for 12 hours, and a cooling process of slowly cooling it at an average cooling rate of 0.4° C./minute down to 500° C.

Next, the first heat treatment material D1-1 was subjected to face milling to be as thick as 11 mm, it was subjected to a first cold rolling process, and a first cold processing material D2-1 with a thickness of 3.25 mm was obtained. In this case, the processing rate is 70%.

The first cold processing material D2-1 was subjected to a second heat treatment (final heat treatment), and a second heat treatment material D3-1 was obtained. This heat treatment includes a heating process of heating the first cold processing material D2-1 at 565° C. for 16 hours, and a cooling process of slowly cooling it at an average cooling rate of 0.3° C./minute down to 500° C.

The second heat treatment D3-1 was subjected to a second cold rolling process, and Example Alloys No. 1701 to No. 1706 with a thickness of 2.6 mm were obtained. In this case, the processing rate is 20%.

Alloy compositions of Example Alloys No. 1701 to No. 1706 which are the continuous casting materials obtained as described above are as shown in Table 4.

(Process M18)

The casting raw material D was subjected to a first heat treatment, and a first heat treatment material D1-2 was obtained. This heat treatment includes a heating process of heating the raw material D at 675° C. for 6 hours, and a cooling process of slowly cooling it at an average cooling rate of 0.4° C./minute down to 500° C.

Next, the first heat treatment material D1-2 was subjected to face milling to be as thick as 11 mm, it was subjected to a first cold rolling process, and a first cold processing material D2-2 with a thickness of 3.25 mm was obtained. In this case, the processing rate is 70%.

The first cold processing material D2-2 was subjected to a second heat treatment (final heat treatment), and a second heat treatment material D3-2 was obtained. This heat treatment includes a heating process of heating the first cold processing material D2-2 at 575° C. for 3 hours, and a cooling process of slowly cooling it at an average cooling rate of 0.3° C./minute down to 500° C.

The second heat treatment material D3-2 was subjected to a second cold rolling process, and Example Alloys No. 1801 to No. 1813 with a thickness of 2.6 mm were obtained. In this case, the processing rate is 20%.

Alloy compositions of Example Alloys No. 1801 to No. 1813 which are the continuous casting materials obtained as described above are as shown in Table 4 or Table 5.

(Process M19)

The casting raw material D was subjected to a first heat treatment, and a first heat treatment material D1-3 was obtained. This heat treatment includes a heating process of heating the raw material D at 675° C. for 6 hours, and a cooling process of slowly cooling it at an average cooling rate of 0.4° C./minute down to 500° C. and keeping it at 530° C. for 1 hour during the cooling (it is kept at 530° C. during cooling down to 500° C. and is cooled at 0.4° C./minute down to 500° C. Re-heating to 530° C. is not performed.).

Next, the first heat treatment material D1-3 was subjected to face milling to be as thick as 11 mm, it was subjected to a first cold rolling process, and a first cold processing material D2-3 with a thickness of 3.25 mm was obtained. In this case, the processing rate is 70%.

The first cold processing material D2-3 was subjected to a second heat treatment (final heat treatment), and a second heat treatment material D3-3 was obtained. This heat treatment includes a heating process of heating the first cold processing material D2-3 at 575° C. for 3 hours, and a cooling process of slowly cooling it at an average cooling rate of 0.3° C./minute down to 530° C., keeping it at 530° C. for 1 hour, and cooling it at an average cooling rate of 0.3° C./minute down to 500° C. (the same as the part described in the paragraph [0058]).

The second heat treatment material D3-3 was subjected to a second cold rolling process, and Example Alloys No. 1901 and No. 1902 with a thickness of 2.6 mm were obtained. In this case, the processing rate is 20%.

Alloy compositions of Example Alloys No. 1901 and No. 1902 which are the continuous casting materials obtained as described above are as shown in Table 5.

(Process M20)

The hot processing raw material D was subjected to a first heat treatment, and a first heat treatment material D1-4 was obtained. This heat treatment includes a heating process of heating the raw material D at 650° C. for 12 hours, and a cooling process of slowly cooling it at an average cooling rate of 0.4° C./minute down to 500° C.

Next, the first heat treatment material D1-4 was subjected to face milling to be as thick as 11 mm, it was subjected to a first cold rolling process, and a first cold processing material D2-4 with a thickness of 5 mm was obtained. In this case, the processing rate is 55%.

The first cold processing material D2-4 was subjected to a second heat treatment, and a second heat treatment material D3-4 was obtained. This heat treatment includes a heating process of heating the first cold processing material D2-4 at 575° C. for 3 hours, and a cooling process of slowly cooling it at an average cooling rate of 0.3° C./minute down to 500° C.

Next, the second heat treatment material D3-4 was subjected to a second cold rolling process, and a second cold processing material D4-4 with a thickness of 3.25 mm was obtained. In this case, the processing rate is 35%.

The second cold processing material D4-4 was subjected to a third heat treatment (final heat treatment), and a third heat treatment material D5-4 was obtained. This heat treatment includes a heating process of heating the second cold processing material D4-4 at 565° C. for 8 hours, and a cooling process of slowing cooling it at an average cooling rate 0.3° C./minute down to 500° C.

The third heat treatment material D5-4 was subjected to a third cold rolling process, and Example Alloys No. 2001 to No. 2003 with a thickness of 2.6 mm were obtained. In this case, the processing rate is 20%.

Alloy compositions of Example Alloys No. 2001 to No. 2003 which are the continuous casting materials obtained as described above are as shown in Table 5.

(Process M21)

The hot processing raw material D was subjected to a first cold rolling process without performing a heat treatment, unlike Processes M17 to M20. That is, the raw material D was subjected to face milling to be as thick as 11 mm, it was subjected to the first cold rolling process, and a first cold processing material D2-5 with a thickness of 3.25 mm was obtained. In this case, the processing rate is 70%.

The first cold processing material D2-5 was subjected to a heat treatment, and a heat treatment material D3-5 was obtained. This heat treatment includes a heating processing of heating the first cold processing material D2-5 at 575° C. for 3 hours, and a cooling process of slowing cooling it at an average cooling rate 0.3° C./minute down to 500° C.

The heat treatment material D3-5 was subjected to a second cold rolling process, and Example Alloys No. 2101 to No. 2105 with a thickness of 2.6 mm were obtained. In this case, the processing rate is 20%.

Alloy compositions of Example Alloys No. 2101 to No. 2105 which are the continuous casting materials obtained as described above are as shown in Table 5.

(Process M22)

The casting raw material D was subjected to a first heat treatment, and a first heat treatment material D1-6 was obtained. This heat treatment includes a heating process of heating the raw material D at 540° C. for 6 hours, and a cooling process of slowly cooling it at an average cooling rate of 0.4° C./minute down to 500° C.

Next, the first heat treatment material D1-6 was subjected to face milling to be as thick as 11 mm, it was subjected to a first cold rolling process, and a first cold processing material D2-6 with a thickness of 3.25 mm was obtained. In this case, the processing rate is 70%.

The first cold processing material D2-6 was subjected to a second heat treatment (final heat treatment), and a second heat treatment material D3-6 was obtained. This heat treatment includes a heating process of heating the first cold processing material D2-6 at 575° C. for 3 hours, and a cooling process of slowly cooling it at an average cooling rate of 0.3° C./minute down to 500° C.

The second heat treatment material D3-6 was subjected to a second cold rolling process, and Example Alloys No. 2201 and No. 2202 with a thickness of 2.6 mm were obtained. In this case, the processing rate is 20%.

Alloy compositions of Example Alloys No. 2201 and No. 2202 which are the continuous casting materials obtained as described above are as shown in Table 5.

(Process M23)

The hot processing raw material D was subjected to a first heat treatment, and a first heat treatment material D1-7 was obtained. In this heat treatment, the raw material D was heated at 675° C. for 6 hours and was air-cooled. In this air cooling, an average cooling rate down to 500° C. from 675° C. was 10° C./minute.

Next, the first heat treatment material D1-7 was subjected to face milling to be as thick as 11 mm, it was subjected to a first cold rolling process, and a first cold processing material D2-7 with a thickness of 3.25 mm was obtained. In this case, the processing rate is 70%.

The first cold processing material D2-7 was subjected to a second heat treatment, and a second heat treatment material D3-7 was obtained. This heat treatment includes a heating process of heating the first cold processing material D2-7 at 575° C. for 3 hours, and a cooling process of slowly cooling it at an average cooling rate of 0.3° C./minute down to 500° C. That is, a cooling process of slowing cooling it at an average cooling rate of 0.3° C./minute down to 500° C.

The second heat treatment material D3-7 was subjected to a second cold rolling process, and Example Alloys No. 2301 and No. 2302 with a thickness of 2.6 mm were obtained. In this case, the processing rate is 20%.

Alloy compositions of Example Alloys No. 2301 and No. 2302 which are the continuous casting materials obtained as described above are as shown in Table 5.

(Process M24)

The hot processing raw material D was subjected to a first heat treatment, and a first heat treatment material D1-8 was obtained. This heat treatment includes a heating process of heating the raw material D at 675° C. for 6 hours, and a cooling process of slowly cooling it at an average cooling rate of 0.4° C./minute down to 500° C.

Next, the first heat treatment material D1-8 was subjected to face milling to be as thick as 11 mm, it was subjected to a cold rolling process that is a first cold process, and a first cold processing material D2-8 with a thickness of 3.25 mm was obtained. In this case, the processing rate is 70%.

The first cold processing material D2-8 was subjected to a second heat treatment (490° C., 8 hours), and a second heat treatment D3-8 was obtained.

The second heat treatment material D3-8 was subjected to a second cold rolling process, and Example Alloys No. 2401 to No. 2403 with a thickness of 2.6 mm were obtained. In this case, the processing rate is 20%.

Alloy compositions of Example Alloys No. 2401 to No. 2403 which are the continuous casting materials obtained as described above are as shown in Table 5.

(Process M25)

The hot processing raw material D was subjected to a first heat treatment, and a first heat treatment material D1-9 was obtained. This heat treatment includes a heating process of heating the raw material D at 675° C. for 6 hours, and a cooling process of slowly cooling it at an average cooling rate of 0.4° C./minute down to 500° C.

Next, the first heat treatment material D1-9 was subjected to face milling to be as thick as 11 mm, it was subjected to a cold rolling process that is a first cold process, and a first cold processing material D2-9 with a thickness of 3.25 mm was obtained. In this case, the processing rate is 70%.

The first cold processing material D2-9 was subjected to a second heat treatment, and a second heat treatment material D3-9 was obtained. This heat treatment includes a heating process of heating the first cold processing material D2-9 at 530° C. for 3 hours, and a cooling process of slowly cooling it at an average cooling rate of 0.3° C./minute down to 500° C.

The second heat treatment material D3-9 was subjected to a second cold rolling process, and Example Alloys No. 2501 and No. 2502 with a thickness of 2.6 mm were obtained. In this case, the processing rate is 20%.

Alloy compositions of Example Alloys No. 2501 and No. 2502 which are the continuous casting materials obtained as described above are as shown in Table 5.

As comparative Examples, copper alloys (hereinafter, referred to as "Comparative Example Alloy") No. 3001 to No. 3008, No. 3101 to No. 3108, No. 3201 to No. 3203, No. 3301, No. 3302, No. 3401, No. 3402, No. 3501 to No. 3503, No. 3601 to No. 3603, No. 3701 to No. 3707, No. 3801, and No. 3901 to No. 3906 shown in Table 6 and Table 7 were obtained.

Comparative Example Alloys No. 3001 to No. 3008 are hot processing materials (hot rolled materials) produced by the same process as Process M2 of the examples, using the hot processing raw material A having the same shape obtained by the same process as that of the examples except for the difference in alloy composition. Alloy compositions of Comparative Example Alloys No. 3001 to No. 3008 and the raw material A used to produce the same are as shown in Table 6.

Comparative Example Alloys No. 3101 to No. 3108 are hot processing materials (hot rolled materials) produced by the same process as Process M5 of the examples, using the hot processing raw material A having the same shape obtained by the same process as that of the examples except for the difference in alloy composition. Alloy compositions of Comparative Example Alloys No. 3101 to No. 3108 and the raw material A used to produce the same are as shown in Table 6.

Comparative Example Alloys No. 3201 to No. 3203 are hot processing materials (hot extruded materials) produced by the same process as Process M10 of the examples, using the hot processing raw material B having the same shape obtained by the same process as that of the examples except for the difference in alloy composition. Alloy compositions of Comparative Example Alloys No. 3201 to No. 3203 and the raw material B used to produce the same are as shown in Table 6.

Comparative Example Alloys No. 3301 and No. 3302 are hot processing materials (hot extruded materials) produced by the same process as Process M12 of the examples, using the hot processing raw material B having the same shape obtained by the same process as that of the examples except for the difference in alloy composition. Alloy compositions of Comparative Example Alloys No. 3301 and No. 3302 and the raw material B used to produce the same are as shown in Table 6.

Comparative Example Alloys No. 3401 and No. 3402 are continuous casting materials produced by the same process as Process M14 of the examples, using the continuous casting raw material C having the same shape obtained by the same process as that of the examples except for the difference in alloy composition. Alloy compositions of Comparative Example Alloys No. 3401 and No. 3402 and the raw material C used to produce the same are as shown in Table 7.

Comparative Example Alloys No. 3501 to No. 3503 are continuous casting materials produced by the same process as Process M15 of the examples, using the continuous casting raw material C having the same shape obtained by the same process as that of the examples except for the difference in alloy composition. Alloy compositions of Comparative Example Alloys No. 3501 to No. 3503 and the raw material C used to produce the same are as shown in Table 7.

Comparative Example Alloys No. 3601 to No. 3603 are continuous casting materials produced by the same process as Process M16 of the examples, using the continuous casting raw material C having the same shape obtained by the same process as that of the examples except for the difference in alloy composition. Alloy compositions of Comparative Example Alloys No. 3601 to No. 3603 and the raw material C used to produce the same are as shown in Table 7.

Comparative Example Alloys No. 3701 to No. 3707 are continuous casting materials produced by the same process as Process M18 of the examples, using the continuous casting raw material D having the same shape obtained by the same process as that of the examples except for the difference in alloy composition. Alloy compositions of Comparative Example Alloys No. 3701 to No. 3707 and the raw material D used to produce the same are as shown in Table 7.

Comparative Example Alloy No. 3801 is a continuous casting material produced by the same process as Process M21 of the examples, using the continuous casting raw material D having the same shape obtained by the same process as that of the examples except for the difference in alloy composition. Alloy compositions of Comparative Example Alloy No. 3801 and the raw material D used to produce the same are as shown in Table 7.

Comparative Example Alloys No. 3901 to No. 3903 are commercially available temper-"H" materials with a thickness of 2.4 mm whose compositions are shown in Table 7. Comparative Example Alloys No 3904 to No. 3906 are commercially available rod materials with a diameter of 15 mm put whose compositions are shown in Table 5. Based on the alloy compositions, No. 3901 and No. 3904 correspond to CDA C79200. No. 3902, No. 3903, No. 3905 and No. 3906 correspond to JIS C3710, JIS C2801, JIS C3712, and JIS C2800, respectively.

Figure 2:
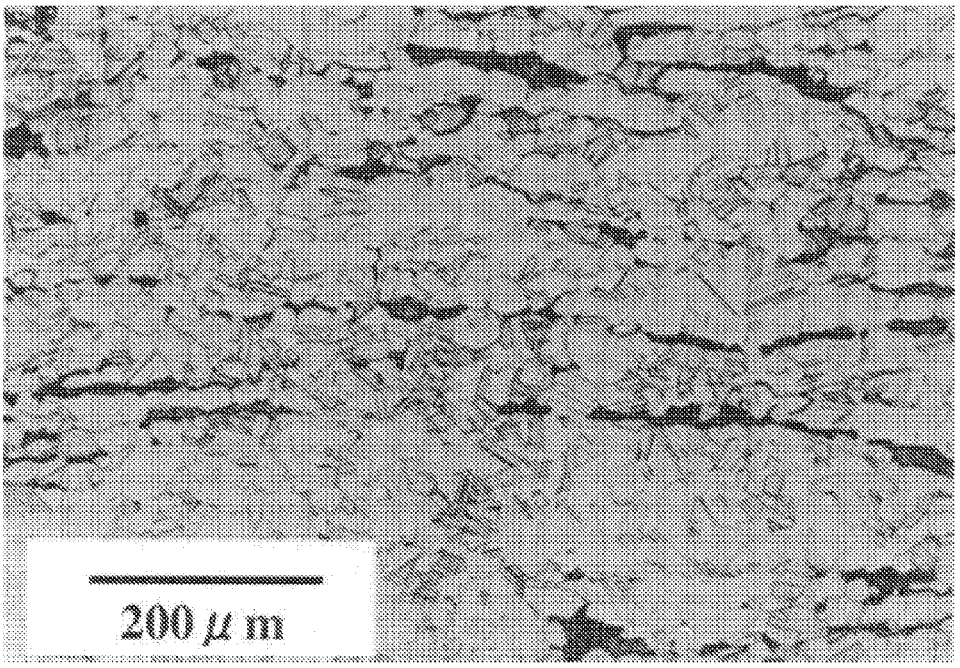
FIG. 2 is a photograph of an etching surface illustrating a metal structure of a first heat treatment material A1-2 obtained from a producing process of Example Alloy No. 201.

FIG. 1 and FIG. 2 are photographs of an etching surface of Example Alloy No. 201. FIG. 1 shows a metal structure of the hot processing raw material A, and it is understood from FIG. 1 that β phases in the raw materials A are in a net-like fashion.

FIG. 2 shows a metal structure of the first heat treatment material A1-2 obtained by performing a heat treatment at 675° C. on the raw material A. It is understood from FIG. 2 that the net-like structure of β phases is disappeared (segmentalized) by the high temperature heat treatment, that the β phases are dispersed, and that a ratio occupied by β phases is lowered by the precipitation of α phases.

Figure 3:
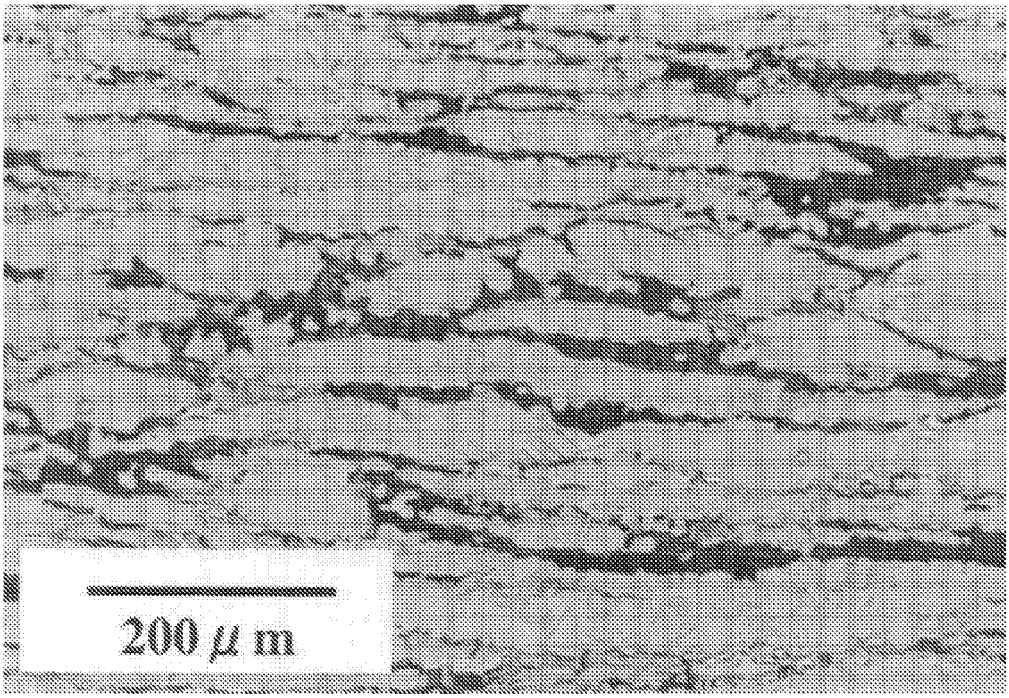
FIG. 3 is a photograph of an etching surface illustrating a metal structure of a heat treatment material obtained by performing a different heat treatment from that of Process M2 on the raw material A of Example Alloy No. 201.
Figure 4:
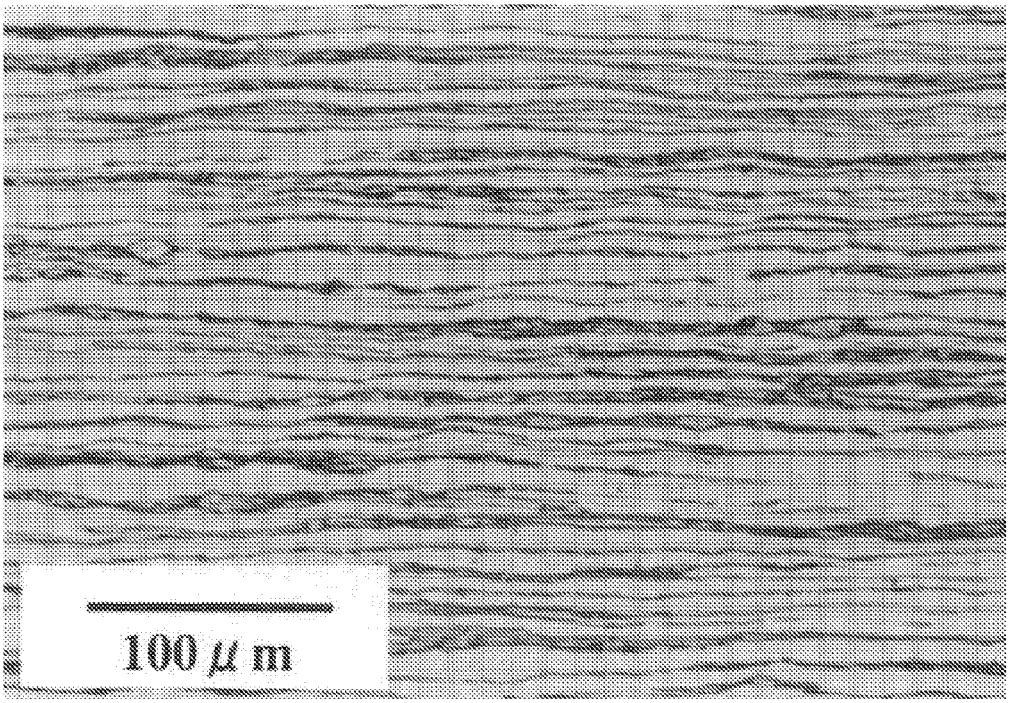
FIG. 4 is photograph of an etching surface illustrating a metal structure of a cold processing material obtained by performing the same cold rolling process as Process M2 on the raw material A of Example Alloy No. 201 without performing a heat treatment.

FIG. 3 and FIG. 4 are photographs of an etching surface of the raw material A of Example Alloy No. 201, which is subjected to a heat treatment or a cold process different from Process M2. That is, FIG. 3 shows a metal structure of a heat treatment material obtained by performing a heat treatment different from Process M2 (keeping at 540° C. for 6 hours, slowly cooling at 0.4° C./minute down to 500° C., and then air-cooling) on the raw material A under a low temperature condition, and FIG. 4 shows a metal structure of a cold processing material obtained by performing the same cold rolling (processing rate 70%) as Process M2 without performing a heat treatment on the raw material A unlike Process M2. It is understood from FIG. 3 that a ratio occupied by β phases is decreased by precipitation of α phases but the netted structure of β phases is not disappeared since the heat treatment temperature is low. In addition, it is understood from FIG. 4 that the layered β phases exist in a large amount since a heat treatment is not performed before the cold rolling.

Figure 5:
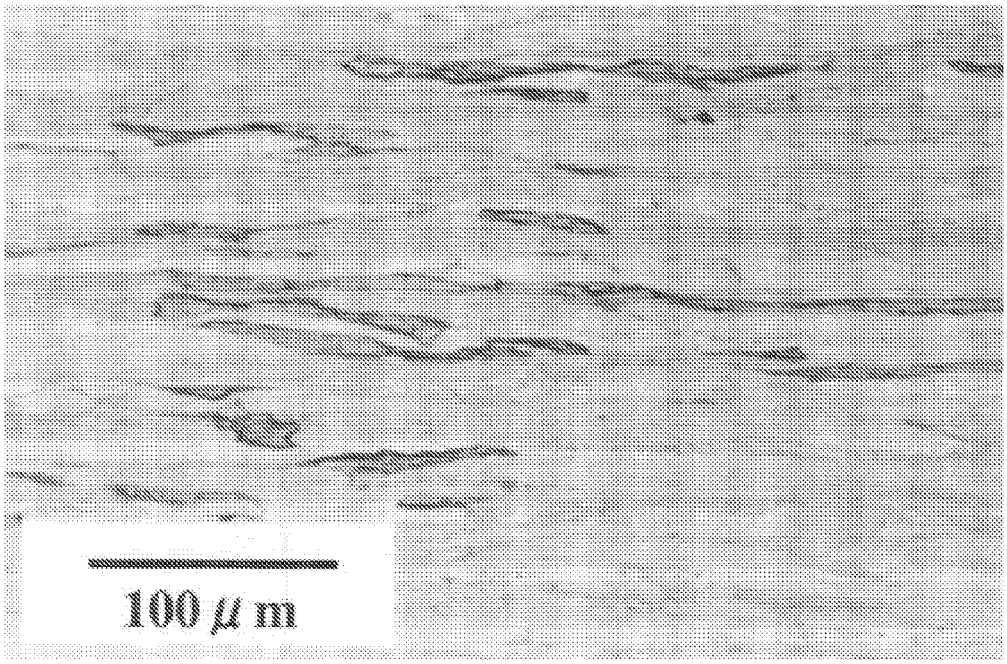
FIG. 5 is a photograph of an etching surface illustrating a metal structure of a first cold processing material A2-2 from Example Alloy No. 201.
Figure 6:
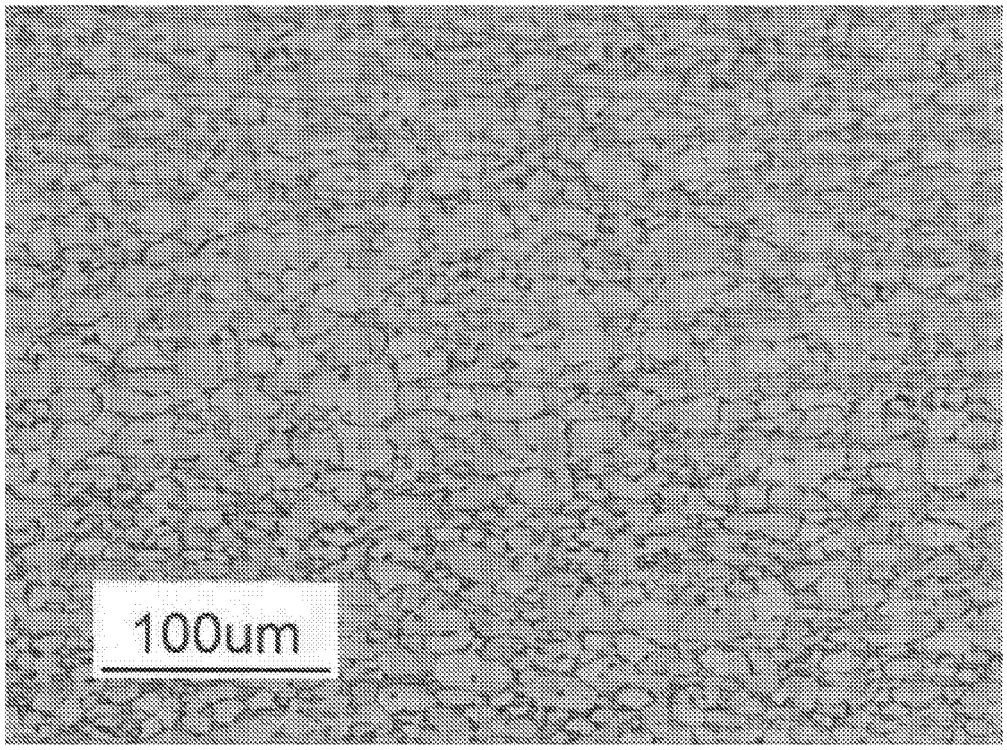
FIG. 6 is a photograph of an etching surface illustrating a metal structure of a second heat treatment material A3-2 obtained from the producing process of Example Alloy No. 201.

FIG. 5 is a photograph of an etching surface illustrating a metal structure of the first cold processing material A2-2 of Example Alloy No 201. It is understood from FIG. 5 that the amount of β phases is small and the β phases are elongated in a rolling direction by the cold rolling in the same manner as shown in FIG. 2. FIG. 6 is a photograph of an etching surface illustrating a metal structure of the second heat treatment material A3-2 obtained by performing a heat treatment (575° C.) on the first processing material A2-2 shown in FIG. 5. As can be seen clearly in comparison with FIG. 5, β phases are uniformly dispersed in α phases of matrix, and the shape and size (average value of long side/short side, etc.) are in the optimal formation as described above.

Figure 7:
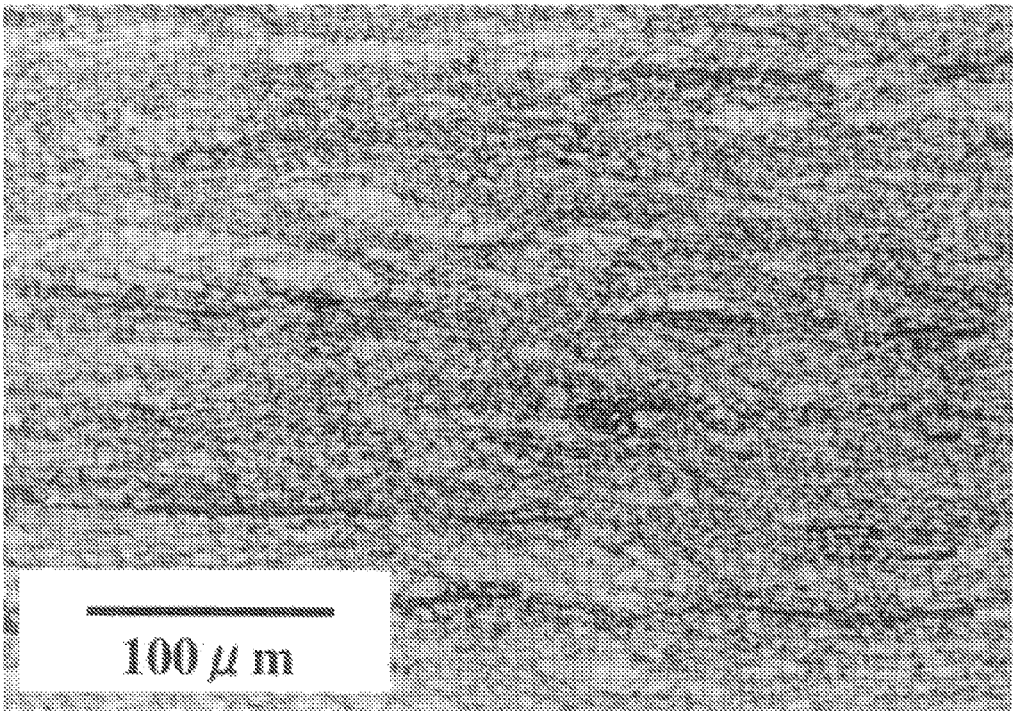
FIG. 7 is a photograph of an etching surface illustrating a metal structure of a heat treatment material obtained by performing a different heat treatment from that of Process M2 on the first cold processing material A2-2 obtained from the producing process of Example Alloy No. 201.
Figure 8:
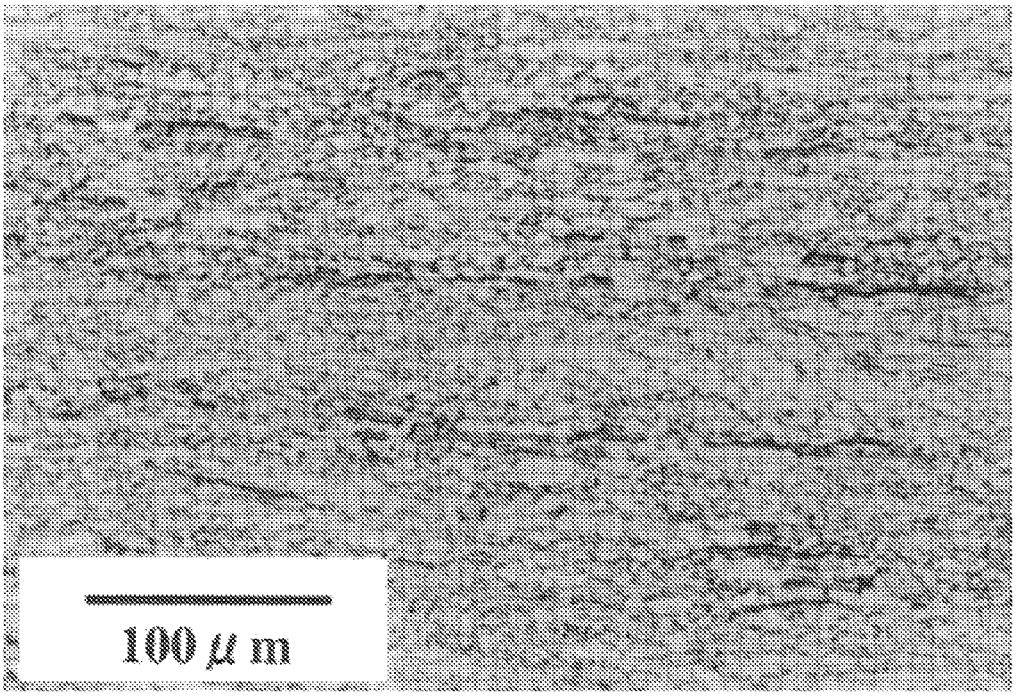
FIG. 8 is a photograph of an etching surface illustrating a metal structure of a heat treatment material obtained by performing a different heat treatment from that of Process M2 on the cold processing material (the first cold processing material A2-2 from Example Alloy No. 201) shown in FIG. 5.
Figure 9:
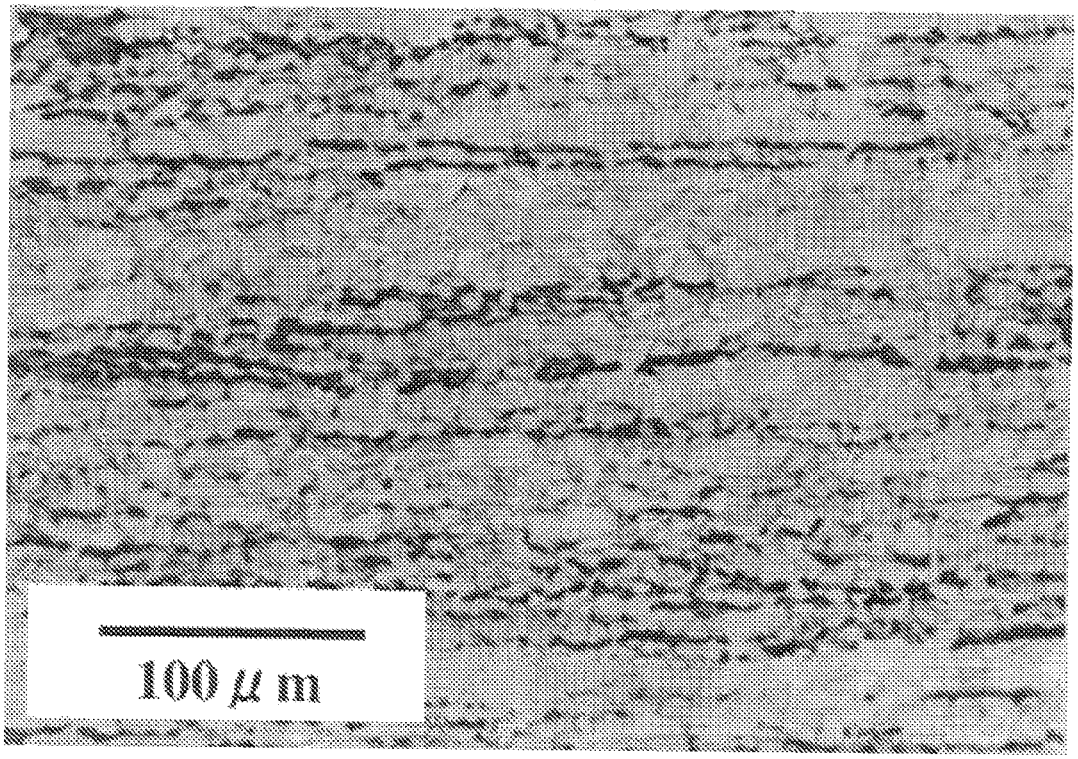
FIG. 9 is an etching photograph illustrating a metal structure of a heat treatment material obtained by performing a heat treatment under the same condition as that of Process M2 on the cold processing material (which is subjected to a cold process without performing a heat treatment thereon) shown in FIG. 4.

FIG. 7 is a photograph of an etching surface illustrating a metal structure of a heat treatment material obtained by a heat treatment (490° C., 8 hours) at a low temperature unlike Process M2 on the cold processing materials (first cold processing material A2-2 of Example Alloy No. 201) shown in FIG. 5. It is understood from FIG. 7 that precipitation caused by α phases is insufficient due to the low temperature heat treatment, that β phases are longitudinally continued, and on the other hand, the β phases are precipitated around grain boundaries, unlike the case shown in FIG. 6. It is clear that the amount of β phases is increased and α phase grains are in a non-recrystallization state, that the longitudinal β phases continued in the rolling direction and refined β phases are mixed, and that the condition of the average value of long side/short side is not satisfied. FIG. 8 is a photograph of an etching surface illustrating a metal structure of a heat treatment material obtained by performing a heat treatment (530° C., 3 hours, average cooling rate down to 500° C.: 0.4° C./minute) under the condition of a temperature lower than the heat treatment temperature (575° C.) of Process M2, on the cold processing material (first cold processing material A2-2 of Example Alloy No. 201) shown in FIG. 5. It is understood from FIG. 8 that the precipitate caused by α phases is still insufficient since the heat treatment temperature is higher than that of the case of FIG. 7 but lower than that of Process M2, that β phases are longitudinally continued, and that the long side/short side is large. FIG. 9 is an etching photograph illustrating a metal structure of a heat treatment material obtained by performing a heat treatment (575° C., 3 hours, average cooling rate down to 500° C.: 0.4° C./minute) under the same condition as Process M2, on the cold processing material (a raw material is subjected to a cold process without performing a heat treatment) shown in FIG. 4. It is clearly understood from FIG. 9 that α phases are precipitated by the heat treatment, segmentalization (dissolution disappearance of net shape) of β phases proceeds, that the β phases are still longitudinally continued nevertheless, that the long side/short side is large and insufficient. Accordingly, the disadvantage that a heat treatment is not performed on the raw material A before cold process is clearly understood.

As for Example Alloys and Comparative Example Alloys, a ratio (hereinafter, referred to as "raw material β phase ratio") occupied by β phases in the raw materials A, B, C, and D, a long side/short side ratio (average value of long side/short side) of β phases, and the number of β phases (hereinafter, referred to as "the number of β phase of 0.5 mm or more") having a long side of 0.5 mm or more per 0.1 $mm^2$ were measured. A ratio (hereinafter, referred to as "β phase ratio after heat treatment") occupied by β phases in the heat treatment material obtained by performing a heat treatment on the raw materials A, B, C, and D was measured, and a ratio (hereinafter, referred to as "product β phase ratio") of β phases in a product (before finishing process), a β phase area (average area of β phases), a long side/short side ratio (average value of long side/short side of β phases), a β phase ratio of 12 or less (ratio of β phases with a value of long side/short side of 12 or less to the whole β phases), the number of β phases (hereinafter, referred to as "the number of β phases of 0.06 mm or more") having a long side of 0.06 mm or more per 0.1 $mm^2$, and an α phase diameter (average grain size of α phases) were measured.

The average grain size was measured according to an FE-SEM-EBSP (Electron Back Scattering diffraction Pattern) method. That is, FE-SEM is JSM-7000F manufactured by JEOL, Ltd., TSL solutions OIM-Ver. 5.1 was used for analysis, and the average grain size was measured from a grain size map (Grain Map) of 200-fold magnification and 500-fold magnification in analysis. A method of calculating the average grain size is based on a quadrature method (JIS H 0501).

The ratio (β phase ratio) occupied by β phases was measured by the FE-SEM-EBSP method. FE-SEM is JSM-7000F manufactured by JEOL, Ltd., OIM-VER. 5.1 manufacture by TSL solutions, Ltd. was used for analysis, and it was measured from a phase map (Phase Map) of 200-fold magnification and 500-fold magnification in analysis.

The length (long side, short side) and area of β phases were measured by the FE-SEM-EBSP method. The maximum length, long side length, and short side length of β phases were calculated by binarization using the image processing software "WinROOF" from a phase map of 200-fold magnification and 500-fold magnification in analysis.

The measured and calculated results are as shown in Tables 8 to 14, and it was confirmed that Example Alloys satisfy the above-described proper conditions about α phases and β phases. As for the number of β phases of 0.5 mm or more and the number of β phases of 0.06 mm or more, the optimal range of less than 5 is represented by "○", the proper range of 5 to 10, although not optimal, is represented by "Δ", and the range of over 10 out of the proper range is represented by "X". A macro structure of a casting material is obtained by pouring a melt into a permanent mold with an inner diameter of 40 mm and a height of 50 mm, polishing a transverse cross section of the cast material, and etching it with nitric acid to reveal the macro structure. The macro structure was observed in an enlarged image at about 25-fold magnification from a real size, and an average grain size ("grain size of macro structure" represented in Tables) was measured by a comparison method.

As for Example Alloys and Comparative Example Alloys, hot/cold workability, torsion strength, impact strength, bending property, wear resistance, press formability, machinability, and the like were verified as follows.

(Hot Workability/Cold Workability)

Hot workability was assessed by a crack condition (crack condition of raw materials A, B, C, and D) after hot rolling. The results are shown in Tables 15 to 19 and Tables 25 and 26. In the tables, a case where no damage such as cracks and only minute cracks (5 mm or less) were observed is considered as excellent in practicality and is represented by "○". Another case where less than 10 pieces of edge cracks as large as 10 mm or less were observed throughout the whole length is considered as practical and is represented by "Δ". Yet another case where large cracks of as large as 10 mm or more and/or more than 10 pieces of small cracks as large as 10 mm or less were observed is considered as impractical (significant rework is necessary) and is represented by "X". Cold workability was assessed by a crack condition (crack condition of cold processing material) after cold rolling. The results are shown in Tables 6 to 10. In the tables, a case where no damage such as cracks and only minute cracks (3 mm or less) were observed is considered as excellent in practicality and is represented by "○". Another case where edge cracks of over 3 mm to 7 mm or less in size were observed is considered as practical and is represented by "Δ". Yet another case where large cracks over 7 mm are observed in addition to defects of casting materials is considered as impractical and is represented by "X". From the results shown in Tables 15 to 19, it was verified that there is no problem in hot and cold workability in Example Alloys. Meanwhile, from Comparative Examples, it was verified that hot cracks easily occur when Cu concentration is high or the value of Mn/Ni is low, and that cold cracks easily occur when Cu concentration is low, the Mn/Ni value is low, a ratio occupied by β phases is high, or a shape of β phases is not satisfactory.

(Torsion Strength)

As for torsion strength, torsion test pieces (length: 320 mm, diameter of chuck portion: 14.1 mm, diameter of parallel portion: 7.8 mm, length of parallel portion: 100 mm) were taken from Example Alloys and Comparative Example Alloys. A torsion test was performed thereon, and torsion strength (hereinafter, referred to as "1° torsion strength") in case of permanent deformation of 1° and torsion strength (hereinafter, referred to as "45° torsion strength") in case of permanent deformation of 45° were measured. The results are shown in Tables 6 to 10. Although a rod material and a plate material are different in shapes, it is impossible to insert a key in case it has only a slight deformation. It is impossible for a key to be repaired if the deformation reaches 45°, and there are concerns about safety as well. It was verified from the torsion test that the aforesaid problems not occur in Example Alloys.

(Impact Resistance)

Impact test pieces (V notch test piece based on JIS Z2242) were taken from Example Alloys and Comparative Example Alloys. Charpy impact test was performed thereon, and impact strength was measured. The results are as shown in Tables 15 to 19 and Tables 25 and 26, and it was verified that Example Alloys satisfying the relational expressions f1 to f4 and the amount and shape of β phases are excellent in impact resistance.

(Bending Property)

Bending test pieces (thickness: 2.4 mm) were taken from Example Alloys and Comparative Example Alloys, and the test pieces were bent at 90° by using a jig having a radius of t/2 (1.2 mm) at the bending part. The results are shown in Tables 15 to 19 and Tables 25 and 26. In the tables, a case where no crack occurs by 90° bending is considered as excellent in bending property and is represented by "○", another case where small cracks leading to no open crack or breaking occur is considered as having a general bending property and is represented by "Δ". Yet another case where cracks leading to open crack and breaking is considered as inferior in bending property and is represented by "X". From the results, it was verified that Example Alloys satisfying the relational expressions f1 to f4 and the amount and shape of β phases have no problem in bending property. In addition, it was also verified that bending property deteriorates when Cu concentration is low, the value of Mn/Ni is low, a ratio occupied by β phases is high, or the shape of β phases is not satisfactory.

(Wear Resistance)

Test pieces were taken from Example Alloys and Comparative Example Alloys. An wear test was performed with a ball-on-disk wear tester (manufactured by Shinko Engineering Co., Ltd.). That is, the wear test was performed by using a SUS304 ball having a diameter of 10 mm as a sliding material under a load of 5 kgf (49N) without lubrication, which was subjected to a circumferential rotation wear at an wear rate of 0.1 m/min for a sliding distance of 250 m. Weights before and after the test were measured, thereby calculating a difference as an wear amount. The results are shown in Tables 15 to 19 and Tables 25 and 26, and it was verified that Example Alloys were excellent in wear resistance.

(Press Formability)

Example Copper Alloys and Comparative Example Copper Alloys are formed into a key-like shape by press (lateral clearance: 0.05 mm) using a T-shaped mold in order to assess press formability from a length of shear droop, size (length) of burr, and a dimensional difference of a product (at the fractured section) (whether or not the product is straightly pressed with high precision). The results are shown in Tables 15 to 19 and Tables 25 and 26. As for shear droop, a case where an area of shear droop is 0.18 mm or less (7% of plate thickness) was considered as satisfactory in press formability, and is represented by "○", another case where the area is within the range of 0.1 mm to 0.26 mm (10% of plate thickness) was considered as fair in press formability and is represented by "Δ". Yet another case where the area is 0.26 mm or more was considered as poor in press formability and is represented by "X". As for burr, a case where no burr (blister) was observed is considered as satisfactory in press formability and is represented by "○". Another case where a height of burr was less than 0.01 mm is considered as possible fair in formability and is represented by "Δ", and yet another case where a height of burr is more than 0.01 mm is considered as poor in press formability and is represented by "X". As for a dimensional difference, a case where the dimensional difference is 0.07 or less is considered as satisfactory in press formability and is represented by "○". Another case where the dimensional difference is over 0.07 mm and less than 0.11 mm is considered as fair in press formability and is represented by "Δ", and yet another case where the dimensional difference is 0.11 mm or more is considered as poor in press formability and is represented by "X". Meanwhile, as press-formed products, they are naturally required to have no burr, only a small shear droop and good dimensional precision in a thickness direction (product width). Particularly, when such a press-formed product is a key, the aforesaid points are essential to achieve high performance of the key. From Tables 15 to 19, it was verified that Example Alloys satisfy such requirements. As for dimensional precision and the like, it is preferable that 75% or more of a fractured surface is shear or a fracture surface. In Example Alloys, basically, a ratio occupied by a fracture surface was 75% or more. Needless to say, tool life is improved when a larger amount of fracture surfaces is present. When the β phase ratio and the shape of β phases are appropriate, a large amount of fracture surfaces is generated due to an uniform breaking at the time of press forming. Accordingly, it is understood that satisfactory press forming is performed in Example Alloys satisfying the relational expressions f1 to f4, and the amount and shape of β phases.

(Machinability)

Drill test pieces (plate with thickness of 14.5 mm and rod with diameter of 14.5 mm) were taken from Example Alloys and Comparative Example Alloys. A drill test was performed with no lubrication, and the torque of the drill was measured. That is, drilling was performed using a JIS standard drill manufactured by HUYS Industries Limited to drill a hole with a diameter of 3.5 mm and a depth of 10 mm at 1250 rpm and a feeding rate of 0.07 mm/rev, and a torque caused by the drilling was converted into an electrical signal and was recorded with a recorder, and it was converted again into a torque. The results are shown in Tables 20 to 24 and Tables 27 and 28. As for tool life, a test consisting of a drilling followed by another drilling after every 5 seconds up to 30 times was performed by using a plate with a thickness of 14.5 mm. The distance between each drilled hole is set to be 18 mm to 25 mm. As for an assessment of tool life, an average value of the torque of the first three drilling was calculated. It was determined that the drill was worn away when the average value of the torque was increased by 10%. Tables 11 to 15 show the number of drilling times until the torque average value is increased by 10%. From the drill test results (torque, number of cutting times) shown in Tables 20 to 24 and Tables 27 and 28, it was verified that Example Alloys were excellent in machinability including tool life. It is understood that the results greatly depend on the ratio and shape of β phases, and on the value of [Mn]/[Ni]. They are also affected by the slight addition of machinability improving elements such as Pb or the like and the value of f5. In addition, machinability becomes more satisfactory, as the ratio occupied by β phase becomes higher, as the amount of added machinability improving elements of Pb and the like becomes larger, and as the value of f5 becomes higher within the appropriate range.

(Stress Corrosion Cracking Resistance)

Test pieces similar to the bending test pieces were taken from Example Alloys and Comparative Example Alloys. A stress corrosion cracking test was performed using the test pieces bent to 90 degrees by a method prescribed in JIS. That is, the test pieces were exposed to ammonia using a solution of aqueous ammonia and water mixed in the same quantity, rinsed by sulfuric acid, and then checked whether or not cracks were observed with a 10-fold stereoscopic microscope in order to assess stress corrosion cracking resistance. The results are shown in Tables 20 to 24 and Tables 27 and 28 (represented by "stress corrosion cracking property" in Tables). In the Tables, a case where no crack after 24-hours exposure was observed is considered as satisfactory in corrosion crack resistance (there is no problem in practical use), and is represented by "○". Another case where cracks occur after 24 hours but no crack after 4 hours is considered as generally fair in stress corrosion cracking resistance (still practically useful despite a problem and is represented by "Δ". Yet another case where cracks occur after 4 hours is considered as inferior in stress corrosion cracking resistance and is represented by "X". From the results of Tables 20 to 24, it was verified that Example Alloys have no problem in stress corrosion cracking resistance in a practical use. In addition, from Comparative Example Alloys, it is understood that stress corrosion cracking resistance becomes inferior, as the ratio occupied by β phase becomes higher, as the amount of Mn becomes larger, and as the Mn/Ni value becomes higher.

In summary, when Comparative Example Alloys do not satisfy the range of the compositions of the invention or the relational expressions f1 to f4, there are many cases where the amount of β phases and the shape (average area, long/short ratio, division) of β phases do not satisfy the predetermined requirements and thus press formability or machinability is not satisfactory. Even when the requirements of β phases are satisfied, and when if the amount of Mn or the Mn/Ni ratio is out of the range of the invention, at least one or more of the properties such as hot or cold workability, bending property, press formability, machinability, and wear resistance are not satisfactory. When Cu concentration or the value of f1 is high, hot workability is not satisfactory, and when it is low, cold workability or bending property is not satisfactory. The addition of Pb or the like in a small amount slightly decreases impact strength, but hardly harms the other properties, and can improve machinability or press formability. The co-addition of Zr and P in the preferable range including a mixing ratio realizes grain refinement in the step of casting materials. Accordingly, β phases are divided by the first heat treatment into the preferable shape, and machinability and the like of the final products are improved. Particularly, the advantage of the co-addition of these elements is enormous for continuous casting materials. The invention alloys obtained by satisfying the compositions and the relational expressions f1 to f4 and the appropriate heat treatment provides properties necessary for a key or the like, such as press formability, hot/cold workability, bending property, torsion strength, impact strength, wear resistance, and corrosion resistance.

(Color Tone)

Color tone of Example Alloys and Comparative Example Alloys was measured according to the method based on JIS Z 8729-1982, and the results are shown by using L, a, b color system prescribed in JIS Z 8729-1980 in Tables 20 to 24 and Tables 27 and 28. Specifically, values of L, a, and b were measured in a manner of SCI (including specular reflection light) using a spectrum colorimeter "CM-2002" manufactured by Minolta, Inc.

As for L (chromaticness), it is considered that L is increased as the amounts of added Cu and Ni become larger and decreased as the content of Mn becomes larger. L slightly moves to the plus direction with a small amount of Al among the additional elements.

As for a (plus direction: red, minus direction: green), it is basically plus when the value of [Ni]+[Mn] is smaller than 14, exhibiting slightly strong reddish color. It becomes minus when [Ni]+[Mn]>14, and the red color gradually fades (a=0 represents white color or black color). A minus value becomes larger as the amount of added Ni becomes larger or the amount of added Mn becomes smaller. That is, to obtain silver-white color, it is preferable that at least the value of [Ni]+[Mn] is equal to or more than 13.

As for b (plus direction: yellow, minus direction: blue), it becomes larger as the value of [Ni]+[Mn] becomes smaller (i.e. becomes yellower). In Example Alloys, it is understood that variation of the b value is limited and the value is low (whiter). In view of the above description as well, to obtain silver-white color it is preferable that at least the value of [Ni]+[Mn] is equal to or more than 13.

A salt spray test pursuant to JIS Z 2371 was performed to measure color. That is, 5% NaCl solution of 35° C. (to be accurate 35±2° C.) was sprayed onto a sample placed in a spray chamber. It was taken out after a predetermined time (24 hours), and color measurement was conducted by the colorimeter. The results are shown in Tables 20 to 24 and Tables 27 and 28.

The aforesaid method of measuring color based on JIS Z 8722-1982 was additionally conducted on the sample subjected to the salt spray test, and the color variation after the salt spray test was verified. The results are shown in Tables 20 to 24 and Tables 27 and 28 (represented by "color difference before and after test" in the Tables). The L (chromaticness) is decreased by salt spray, and luster is lost. The values of a and b moves into the plus direction, and color tone such as reddish brown becomes stronger. That is, due to the general corrosion resulting from salt spray and the reddish brown corrosion product such as copper oxide, luster is lost, and red color tone becomes stronger. The degree of such color variation is remarkable as the total amount of added Ni and Mn becomes small. When the value of Mn/Ni is outside of the appropriate range, the degree becomes large. Al can contribute to improvement (variation in color difference is small) of corrosion resistance. As for the Cu amount, the value of a is more likely to move to the plus direction. From Tables 20 to 24 and Tables 27 and 28, it is understood that the variation before and after the salt spray test is small, that the value of color difference is less than 10, and that tarnish resistance is excellent in Example Alloys with respect to any one of L, a, and b as compared with Comparative Example Alloys.

As described above, it is easily understood that the silver-white copper alloys of the invention represent the above-described effects.

TABLE 1

| | Alloy | Proc- | Raw | Composition | | | | | | | | | | | | | | | | |
|---|---|---|---|---|---|---|---|---|---|---|---|---|---|---|---|---|---|---|---|---|
| | | | | Constituent Element (mass %) | | | | | | | | | | | | Content Correlation | | | | |
| | No. | ess | Material | Cu | Ni | Mn | Zn | Pb | Bi | C | S | Al | P | Zr | Mg | f1 | f2 | f3 | f4 | f5 |
| Ex. | 101 | M1 | A | 48.4 | 8.9 | 5.7 | 37 | | | | | | | | | 62.6 | 0.64 | 14.60 | 12.61 | 10.3 |
| | 102 | M1 | A | 48.6 | 9.2 | 6.1 | 36.1 | | | | | | | | | 63.3 | 0.66 | 15.30 | 13.17 | 5.2 |
| | 103 | M1 | A | 48.5 | 9 | 5.8 | 36.7 | 0.009 | | 0.0012 | | | | | | 62.8 | 0.64 | 14.80 | 12.77 | 10.9 |
| | 104 | M1 | A | 48.4 | 8.9 | 5.6 | 37.1 | 0.004 | | | | | | | | 62.5 | 0.63 | 14.50 | 12.54 | 10.9 |
| | 201 | M2 | A | 48.4 | 8.9 | 5.7 | 37 | | | | | | | | | 62.6 | 0.64 | 14.60 | 12.61 | 9.6 |
| | 202 | M2 | A | 49.8 | 8.4 | 5.2 | 36.6 | | | | | | | | | 63.1 | 0.62 | 13.60 | 11.78 | 8.0 |
| | 203 | M2 | A | 48.2 | 9.4 | 5.1 | 37.3 | | | | | | | | | 62.9 | 0.54 | 14.50 | 12.72 | 9.3 |
| | 204 | M2 | A | 48.6 | 9.2 | 6.1 | 36.1 | | | | | | | | | 63.3 | 0.66 | 15.30 | 13.17 | 4.4 |
| | 205 | M2 | A | 48.8 | 8.9 | 5.5 | 36.8 | 0.014 | | | | | | | | 62.9 | 0.62 | 14.40 | 12.48 | 8.4 |
| | 206 | M2 | A | 48.5 | 9 | 5.8 | 36.7 | 0.009 | | 0.0012 | | | | | | 62.8 | 0.64 | 14.80 | 12.77 | 10.6 |
| | 207 | M2 | A | 49 | 9 | 5.2 | 36.8 | | | 0.0026 | | | | | | 63.2 | 0.58 | 14.20 | 12.38 | 7.6 |
| | 208 | M2 | A | 48.2 | 9.2 | 5 | 37.6 | | | | 0.0008 | | | | | 62.6 | 0.54 | 14.20 | 12.45 | 12.6 |
| | 209 | M2 | A | 49.9 | 8.6 | 5.3 | 36.2 | | 0.002 | | | | | | | 63.5 | 0.62 | 13.90 | 12.05 | 4.7 |
| | 210 | M2 | A | 49.3 | 8.8 | 5.4 | 36.5 | | | | | 0.06 | | | | 63.2 | 0.61 | 14.20 | 12.31 | 6.3 |
| | 211 | M2 | A | 48.6 | 9.1 | 5.4 | 36.9 | | | | | | 0.008 | | 0.005 | 63.0 | 0.59 | 14.50 | 12.61 | 7.4 |
| | 212 | M2 | A | 48.4 | 8.9 | 5.6 | 37.1 | 0.005 | | 0.0008 | | 0.05 | | | 0.007 | 62.5 | 0.63 | 14.50 | 12.54 | 12.0 |
| | 213 | M2 | A | 48.4 | 8.9 | 5.6 | 37.1 | 0.004 | | | | | | | | 62.5 | 0.63 | 14.50 | 12.54 | 10.1 |
| | 214 | M2 | A | 48.3 | 9 | 5.7 | 37 | | | | | | 0.054 | 0.023 | | 62.6 | 0.63 | 14.70 | 12.71 | 9.7 |
| | 215 | M2 | A | 48.9 | 8.8 | 5.5 | 36.8 | 0.012 | | | | | 0.062 | 0.018 | | 62.9 | 0.63 | 14.30 | 12.38 | 8.5 |
| | 301 | M3 | A | 48.4 | 8.9 | 5.7 | 37 | | | | | | | | | 62.6 | 0.64 | 14.60 | 12.61 | 8.8 |
| | 302 | M3 | A | 48.8 | 8.9 | 5.5 | 36.8 | 0.014 | | | | | | | | 62.9 | 0.62 | 14.40 | 12.48 | 7.6 |
| | 303 | M3 | A | 48.5 | 9 | 5.8 | 36.7 | 0.009 | | 0.0012 | | | | | | 62.8 | 0.64 | 14.80 | 12.77 | 9.7 |

TABLE 2

| | Alloy | | | Composition | | | | | | | | | | | | | | | | |
|---|---|---|---|---|---|---|---|---|---|---|---|---|---|---|---|---|---|---|---|---|
| | | | | Constituent Element (mass %) | | | | | | | | | | | | Content Correlation | | | | |
| | No. | Process | Raw Material | Cu | Ni | Mn | Zn | Pb | Bi | C | S | Al | P | Zr | Mg | f1 | f2 | f3 | f4 | f5 |
| Ex. | 401 | M4 | A | 48.4 | 8.9 | 5.7 | 37 | | | | | | | | | 62.6 | 0.64 | 14.60 | 12.61 | 9.2 |
| | 402 | M4 | A | 48.5 | 9 | 5.8 | 36.7 | 0.009 | | 0.0012 | | | | | | 62.8 | 0.64 | 14.80 | 12.77 | 9.2 |
| | 501 | M5 | A | 48.4 | 8.9 | 5.7 | 37 | | | | | | | | | 62.6 | 0.64 | 14.60 | 12.61 | 14.9 |
| | 502 | M5 | A | 48.8 | 8.9 | 5.5 | 36.8 | 0.014 | | | | | | | | 62.9 | 0.62 | 14.40 | 12.48 | 15.1 |
| | 503 | M5 | A | 48.5 | 9 | 5.8 | 36.7 | 0.009 | | 0.0012 | | | | | | 62.8 | 0.64 | 14.80 | 12.77 | 15.7 |
| | 601 | M6 | A | 48.4 | 8.9 | 5.7 | 37 | | | | | | | | | 62.6 | 0.64 | 14.60 | 12.61 | 12.9 |
| | 602 | M6 | A | 48.5 | 9 | 5.8 | 36.7 | 0.009 | | 0.0012 | | | | | | 62.8 | 0.64 | 14.80 | 12.77 | 14.2 |
| | 701 | M7 | A | 48.4 | 8.9 | 5.7 | 37 | | | | | | | | | 62.6 | 0.64 | 14.60 | 12.61 | 12.2 |
| | 702 | M7 | A | 48.5 | 9 | 5.8 | 36.7 | 0.009 | | 0.0012 | | | | | | 62.8 | 0.64 | 14.80 | 12.77 | 12.7 |
| | 801 | M8 | A | 48.4 | 8.9 | 5.7 | 37 | | | | | | | | | 62.6 | 0.64 | 14.60 | 12.61 | 14.6 |
| | 802 | M8 | A | 48.5 | 9 | 5.8 | 36.7 | 0.009 | | 0.0012 | | | | | | 62.8 | 0.64 | 14.80 | 12.77 | 15.4 |
| | 901 | M9 | A | 48.4 | 8.9 | 5.7 | 37 | | | | | | | | | 62.6 | 0.64 | 14.60 | 12.61 | 11.8 |
| | 902 | M9 | A | 48.5 | 9 | 5.8 | 36.7 | 0.009 | | 0.0012 | | | | | | 62.8 | 0.64 | 14.80 | 12.77 | 12.5 |
| | 1001 | M10 | B | 48.4 | 8.9 | 5.7 | 37 | | | | | | | | | 62.6 | 0.64 | 14.60 | 12.61 | 11.2 |
| | 1002 | M10 | B | 48.6 | 9.2 | 6.1 | 36.1 | | | | | | | | | 63.3 | 0.66 | 15.30 | 13.17 | 5.8 |
| | 1003 | M10 | B | 48.5 | 9 | 5.8 | 36.7 | 0.009 | | 0.0012 | | | | | | 62.8 | 0.64 | 14.80 | 12.77 | 11.9 |
| | 1004 | M10 | B | 49 | 9 | 5.2 | 36.8 | | | 0.0026 | | | | | | 63.2 | 0.58 | 14.20 | 12.38 | 8.3 |
| | 1005 | M10 | B | 48.3 | 9 | 5.8 | 36.9 | 0.028 | | | | | | | | 62.6 | 0.64 | 14.80 | 12.77 | 12.7 |
| | 1006 | M10 | B | 48.4 | 8.9 | 5.6 | 37.1 | 0.004 | | | | | | | | 62.5 | 0.63 | 14.50 | 12.54 | 11.5 |

TABLE 2-continued

| Alloy | | | Composition | | | | | | | | | | | | | | | | |
|---|---|---|---|---|---|---|---|---|---|---|---|---|---|---|---|---|---|---|---|
| | | | Constituent Element (mass %) | | | | | | | | | | | | Content Correlation | | | | |
| No. | Process | Raw Material | Cu | Ni | Mn | Zn | Pb | Bi | C | S | Al | P | Zr | Mg | f1 | f2 | f3 | f4 | f5 |
| 1007 | M10 | B | 48.3 | 9 | 5.7 | 37 | | | | | | 0.054 | 0.023 | | 62.6 | 0.63 | 14.70 | 12.71 | 11.0 |
| 1101 | M11 | B | 48.4 | 8.9 | 5.7 | 37 | | | | | | | | | 62.6 | 0.64 | 14.60 | 12.61 | 10.5 |
| 1102 | M11 | B | 48.8 | 8.9 | 5.5 | 36.8 | 0.014 | | | | | | | | 62.9 | 0.62 | 14.40 | 12.48 | 10.9 |

TABLE 3

| Alloy | | Raw | Composition | | | | | | | | | | | | | | | | |
|---|---|---|---|---|---|---|---|---|---|---|---|---|---|---|---|---|---|---|---|
| | | | Constituent Element (mass %) | | | | | | | | | | | | Content Correlation | | | | |
| | No. | Process | Material | Cu | Ni | Mn | Zn | Pb | Bi | C | S | Al | P | Zr | Mg | f1 | f2 | f3 | f4 | f5 |
| Ex. | 1103 | M11 | B | 48.5 | 9 | 5.8 | 36.7 | 0.009 | | 0.0012 | | | | | | 62.8 | 0.64 | 14.80 | 12.77 | 11.0 |
| | 1104 | M11 | B | 48.4 | 8.9 | 5.6 | 37.1 | 0.005 | | 0.0008 | | 0.05 | | | 0.007 | 62.5 | 0.63 | 14.50 | 12.54 | 12.6 |
| | 1105 | M11 | B | 48.3 | 9 | 5.8 | 36.9 | 0.028 | | | | | | | | 62.6 | 0.64 | 14.80 | 12.77 | 12.1 |
| | 1106 | M11 | B | 48.4 | 8.9 | 5.6 | 37.1 | 0.004 | | | | | | | | 62.5 | 0.63 | 14.50 | 12.54 | 11.1 |
| | 1107 | M11 | B | 48.3 | 9 | 5.7 | 37 | | | | | | 0.054 | 0.023 | | 62.6 | 0.63 | 14.70 | 12.71 | 10.4 |
| | 1108 | M11 | B | 48.9 | 8.8 | 5.5 | 36.8 | 0.012 | | | | | 0.062 | 0.018 | | 62.9 | 0.63 | 14.30 | 12.38 | 10.0 |
| | 1201 | M12 | B | 48.4 | 8.9 | 5.7 | 37 | | | | | | | | | 62.6 | 0.64 | 14.60 | 12.61 | 15.8 |
| | 1202 | M12 | B | 48.5 | 9 | 5.8 | 36.7 | 0.009 | | 0.0012 | | | | | | 62.8 | 0.64 | 14.80 | 12.77 | 16.6 |
| | 1301 | M13 | B | 48.4 | 8.9 | 5.7 | 37 | | | | | | | | | 62.6 | 0.64 | 14.60 | 12.61 | 12.3 |
| | 1302 | M13 | B | 48.5 | 9 | 5.8 | 36.7 | 0.009 | | 0.0012 | | | | | | 62.8 | 0.64 | 14.80 | 12.77 | 13.2 |
| | 1401 | M14 | C | 48.4 | 8.9 | 5.7 | 37 | | | | | | | | | 62.6 | 0.64 | 14.60 | 12.61 | 12.2 |
| | 1402 | M14 | C | 49.8 | 8.4 | 5.2 | 36.6 | | | | | | | | | 63.1 | 0.62 | 13.60 | 11.78 | 10.3 |
| | 1403 | M14 | C | 48.5 | 9 | 5.8 | 36.7 | 0.009 | | 0.0012 | | | | | | 62.8 | 0.64 | 14.80 | 12.77 | 13.2 |
| | 1404 | M14 | C | 48.4 | 8.9 | 5.6 | 37.1 | 0.005 | | 0.0008 | | 0.05 | | | 0.007 | 62.5 | 0.63 | 14.50 | 12.54 | 13.9 |
| | 1405 | M14 | C | 48.3 | 9 | 5.8 | 36.9 | 0.028 | | | | | | | | 62.6 | 0.64 | 14.80 | 12.77 | 13.5 |
| | 1406 | M14 | C | 48.4 | 8.9 | 5.6 | 37.1 | 0.004 | | | | | | | | 62.5 | 0.63 | 14.50 | 12.54 | 12.5 |
| | 1407 | M14 | C | 48.3 | 9 | 5.7 | 37 | | | | | | 0.054 | 0.023 | | 62.6 | 0.63 | 14.70 | 12.71 | 11.8 |
| | 1408 | M14 | C | 48.9 | 8.8 | 5.5 | 36.8 | 0.012 | | | | | 0.062 | 0.018 | | 62.9 | 0.63 | 14.30 | 12.38 | 10.8 |
| | 1501 | M15 | C | 48.4 | 8.9 | 5.7 | 37 | | | | | | | | | 62.6 | 0.64 | 14.60 | 12.61 | 12.0 |
| | 1502 | M15 | C | 48.2 | 9.4 | 5.1 | 37.3 | | | | | | | | | 62.9 | 0.54 | 14.50 | 12.72 | 11.6 |
| | 1503 | M15 | C | 48.5 | 9 | 5.8 | 36.7 | 0.009 | | 0.0012 | | | | | | 62.8 | 0.64 | 14.80 | 12.77 | 11.7 |
| | 1504 | M15 | C | 48.2 | 9.2 | 5 | 37.6 | | | | 0.0008 | | | | | 62.6 | 0.54 | 14.20 | 12.45 | 13.7 |

TABLE 4

| Alloy | | Proc- | Raw | Composition | | | | | | | | | | | | | | | | |
|---|---|---|---|---|---|---|---|---|---|---|---|---|---|---|---|---|---|---|---|---|
| | | | | Constituent Element (mass %) | | | | | | | | | | | | Content Correlation | | | | |
| | No. | ess | Material | Cu | Ni | Mn | Zn | Pb | Bi | C | S | Al | P | Zr | Mg | f1 | f2 | f3 | f4 | f5 |
| Ex. | 1505 | M15 | C | 49.9 | 8.6 | 5.3 | 36.2 | | 0.002 | | | | | | | 63.5 | 0.62 | 13.90 | 12.05 | 6.1 |
| | 1506 | M15 | C | 48.3 | 9 | 5.8 | 36.9 | 0.028 | | | | | | | | 62.6 | 0.64 | 14.80 | 12.77 | 13.5 |
| | 1507 | M15 | C | 48.4 | 8.9 | 5.6 | 37.1 | 0.004 | | | | | | | | 62.5 | 0.63 | 14.50 | 12.54 | 12.6 |
| | 1508 | M15 | C | 48.3 | 9 | 5.7 | 37 | | | | | | 0.054 | 0.023 | | 62.6 | 0.63 | 14.70 | 12.71 | 11.8 |
| | 1509 | M15 | C | 48.9 | 8.8 | 5.5 | 36.8 | 0.012 | | | | | 0.062 | 0.018 | | 62.9 | 0.63 | 14.30 | 12.38 | 10.5 |
| | 1601 | M16 | D | 48.4 | 8.9 | 5.7 | 37 | | | | | | | | | 62.6 | 0.64 | 14.60 | 12.61 | 15.9 |
| | 1602 | M16 | D | 48.5 | 9 | 5.8 | 36.7 | 0.009 | | 0.0012 | | | | | | 62.8 | 0.64 | 14.80 | 12.77 | 16.7 |
| | 1701 | M17 | D | 48.4 | 8.9 | 5.7 | 37 | | | | | | | | | 62.6 | 0.64 | 14.60 | 12.61 | 10.9 |
| | 1702 | M17 | D | 48.8 | 8.9 | 5.5 | 36.8 | 0.014 | | | | | | | | 62.9 | 0.62 | 14.40 | 12.48 | 9.6 |
| | 1703 | M17 | D | 48.5 | 9 | 5.8 | 36.7 | 0.009 | | 0.0012 | | | | | | 62.8 | 0.64 | 14.80 | 12.77 | 11.8 |
| | 1704 | M17 | D | 48.6 | 9.1 | 5.4 | 36.9 | | | | | | 0.008 | | 0.005 | 63.0 | 0.59 | 14.50 | 12.61 | 8.0 |
| | 1705 | M17 | D | 48.3 | 9 | 5.7 | 37 | | | | | | 0.054 | 0.023 | | 62.6 | 0.63 | 14.70 | 12.71 | 10.9 |
| | 1706 | M17 | D | 48.9 | 8.8 | 5.5 | 36.8 | 0.012 | | | | | 0.062 | 0.018 | | 62.9 | 0.63 | 14.30 | 12.38 | 9.7 |
| | 1801 | M18 | D | 48.4 | 8.9 | 5.7 | 37 | | | | | | | | | 62.6 | 0.64 | 14.60 | 12.61 | 10.2 |
| | 1802 | M18 | D | 49.8 | 8.4 | 5.2 | 36.6 | | | | | | | | | 63.1 | 0.62 | 13.60 | 11.78 | 8.5 |
| | 1803 | M18 | D | 48.2 | 9.4 | 5.1 | 37.3 | | | | | | | | | 62.9 | 0.54 | 14.50 | 12.72 | 10.0 |
| | 1804 | M18 | D | 48.6 | 9.2 | 6.1 | 36.1 | | | | | | | | | 63.3 | 0.66 | 15.30 | 13.17 | 5.0 |
| | 1805 | M18 | D | 48.8 | 8.9 | 5.5 | 36.8 | 0.014 | | | | | | | | 62.9 | 0.62 | 14.40 | 12.48 | 9.2 |
| | 1806 | M18 | D | 48.5 | 9 | 5.8 | 36.7 | 0.009 | | 0.0012 | | | | | | 62.8 | 0.64 | 14.80 | 12.77 | 11.0 |
| | 1807 | M18 | D | 49 | 9 | 5.2 | 36.8 | | | 0.0026 | | | | | | 63.2 | 0.58 | 14.20 | 12.38 | 8.0 |
| | 1808 | M18 | D | 48.2 | 9.2 | 5 | 37.6 | | | | 0.0008 | | | | | 62.6 | 0.54 | 14.20 | 12.45 | 13.1 |
| | 1809 | M18 | D | 49.3 | 8.8 | 5.4 | 36.5 | | | | | 0.06 | | | | 63.2 | 0.61 | 14.20 | 12.31 | 7.1 |
| | 1810 | M18 | D | 48.4 | 8.9 | 5.6 | 37.1 | 0.005 | | 0.008 | | 0.05 | | | 0.007 | 62.5 | 0.63 | 14.50 | 12.54 | 12.7 |

TABLE 5

| | Alloy | | | Composition | | | | | | | | | | | | | | | | |
|---|---|---|---|---|---|---|---|---|---|---|---|---|---|---|---|---|---|---|---|---|
| | | | | Constituent Element (mass %) | | | | | | | | | | | | Content Correlation | | | | |
| | No. | Process | Raw Material | Cu | Ni | Mn | Zn | Pb | Bi | C | S | Al | P | Zr | Mg | f1 | f2 | f3 | f4 | f5 |
| Ex. | 1811 | M18 | D | 48.3 | 9 | 5.8 | 36.9 | 0.028 | | | | | | | | 62.6 | 0.64 | 14.80 | 12.77 | 11.6 |
| | 1812 | M18 | D | 48.3 | 9 | 5.7 | 37 | | | | | | 0.054 | 0.023 | | 62.6 | 0.63 | 14.70 | 12.71 | 10.0 |
| | 1813 | M18 | D | 48.9 | 8.8 | 5.5 | 36.8 | 0.012 | | | | | 0.062 | 0.018 | | 62.9 | 0.63 | 14.30 | 12.38 | 9.3 |
| | 1901 | M19 | D | 48.4 | 8.9 | 5.7 | 37 | | | | | | | | | 62.6 | 0.64 | 14.60 | 12.61 | 8.9 |
| | 1902 | M19 | D | 48.5 | 9 | 5.8 | 36.7 | 0.009 | | 0.0012 | | | | | | 62.8 | 0.64 | 14.80 | 12.77 | 9.9 |
| | 2001 | M20 | D | 48.4 | 8.9 | 5.7 | 37 | | | | | | | | | 62.6 | 0.64 | 14.60 | 12.61 | 10.0 |
| | 2002 | M20 | D | 48.2 | 9.4 | 5.1 | 37.3 | | | | | | | | | 62.9 | 0.54 | 14.50 | 12.72 | 9.4 |
| | 2003 | M20 | D | 48.5 | 9 | 5.8 | 36.7 | 0.009 | | 0.0012 | | | | | | 62.8 | 0.64 | 14.80 | 12.77 | 11.7 |
| | 2101 | M21 | D | 48.4 | 8.9 | 5.7 | 37 | | | | | | | | | 62.6 | 0.64 | 14.60 | 12.61 | 15.8 |
| | 2102 | M21 | D | 48.6 | 9.2 | 6.1 | 36.1 | | | | | | | | | 63.3 | 0.66 | 15.30 | 13.17 | 11.2 |
| | 2103 | M21 | D | 48.5 | 9 | 5.8 | 36.7 | 0.009 | | 0.0012 | | | | | | 62.8 | 0.64 | 14.80 | 12.77 | 16.6 |
| | 2104 | M21 | D | 48.3 | 9 | 5.7 | 37 | | | | | | 0.054 | 0.023 | | 62.6 | 0.63 | 14.70 | 12.71 | 13.7 |
| | 2105 | M21 | D | 48.9 | 8.8 | 5.5 | 36.8 | 0.012 | | | | | 0.062 | 0.018 | | 62.9 | 0.63 | 14.30 | 12.38 | 11.5 |
| | 2201 | M22 | D | 48.4 | 8.9 | 5.7 | 37 | | | | | | | | | 62.6 | 0.64 | 14.60 | 12.61 | 12.8 |
| | 2202 | M22 | D | 48.5 | 9 | 5.8 | 36.7 | 0.009 | | 0.0012 | | | | | | 62.8 | 0.64 | 14.80 | 12.77 | 14.0 |
| | 2301 | M23 | D | 48.4 | 8.9 | 5.7 | 37 | | | | | | | | | 62.6 | 0.64 | 14.60 | 12.61 | 12.3 |
| | 2302 | M23 | D | 48.5 | 9 | 5.8 | 36.7 | 0.009 | | 0.0012 | | | | | | 62.8 | 0.64 | 14.80 | 12.77 | 13.3 |
| | 2401 | M24 | D | 48.4 | 8.9 | 5.7 | 37 | | | | | | | | | 62.6 | 0.64 | 14.60 | 12.61 | 15.1 |
| | 2402 | M24 | D | 48.8 | 8.9 | 5.5 | 36.8 | 0.014 | | | | | | | | 62.9 | 0.62 | 14.40 | 12.48 | 15.6 |
| | 2403 | M24 | D | 48.5 | 9 | 5.8 | 36.7 | 0.009 | | 0.0012 | | | | | | 62.8 | 0.64 | 14.80 | 12.77 | 15.8 |
| | 2501 | M25 | D | 48.4 | 8.9 | 5.7 | 37 | | | | | | | | | 62.6 | 0.64 | 14.60 | 12.61 | 12.6 |
| | 2502 | M25 | D | 48.5 | 9 | 5.8 | 36.7 | 0.009 | | 0.0012 | | | | | | 62.8 | 0.64 | 14.80 | 12.77 | 13.2 |

TABLE 6

| | Alloy | | | Composition | | | | | | | | | | | | | | | | |
|---|---|---|---|---|---|---|---|---|---|---|---|---|---|---|---|---|---|---|---|---|
| | | | | Constituent Element (mass %) | | | | | | | | | | | | Content Correlation | | | | |
| | No. | Process | Raw Material | Cu | Ni | Mn | Zn | Pb | Bi | C | S | Al | P | Zr | Mg | f1 | f2 | f3 | f4 | f5 |
| Comp. Ex. | 3001 | M2 | A | 48.2 | 9.2 | 6.6 | 36 | | | | | | | | | 63.1 | 0.72 | 15.80 | 13.49 | 8.3 |
| | 3002 | M2 | A | 49.5 | 9.3 | 2.8 | 38.4 | | | | | | | | | 63.4 | 0.30 | 12.10 | 11.12 | 13.1 |
| | 3003 | M2 | A | 47.3 | 8.8 | 5.5 | 38.4 | | | | | | | | | 61.3 | 0.63 | 14.30 | 12.38 | 18.5 |
| | 3004 | M2 | A | 50.8 | 8.7 | 5.3 | 35.2 | | | | | | | | | 64.6 | 0.61 | 14.00 | 12.15 | 1.2 |
| | 3005 | M2 | A | 49.9 | 8 | 4.8 | 37.3 | | | | | | | | | 62.5 | 0.60 | 12.80 | 11.12 | 11.5 |
| | 3006 | M2 | A | 48.7 | 8.6 | 6.9 | 35.8 | 0.005 | | 0.0018 | | | | | | 62.8 | 0.80 | 15.50 | 13.09 | 9.9 |
| | 3007 | M2 | A | 49.2 | 8.9 | 3.5 | 38.4 | 0.009 | | 0.0007 | | | | | | 62.7 | 0.39 | 12.40 | 11.18 | 18.1 |
| | 3008 | M2 | A | 50.2 | 7.5 | 6.3 | 36 | | | | | | | | | 62.6 | 0.84 | 13.80 | 11.60 | 8.5 |
| | 3101 | M5 | A | 48.2 | 9.2 | 6.6 | 36 | | | | | | | | | 63.1 | 0.72 | 15.80 | 13.49 | 14.6 |
| | 3102 | M5 | A | 49.5 | 9.3 | 2.8 | 38.4 | | | | | | | | | 63.4 | 0.30 | 12.10 | 11.12 | 16.8 |
| | 3103 | M5 | A | 47.3 | 8.8 | 5.5 | 38.4 | | | | | | | | | 61.3 | 0.63 | 14.30 | 12.38 | 23.5 |
| | 3104 | M5 | A | 50.8 | 8.7 | 5.3 | 35.2 | | | | | | | | | 64.6 | 0.61 | 14.00 | 12.15 | 3.8 |
| | 3105 | M5 | A | 49.9 | 8 | 4.8 | 37.3 | | | | | | | | | 62.5 | 0.60 | 12.80 | 11.12 | 14.4 |
| | 3106 | M5 | A | 48.7 | 8.6 | 6.9 | 35.8 | 0.005 | | 0.0018 | | | | | | 62.8 | 0.80 | 15.50 | 13.09 | 15.1 |
| | 3107 | M5 | A | 49.2 | 8.9 | 3.5 | 38.4 | 0.009 | | 0.0007 | | | | | | 62.7 | 0.39 | 12.40 | 11.18 | 23.2 |
| | 3108 | M5 | A | 50.2 | 7.5 | 6.3 | 36 | | | | | | | | | 62.6 | 0.84 | 13.80 | 11.60 | 15.5 |
| | 3201 | M10 | B | 48.2 | 9.2 | 6.6 | 36 | | | | | | | | | 63.1 | 0.72 | 15.80 | 13.49 | 8.5 |
| | 3202 | M10 | B | 49.5 | 9.3 | 2.8 | 38.4 | | | | | | | | | 63.4 | 0.30 | 12.10 | 11.12 | 13.3 |
| | 3203 | M10 | B | 49.9 | 8 | 4.8 | 37.3 | | | | | | | | | 62.5 | 0.60 | 12.80 | 11.12 | 11.6 |
| | 3301 | M12 | B | 49.5 | 9.3 | 2.8 | 38.4 | | | | | | | | | 63.4 | 0.30 | 12.10 | 11.12 | 16.2 |
| | 3302 | M12 | B | 50.2 | 7.5 | 6.3 | 36 | | | | | | | | | 62.6 | 0.84 | 13.80 | 11.60 | 15.8 |

TABLE 7

| | Alloy | | | Composition | | | | | | | | | | | | | | | | |
|---|---|---|---|---|---|---|---|---|---|---|---|---|---|---|---|---|---|---|---|---|
| | | | | Constituent Element (mass %) | | | | | | | | | | | | Content Correlation | | | | |
| | No. | Process | Raw Material | Cu | Ni | Mn | Zn | Pb | Bi | C | S | Al | P | Zr | Mg | f1 | f2 | f3 | f4 | f5 |
| Comp. | 3401 | M14 | C | 48.2 | 9.2 | 6.6 | 36 | | | | | | | | | 63.1 | 0.72 | 15.80 | 13.49 | 8.8 |
| Ex.. | 3402 | M14 | C | 49.2 | 8.9 | 3.5 | 38.4 | 0.009 | | 0.0007 | | | | | | 62.7 | 0.39 | 12.40 | 11.18 | 18.3 |
| | 3501 | M15 | C | 47.3 | 8.8 | 5.5 | 38.4 | | | | | | | | | 61.3 | 0.63 | 14.30 | 12.38 | 18.8 |
| | 3502 | M15 | C | 50.8 | 8.7 | 5.3 | 35.2 | | | | | | | | | 64.6 | 0.61 | 14.00 | 12.15 | 2.6 |
| | 3503 | M15 | C | 48.7 | 8.6 | 6.9 | 35.8 | 0.005 | | 0.0018 | | | | | | 62.8 | 0.80 | 15.50 | 13.09 | 10.8 |
| | 3601 | M16 | C | 48.7 | 8.6 | 6.9 | 35.8 | 0.005 | | 0.0018 | | | | | | 62.8 | 0.80 | 15.50 | 13.09 | 14.8 |
| | 3602 | M16 | C | 49.2 | 8.9 | 3.5 | 38.4 | 0.009 | | 0.0007 | | | | | | 62.7 | 0.39 | 12.40 | 11.18 | 21.9 |
| | 3603 | M16 | C | 50.2 | 7.5 | 6.3 | 36 | | | | | | | | | 62.6 | 0.84 | 13.80 | 11.60 | 15.3 |

TABLE 7-continued

| Alloy | | | Composition | | | | | | | | | | | | | | | | |
|---|---|---|---|---|---|---|---|---|---|---|---|---|---|---|---|---|---|---|---|
| | | | Constituent Element (mass %) | | | | | | | | | | | | Content Correlation | | | | |
| No. | Process | Raw Material | Cu | Ni | Mn | Zn | Pb | Bi | C | S | Al | P | Zr | Mg | f1 | f2 | f3 | f4 | f5 |
| 3701 | M18 | D | 48.2 | 9.2 | 6.6 | 36 | | | | | | | | | 63.1 | 0.72 | 15.80 | 13.49 | 8.4 |
| 3702 | M18 | D | 49.5 | 9.3 | 2.8 | 38.4 | | | | | | | | | 63.4 | 0.30 | 12.10 | 11.12 | 14.3 |
| 3703 | M18 | D | 47.3 | 8.8 | 5.5 | 38.4 | | | | | | | | | 61.3 | 0.63 | 14.30 | 12.38 | 19.1 |
| 3704 | M18 | D | 50.8 | 8.7 | 5.3 | 35.2 | | | | | | | | | 64.6 | 0.61 | 14.00 | 12.15 | 1.8 |
| 3705 | M18 | D | 49.9 | 8 | 4.8 | 37.3 | | | | | | | | | 62.5 | 0.60 | 12.80 | 11.12 | 11.8 |
| 3706 | M18 | D | 48.7 | 8.6 | 6.9 | 35.8 | 0.005 | | 0.0018 | | | | | | 62.8 | 0.80 | 15.50 | 13.09 | 10.7 |
| 3707 | M18 | D | 49.2 | 8.9 | 3.5 | 38.4 | 0.009 | | 0.0007 | | | | | | 62.7 | 0.39 | 12.40 | 11.18 | 18.5 |
| 3801 | M21 | D | 49.9 | 8 | 4.8 | 37.3 | | | | | | | | | 62.5 | 0.60 | 12.80 | 11.12 | 15.2 |
| 3901 | | | 61.2 | 11.3 | 0.2 | | 0.8 | | | | | | | | 77.1 | 0.02 | 11.50 | 11.43 | 8.9 |
| 3902 | | | 60.6 | 0 | 0 | | 0.8 | | | | | | | | 60.6 | | 0.00 | 0.00 | 16.9 |
| 3903 | | | 61.1 | 0 | 0 | | 0.001 | | | | | | | | 61.1 | | 0.00 | 0.00 | 13.3 |
| 3904 | | | 61.5 | 11.5 | 0.2 | | 0.8 | | | | | | | | | | | | 8.9 |
| 3905 | | | 60.3 | | | | 0.8 | | | | | | | | | | | | 20.9 |
| 3906 | | | 60.5 | | | | 0.02 | | | | | | | | | | | | 16.4 |

TABLE 8

| | | Raw Material (Hot Processing Material, Continuous Casting Material) | | | | Product (Before Finishing Process) | | | | | | |
|---|---|---|---|---|---|---|---|---|---|---|---|---|
| | Alloy No. | Raw Material β Phase Ratio (%) | β Phase Ratio After Heat Treatment (%) | Long Side/Short Side Ratio of β Phase | Number of β Phase of 0.5 mm or more | Grain Size of Macro Structure (mm) | Product β Phase Ratio (%) | β Phase area ($mm^2$) | Long Side/Short Side Ratio of β Phase | β Phase Ratio of 12 or less (%) | Number of β Phase of 0.06 mm or more | α Phase Size (mm) |
| Ex. | 101 | 28 | 12.8 | 10 | ○ | | 10.3 | $16.5 \times 10^{-6}$ | 3.4 | 99 | ○ | 0.008 |
| | 102 | 20 | 9.2 | 7.6 | ○ | | 5.2 | $7.5 \times 10^{-6}$ | 2.9 | 100 | ○ | 0.013 |
| | 103 | 25 | 11.2 | 9.2 | ○ | | 9.5 | $19.2 \times 10^{-6}$ | 3.5 | 100 | ○ | 0.012 |
| | 104 | 27 | 12.5 | 10 | ○ | | 10.4 | $17 \times 10^{-6}$ | 3.5 | 98 | ○ | 0.008 |
| | 201 | 28 | 12.3 | 8.4 | ○ | | 9.6 | $12.6 \times 10^{-6}$ | 3.1 | 99 | ○ | 0.008 |
| | 202 | 25 | 11.1 | 8.6 | ○ | | 8 | $9.7 \times 10^{-6}$ | 2.9 | 100 | ○ | 0.01 |
| | 203 | 27 | 11.9 | 9.5 | ○ | | 9.3 | $26 \times 10^{-6}$ | 3.8 | 99 | ○ | 0.009 |
| | 204 | 20 | 8.8 | 6.5 | ○ | | 4.4 | $6.9 \times 10^{-6}$ | 2.6 | 100 | ○ | 0.013 |
| | 205 | 26 | 11.5 | 8.7 | ○ | | 7.3 | $15.2 \times 10^{-6}$ | 3.3 | 99 | ○ | 0.011 |
| | 206 | 25 | 10.5 | 8.7 | ○ | | 9.2 | $16.7 \times 10^{-6}$ | 3.3 | 99 | ○ | 0.011 |
| | 207 | 24 | 9.7 | 7.6 | ○ | | 6.8 | $8.2 \times 10^{-6}$ | 3 | 99 | ○ | 0.013 |
| | 208 | 32 | 14.2 | 11.0 | ○ | | 12.2 | $28 \times 10^{-6}$ | 3.8 | 99 | ○ | 0.008 |
| | 209 | 18 | 7.8 | 7.4 | ○ | | 4.4 | $7.5 \times 10^{-6}$ | 2.7 | 100 | ○ | 0.012 |
| | 210 | 23 | 10.2 | 8.7 | ○ | | 6.3 | $13.7 \times 10^{-6}$ | 3.3 | 99 | ○ | 0.011 |
| | 211 | 26 | 11.0 | 9.5 | ○ | | 7.4 | $10.3 \times 10^{-6}$ | 3.1 | 99 | ○ | 0.008 |
| | 212 | 29 | 12.3 | 10.5 | ○ | | 11 | $20 \times 10^{-6}$ | 4 | 98 | ○ | 0.007 |
| | 213 | 27 | 12.5 | 8.3 | ○ | | 9.6 | $13 \times 10^{-6}$ | 3.2 | 100 | ○ | 0.008 |
| | 214 | 27 | 12.5 | 8.0 | ○ | | 9.7 | $11.8 \times 10^{-6}$ | 3 | 100 | ○ | 0.008 |
| | 215 | 26 | 11.5 | 7.7 | ○ | | 7.5 | $14.5 \times 10^{-6}$ | 3.2 | 100 | ○ | 0.01 |
| | 301 | 28 | 11.1 | 7.5 | ○ | | 8.8 | $12 \times 10^{-6}$ | 3 | 100 | ○ | 0.008 |
| | 302 | 26 | 10.9 | 8.0 | ○ | | 6.5 | $13.3 \times 10^{-6}$ | 3.1 | 100 | ○ | 0.012 |
| | 303 | 25 | 9.4 | 7.6 | ○ | | 8.3 | $14.2 \times 10^{-6}$ | 3 | 100 | ○ | 0.011 |

TABLE 9

| | | Raw Material (Hot Processing Material, Continuous Casting Material) | | | | Product (Before Finishing Process) | | | | | | |
|---|---|---|---|---|---|---|---|---|---|---|---|---|
| | Alloy No. | Raw Material β Phase Ratio (%) | β Phase Ratio After Heat Treatment (%) | Long Side/Short Side Ratio of β Phase | Number of β Phase of 0.5 mm or more | Grain Size of Macro Structure (mm) | Product β Phase Ratio (%) | β Phase area ($mm^2$) | Long Side/Short Side Ratio of β Phase | β Phase Ratio of 12 or less (%) | Number of β Phase of 0.06 mm or more | α Phase Size (mm) |
| Ex. | 401 | 28 | 12.8 | 8 | ○ | | 9.2 | $9.9 \times 10^{-6}$ | 3.1 | 100 | ○ | 0.01 |
| | 402 | 25 | 10.9 | 8.0 | ○ | | 7.8 | $13.9 \times 10^{-6}$ | 3.1 | 100 | ○ | 0.011 |
| | 501 | 28 | 28 | Net Shape | x | | 14.9 | $68 \times 10^{-6}$ | 5.6 | 94 | x | 0.009 |
| | 502 | 26 | 26.0 | Net Shape | x | | 14 | $54 \times 10^{-6}$ | 5 | 94 | x | 0.009 |
| | 503 | 25 | 25 | Net Shape | x | | 14.3 | $63 \times 10^{-6}$ | 5.3 | 93 | x | 0.01 |
| | 601 | 28 | 19.7 | Net Shape | x | | 12.9 | $58 \times 10^{-6}$ | 5 | 97 | Δ | 0.008 |

TABLE 9-continued

| Alloy No. | Raw Material (Hot Processing Material, Continuous Casting Material) Raw Material β Phase Ratio (%) | β Phase Ratio After Heat Treatment (%) | Long Side/Short Side Ratio of β Phase | Number of β Phase of 0.5 mm or more | Product (Before Finishing Process) Grain Size of Macro Structure (mm) | Product β Phase Ratio (%) | β Phase area ($mm^2$) | Long Side/Short Side Ratio of β Phase | β Phase Ratio of 12 or less (%) | Number of β Phase of 0.06 mm or more | α Phase Size (mm) |
|---|---|---|---|---|---|---|---|---|---|---|---|
| 602 | 25 | 17.8 | Net Shape | x | | 12.8 | $47 \times 10^{-6}$ | 4.6 | 98 | Δ | 0.011 |
| 701 | 28 | 14.4 | 13 | ○ | | 12.2 | $36 \times 10^{-6}$ | 4.3 | 97 | Δ | 0.008 |
| 702 | 25 | 13.6 | 14 | ○ | | 11.3 | $30 \times 10^{-6}$ | 4.1 | 98 | ○ | 0.009 |
| 801 | 28 | 11.5 | 6.5 | ○ | | 14.6 | $31 \times 10^{-6}$ | 5.3 | 93 | x | Partial Non-Recrystallization |
| 802 | 25 | 12.0 | 7.2 | ○ | | 14 | $28 \times 10^{-6}$ | 5.5 | 93 | x | Partial Non-Recrystallization |
| 901 | 28 | 12.0 | 7.2 | ○ | | 11.8 | $15.4 \times 10^{-6}$ | 4.7 | 96 | Δ | 0.005 |
| 902 | 25 | 11.0 | 6.0 | ○ | | 11.1 | $18.6 \times 10^{-6}$ | 4.8 | 96 | Δ | 0.006 |
| 1001 | 25 | 11.9 | 8.4 | ○ | | 11.2 | $14.5 \times 10^{-6}$ | 3 | 100 | ○ | 0.009 |
| 1002 | 18 | 8.5 | 6.6 | ○ | | 5.8 | $8.3 \times 10^{-6}$ | 2.6 | 100 | ○ | 0.01 |
| 1003 | 23 | 10.8 | 7.8 | ○ | | 10.5 | $17.5 \times 10^{-6}$ | 3.2 | 100 | ○ | 0.011 |
| 1004 | 22 | 9.5 | 7.7 | ○ | | 7.5 | $9.4 \times 10^{-6}$ | 2.9 | 99 | ○ | 0.011 |
| 1005 | 25 | 12.0 | 8.5 | ○ | | 11.1 | $15.2 \times 10^{-6}$ | 3.1 | 99 | ○ | 0.01 |
| 1006 | 24 | 12.0 | 8.5 | ○ | | 11 | $14.3 \times 10^{-6}$ | 2.8 | 99 | ○ | 0.01 |
| 1007 | 26 | 12.0 | 8.0 | ○ | | 11 | $13.7 \times 10^{-6}$ | 2.9 | 100 | ○ | 0.008 |
| 1101 | 25 | 11.6 | 6.5 | ○ | | 10.5 | $11.4 \times 10^{-6}$ | 2.8 | 100 | ○ | 0.009 |
| 1102 | 24 | 11.0 | 6.0 | ○ | | 9.8 | $16.4 \times 10^{-6}$ | 3.1 | 100 | ○ | 0.01 |

TABLE 10

| Alloy No. | Raw Material (Hot Processing Material, Continuous Casting Material) Raw Material β Phase Ratio (%) | β Phase Ratio After Heat Treatment (%) | Long Side/Short Side Ratio of β Phase | Number of β Phase of 0.5 mm or more | Product (Before Finishing Process) Grain Size of Macro Structure (mm) | Product β Phase Ratio (%) | β Phase area ($mm^2$) | Long Side/Short Side Ratio of β Phase | β Phase Ratio of 12 or less (%) | Number of β Phase of 0.06 mm or more | α Phase Size (mm) |
|---|---|---|---|---|---|---|---|---|---|---|---|
| Ex. 1103 | 23 | 9.9 | 6.1 | ○ | | 9.6 | $11.7 \times 10^{-6}$ | 2.9 | 100 | ○ | 0.011 |
| 1104 | 26 | 11.4 | 9.1 | ○ | | 11.6 | $17.1 \times 10^{-6}$ | 3.7 | 98 | ○ | 0.008 |
| 1105 | 25 | 11.5 | 6.8 | ○ | | 10.5 | $11.8 \times 10^{-6}$ | 3 | 100 | ○ | 0.01 |
| 1106 | 24 | 11.5 | 6.5 | ○ | | 10.6 | $11.6 \times 10^{-6}$ | 2.9 | 100 | ○ | 0.01 |
| 1107 | 26 | 12.0 | 7.2 | ○ | | 10.4 | $11 \times 10^{-6}$ | 2.8 | 100 | ○ | 0.008 |
| 1108 | 24 | 11.0 | 6.0 | ○ | | 9 | $15.5 \times 10^{-6}$ | 3.2 | 100 | ○ | 0.01 |
| 1201 | 25 | 25 | Net Shape | x | | 15.8 | $63 \times 10^{-6}$ | 5.3 | 96 | x | 0.006 |
| 1202 | 23 | 23.0 | Net Shape | x | | 15.2 | $76 \times 10^{-6}$ | 5.7 | 95 | x | 0.009 |
| 1301 | 25 | 17.8 | Net Shape | x | | 12.3 | $57 \times 10^{-6}$ | 4.7 | 98 | Δ | 0.007 |
| 1302 | 23 | 16.4 | Net Shape | x | | 11.8 | $43 \times 10^{-6}$ | 4.6 | 98 | Δ | 0.009 |
| 1401 | 27 | 14.2 | 10 | ○ | | 12.2 | $26 \times 10^{-6}$ | 4.8 | 97 | ○ | 0.013 |
| 1402 | 25 | 12.0 | 10.0 | ○ | | 10.3 | $32 \times 10^{-6}$ | 4.5 | 98 | ○ | 0.013 |
| 1403 | 24 | 13.5 | 9.5 | ○ | | 11.8 | $31 \times 10^{-6}$ | 4.7 | 98 | ○ | 0.015 |
| 1404 | 28 | 12.0 | 11.8 | ○ | | 12.9 | $26 \times 10^{-6}$ | 4.8 | 97 | ○ | 0.009 |
| 1405 | 28 | 14.4 | 10.5 | ○ | | 11.9 | $25 \times 10^{-6}$ | 4.6 | 98 | ○ | 0.013 |
| 1406 | 27 | 14.4 | 9.5 | ○ | 1.5 | 12 | $27 \times 10^{-6}$ | 4.7 | 98 | ○ | 0.012 |
| 1407 | 26 | 14.0 | 9 | ○ | | 11.8 | $19.8 \times 10^{-6}$ | 4.3 | 98 | ○ | 0.012 |
| 1408 | 26 | 12.5 | 9 | ○ | | 9.7 | $24 \times 10^{-6}$ | 4.1 | 99 | ○ | 0.012 |
| 1501 | 27 | 12.7 | 8.8 | ○ | | 12 | $25 \times 10^{-6}$ | 4.5 | 98 | ○ | 0.013 |
| 1502 | 27 | 12.2 | 9.9 | ○ | | 11.6 | $34 \times 10^{-6}$ | 4.6 | 98 | ○ | 0.013 |
| 1503 | 24 | 11.0 | 8.1 | ○ | | 10.3 | $28 \times 10^{-6}$ | 4.4 | 98 | ○ | 0.014 |
| 1504 | 31 | 14.0 | 11.3 | ○ | | 13.3 | $35 \times 10^{-6}$ | 4.8 | 97 | ○ | 0.012 |

TABLE 11

| | | Raw Material (Hot Processing Material, Continuous Casting Material) | | | | Product (Before Finishing Process) | | | | | | |
|---|---|---|---|---|---|---|---|---|---|---|---|---|
| | Alloy No. | Raw Material β Phase Ratio (%) | β Phase Ratio After Heat Treatment (%) | Long Side/Short Side Ratio of β Phase | Number of β Phase of 0.5 mm or more | Grain Size of Macro Structure (mm) | Product β Phase Ratio (%) | β Phase area ($mm^2$) | Long Side/Short Side Ratio of β Phase | β Phase Ratio of 12 or less (%) | Number of β Phase of 0.06 mm or more | α Phase Size (mm) |
| Ex. | 1505 | 18 | 8.4 | 7.8 | ○ | | 5.8 | $14.3 \times 10^{-6}$ | 4.1 | 99 | ○ | 0.015 |
| | 1506 | 28 | 13.0 | 9.0 | ○ | | 11.9 | $27 \times 10^{-6}$ | 4.6 | 97 | ○ | 0.013 |
| | 1507 | 27 | 13.0 | 8.7 | ○ | | 12.1 | $24 \times 10^{-6}$ | 4.6 | 98 | ○ | 0.012 |
| | 1508 | 26 | 12.5 | 8.5 | ○ | | 11.8 | $18.5 \times 10^{-6}$ | 4.1 | 99 | ○ | 0.012 |
| | 1509 | 26 | 12.3 | 8.5 | ○ | | 9.4 | $22 \times 10^{-6}$ | 3.8 | 100 | ○ | 0.012 |
| | 1601 | 27 | 27.0 | Net Shape | x | | 15.9 | $74 \times 10^{-6}$ | 6.5 | 92 | x | 0.012 |
| | 1602 | 24 | 24 | Net Shape | x | | 15.3 | $83 \times 10^{-6}$ | 6.5 | 92 | x | 0.013 |
| | 1701 | 30 | 13.6 | 12 | ○ | 1.2 | 10.9 | $22.8 \times 10^{-6}$ | 3.7 | 99 | ○ | 0.011 |
| | 1702 | 28 | 12.5 | 11.5 | ○ | 1.5 | 8.5 | $25 \times 10^{-6}$ | 3.8 | 98 | ○ | 0.013 |
| | 1703 | 26 | 12.6 | 12 | ○ | | 10.4 | $21 \times 10^{-6}$ | 3.6 | 99 | ○ | 0.012 |
| | 1704 | 28 | 12.5 | 10.0 | ○ | | 8 | $13 \times 10^{-6}$ | 3.6 | 97 | ○ | 0.01 |
| | 1705 | 30 | 12.5 | 10 | ○ | 0.1 | 10.9 | $19.5 \times 10^{-6}$ | 3.5 | 99 | ○ | 0.009 |
| | 1706 | 28 | 12.0 | 9.5 | ○ | 0.1 | 8.7 | $21 \times 10^{-6}$ | 3.6 | 99 | ○ | 0.001 |
| | 1801 | 30 | 12.9 | 9.4 | ○ | | 10.2 | $13.9 \times 10^{-6}$ | 3.4 | 98 | ○ | 0.011 |
| | 1802 | 26 | 11.5 | 9.2 | ○ | | 8.5 | $18.3 \times 10^{-6}$ | 3.2 | 100 | ○ | 0.012 |
| | 1803 | 28 | 12.3 | 10.2 | ○ | | 10 | $31 \times 10^{-6}$ | 3.9 | 98 | ○ | 0.011 |
| | 1804 | 21 | 9.4 | 7.2 | ○ | | 5 | $7.7 \times 10^{-6}$ | 2.9 | 100 | ○ | 0.014 |
| | 1805 | 28 | 12.1 | 10.3 | ○ | | 8.1 | $23 \times 10^{-6}$ | 3.6 | 98 | ○ | 0.013 |
| | 1806 | 26 | 11.3 | 10.0 | ○ | | 9.6 | $17.3 \times 10^{-6}$ | 3.4 | 98 | ○ | 0.012 |
| | 1807 | 25 | 10.8 | 8.5 | ○ | | 7.2 | $9.8 \times 10^{-6}$ | 3.2 | 100 | ○ | 0.014 |
| | 1808 | 34 | 15.3 | 12.2 | ○ | | 12.7 | $26 \times 10^{-6}$ | 4.1 | 98 | ○ | 0.01 |
| | 1809 | 24 | 11.0 | 9.5 | ○ | | 7.1 | $19 \times 10^{-6}$ | 3.5 | 100 | ○ | 0.011 |
| | 1810 | 31 | 13.1 | 11.0 | ○ | | 11.7 | $22 \times 10^{-6}$ | 4.3 | 98 | ○ | 0.007 |

TABLE 12

| | | Raw Material (Hot Processing Material, Continuous Casting Material) | | | | Product (Before Finishing Process) | | | | | | |
|---|---|---|---|---|---|---|---|---|---|---|---|---|
| | Alloy No. | Raw Material β Phase Ratio (%) | β Phase Ratio After Heat Treatment (%) | Long Side/Short Side Ratio of β Phase | Number of β Phase of 0.5 mm or more | Grain Size of Macro Structure (mm) | Product β Phase Ratio (%) | β Phase area ($mm^2$) | Long Side/Short Side Ratio of β Phase | β Phase Ratio of 12 or less (%) | Number of β Phase of 0.06 mm or more | α Phase Size (mm) |
| Ex. | 1811 | 30 | 13.0 | 9.4 | ○ | | 10 | $14 \times 10^{-6}$ | 3.5 | 98 | ○ | 0.012 |
| | 1812 | 30 | 13.0 | 8.5 | ○ | | 10 | $13.4 \times 10^{-6}$ | 3.3 | 99 | ○ | 0.009 |
| | 1813 | 28 | 11.7 | 8.8 | ○ | | 8.3 | $20 \times 10^{-6}$ | 3.4 | 100 | ○ | 0.01 |
| | 1901 | 30 | 11.7 | 8.6 | ○ | | 8.9 | $12.5 \times 10^{-6}$ | 3.2 | 99 | ○ | 0.012 |
| | 1902 | 26 | 10.1 | 8.5 | ○ | | 8.5 | $15.6 \times 10^{-6}$ | 3.2 | 99 | ○ | 0.013 |
| | 2001 | 30 | 13.6 | 12 | ○ | | 10 | $15.2 \times 10^{-6}$ | 3.7 | 100 | ○ | 0.012 |
| | 2002 | 28 | 13.0 | 10.8 | ○ | | 9.4 | $16.5 \times 10^{-6}$ | 3.5 | 99 | ○ | 0.01 |
| | 2003 | 26 | 12.6 | 12 | ○ | | 10.3 | $17.8 \times 10^{-6}$ | 3.7 | 99 | ○ | 0.013 |
| | 2101 | 30 | 30 | Net Shape | x | | 15.8 | $69 \times 10^{-6}$ | 5.5 | 93 | x | 0.009 |
| | 2102 | 21 | 21.0 | Net Shape | x | | 11.2 | $48 \times 10^{-6}$ | 5.1 | 97 | Δ | 0.011 |
| | 2103 | 26 | 26 | Net Shape | x | | 15.2 | $86 \times 10^{-6}$ | 6.1 | 92 | x | 0.01 |
| | 2104 | 30 | 30 | Net Shape | x | | 13.7 | $38 \times 10^{-6}$ | 4.7 | 96 | Δ | 0.008 |
| | 2105 | 28 | 28.0 | Net Shape | x | | 10.5 | $41 \times 10^{-6}$ | 4.9 | 96 | Δ | 0.008 |
| | 2201 | 30 | 20.3 | Net Shape | x | | 12.8 | $64 \times 10^{-6}$ | 5.1 | 97 | x | 0.01 |
| | 2202 | 26 | 19.3 | Net Shape | x | | 12.6 | $70 \times 10^{-6}$ | 5.2 | 97 | x | 0.009 |
| | 2301 | 30 | 15.6 | 16 | Δ | | 12.3 | $35 \times 10^{-6}$ | 4.6 | 96 | Δ | 0.01 |
| | 2302 | 26 | 14.6 | 15 | Δ | | 11.9 | $34 \times 10^{-6}$ | 4.6 | 96 | Δ | 0.009 |
| | 2401 | 30 | 12.9 | 9.4 | ○ | | 15.1 | $86 \times 10^{-6}$ | 6.9 | 92 | x | Partial Non-Recrystallization |
| | 2402 | 28 | 12.1 | 10.3 | ○ | | 14.5 | $85 \times 10^{-6}$ | 6.8 | 93 | x | Partial Non-Recrystallization |
| | 2403 | 26 | 30.0 | 10.0 | ○ | | 14.4 | $83 \times 10^{-6}$ | 6.9 | 92 | x | Partial Non-Recrystallization |
| | 2501 | 30 | 12.9 | 9.4 | ○ | | 12.6 | $27 \times 10^{-6}$ | 5.4 | 96 | Δ | 0.006 |
| | 2502 | 26 | 11.3 | 10.0 | ○ | | 11.8 | $17 \times 10^{-6}$ | 5.3 | 97 | Δ | 0.007 |

TABLE 13

| | | Raw Material (Hot Processing Material, Continuous Casting Material) | | | | Product (Before Finishing Process) | | | | | | |
|---|---|---|---|---|---|---|---|---|---|---|---|---|
| | Alloy No. | Raw Material β Phase Ratio (%) | β Phase Ratio After Heat Treatment (%) | Long Side/Short Side Ratio of β Phase | Number of β Phase of 0.5 mm or more | Grain Size of Macro Structure (mm) | Product β Phase Ratio (%) | β Phase area ($mm^2$) | Long Side/Short Side Ratio of β Phase | β Phase Ratio of 12 or less (%) | Number of β Phase of 0.06 mm or more | α Phase Size (mm) |
| Comp. Ex. | 3001 | 22 | 9.7 | 8.5 | ○ | | 8.3 | $16.3 \times 10^{-6}$ | 3.5 | 99 | ○ | 0.009 |
| | 3002 | 27 | 14.3 | 15.0 | Δ | | 13.1 | $67 \times 10^{-6}$ | 7.1 | 95 | x | 0.01 |
| | 3003 | 42 | 20.5 | 17.0 | Δ | | 18.5 | $210 \times 10^{-6}$ | 8 | 89 | x | 0.007 |
| | 3004 | 10 | 3.2 | 3.2 | ○ | | 1.2 | $3.4 \times 10^{-6}$ | 1.9 | 100 | ○ | 0.025 |
| | 3005 | 29 | 13.3 | 13.0 | ○ | | 11.5 | $15 \times 10^{-6}$ | 3.2 | 99 | ○ | 0.01 |
| | 3006 | 24 | 10.9 | 9.3 | ○ | | 8.6 | $11.7 \times 10^{-6}$ | 3.2 | 100 | ○ | 0.011 |
| | 3007 | 34 | 18.5 | 17.0 | Δ | | 16.8 | $167 \times 10^{-6}$ | 7.7 | 92 | x | 0.008 |
| | 3008 | 27 | 11.3 | 9.5 | ○ | | 8.5 | $18.5 \times 10^{-6}$ | 2.9 | 99 | ○ | 0.011 |
| | 301 | 22 | 22.0 | Net Shape | x | | 14.6 | $34 \times 10^{-6}$ | 5.7 | 95 | x | 0.008 |
| | 3102 | 27 | 27.0 | Net Shape | x | | 16.8 | $115 \times 10^{-6}$ | 8.2 | 88 | x | 0.009 |
| | 3103 | 42 | 42.0 | Net Shape | x | | 23.5 | $145 \times 10^{-6}$ | 7.8 | 81 | x | 0.006 |
| | 3104 | 10 | 10.0 | Net Shape | x | | 3.8 | $9.6 \times 10^{-6}$ | 3.5 | 99 | ○ | 0.022 |
| | 3105 | 29 | 29.0 | Net Shape | x | | 14.4 | $31 \times 10^{-6}$ | 4.9 | 98 | x | 0.008 |
| | 3106 | 24 | 24.0 | Net Shape | x | | 13.8 | $30 \times 10^{-6}$ | 4.3 | 97 | Δ | 0.01 |
| | 3107 | 34 | 34.0 | Net Shape | x | | 21.9 | $123 \times 10^{-6}$ | 7.4 | 87 | x | 0.006 |
| | 3108 | 27 | 27.0 | Net Shape | x | | 15.5 | $27 \times 10^{-6}$ | 5 | 96 | Δ | 0.009 |
| | 3201 | 20 | 9.4 | 9.6 | ○ | | 8.5 | $16.4 \times 10^{-6}$ | 3.8 | 99 | ○ | 0.01 |
| | 3202 | 25 | 14.1 | 13.3 | Δ | | 13.3 | $80 \times 10^{-6}$ | 7 | 92 | x | 0.009 |
| | 3203 | 27 | 13.5 | 13.2 | ○ | | 11.6 | $28 \times 10^{-6}$ | 3.6 | 99 | ○ | 0.009 |
| | 3301 | 25 | 25 | Net Shape | x | | 16.2 | $120 \times 10^{-6}$ | 7.7 | 87 | x | 0.008 |
| | 3302 | 25 | 25 | Net Shape | x | | 15.8 | $32 \times 10^{-6}$ | 5.4 | 95 | x | 0.009 |

TABLE 14

| | | Raw Material (Hot Processing Material, Continuous Casting Material) | | | | Product (Before Finishing Process) | | | | | | |
|---|---|---|---|---|---|---|---|---|---|---|---|---|
| | Alloy No. | Raw Material β Phase Ratio (%) | β Phase Ratio After Heat Treatment (%) | Long Side/Short Side Ratio of β Phase | Number of β Phase of 0.5 mm or more | Grain Size of Macro Structure (mm) | Product β Phase Ratio (%) | β Phase area ($mm^2$) | Long Side/Short Side Ratio of β Phase | β Phase Ratio of 12 or less (%) | Number of β Phase of 0.06 mm or more | α Phase Size (mm) |
| Comp. Ex. | 3401 | 21 | 9.8 | 11.0 | ○ | | 8.8 | $33 \times 10^{-6}$ | 4.7 | 97 | ○ | 0.012 |
| | 3402 | 33 | 18.4 | 19.0 | x | | 17 | $155 \times 10^{-6}$ | 8 | 87 | x | 0.011 |
| | 3501 | 41 | 20.2 | 16.5 | x | | 18.8 | $240 \times 10^{-6}$ | 9 | 78 | x | 0.012 |
| | 3502 | 9 | 3.0 | 5.2 | ○ | | 2.6 | $10.5 \times 10^{-6}$ | 2.4 | 99 | ○ | 0.04 |
| | 3503 | 23 | 11.3 | 13.4 | ○ | | 9.5 | $34 \times 10^{-6}$ | 3.8 | 99 | ○ | 0.013 |
| | 3601 | 23 | 23.0 | Net Shape | x | | 13.5 | $39 \times 10^{-6}$ | 4.6 | 97 | x | 0.011 |
| | 3602 | 33 | 33 | Net Shape | x | | 20.6 | $148 \times 10^{-6}$ | 8 | 85 | x | 0.009 |
| | 3603 | 28 | 28 | Net Shape | x | | 15.3 | $67 \times 10^{-6}$ | 5.5 | 95 | x | 0.011 |
| | 3701 | 23 | 11.0 | 9.3 | ○ | | 8.4 | $17.6 \times 10^{-6}$ | 4.3 | 98 | ○ | 0.01 |
| | 3702 | 29 | 15.0 | 16.5 | x | | 14.3 | $91 \times 10^{-6}$ | 7.5 | 91 | x | 0.011 |
| | 3703 | 43 | 21.2 | 18.0 | x | | 19.1 | $175 \times 10^{-6}$ | 8.2 | 87 | x | 0.009 |
| | 3704 | 11 | 3.6 | 4.5 | ○ | | 1.8 | $5.8 \times 10^{-6}$ | 2.2 | 100 | ○ | 0.03 |
| | 3705 | 31 | 14.2 | 14.0 | Δ | | 11.8 | $18.5 \times 10^{-6}$ | 3.5 | 99 | ○ | 0.011 |
| | 3706 | 26 | 11.7 | 11.0 | ○ | | 9.4 | $14.3 \times 10^{-6}$ | 3.5 | 100 | ○ | 0.009 |
| | 3707 | 35 | 19.0 | 17.0 | x | | 17.2 | $178 \times 10^{-6}$ | 7.5 | 91 | x | 0.009 |
| | 3801 | 31 | 31.0 | Net Shape | x | | 15.2 | $37 \times 10^{-6}$ | 5.2 | 97 | x | 0.009 |
| | 3901 | | | | | | 0 | $\times 10^{-6}$ | | | | 0.015 |
| | 3902 | | | | | | 8 | $\times 10^{-6}$ | | | | 0.015 |
| | 3903 | | | | | | 13 | $\times 10^{-6}$ | | | | 0.015 |
| | 3904 | | | | | | 0 | $\times 10^{-6}$ | | | | |
| | 3905 | | | | | | 12 | $\times 10^{-6}$ | | | | |
| | 3906 | | | | | | 15 | $\times 10^{-6}$ | | | | |

TABLE 15

| | Alloy No. | Hot Processing Property | Cold Processing Property | Torsion Strength 1° Permanent Deformation ($N/mm^2$) | Torsion Strength 45° Permanent Deformation ($N/mm^2$) | Impact Strength ($J/cm^2$) | Bending | Wear Resistance (mg) | Press Formability Dimensional Difference | Press Formability Shear Droop | Press Formability Burr |
|---|---|---|---|---|---|---|---|---|---|---|---|
| Ex. | 101 | ○ | ○ | | | | ○ | 28.8 | ○ | ○ | ○ |
| | 102 | | ○ | | | | ○ | 29 | ○ | ○ | ○ |
| | 103 | ○ | ○ | | | | ○ | 27.8 | ○ | ○ | ○ |
| | 104 | ○ | ○ | | | | ○ | 28.5 | ○ | ○ | ○ |
| | 201 | | ○ | | | | ○ | 28.3 | ○ | ○ | ○ |
| | 202 | ○ | ○ | | | | ○ | 30.3 | ○ | ○ | ○ |
| | 203 | ○ | ○ | | | | ○ | 32.5 | ○ | ○ | ○ |
| | 204 | ○ | ○ | | | | ○ | 29.3 | ○ | ○ | ○ |
| | 205 | ○ | ○ | | | | ○ | 27.2 | ○ | ○ | ○ |
| | 206 | | ○ | | | | ○ | 27.6 | ○ | ○ | ○ |
| | 207 | ○ | ○ | | | | ○ | 29.2 | ○ | ○ | ○ |
| | 208 | ○ | ○ | | | | ○ | 29 | ○ | ○ | ○ |
| | 209 | ○ | ○ | | | | ○ | 27.1 | ○ | ○ | ○ |
| | 210 | ○ | ○ | | | | ○ | 29.4 | ○ | ○ | ○ |
| | 211 | ○ | ○ | | | | ○ | 29.6 | ○ | ○ | ○ |
| | 212 | ○ | ○ | | | | ○ | 27.1 | ○ | ○ | ○ |
| | 213 | | ○ | | | | ○ | 28.5 | ○ | ○ | ○ |
| | 214 | | ○ | | | | ○ | 27.5 | ○ | ○ | ○ |
| | 215 | ○ | ○ | | | | ○ | 27.2 | ○ | ○ | ○ |
| | 301 | | ○ | | | | ○ | 30.5 | ○ | ○ | ○ |
| | 302 | | ○ | | | | ○ | 29 | ○ | ○ | ○ |
| | 303 | | ○ | | | | ○ | 28.6 | ○ | ○ | ○ |

TABLE 16

| | Alloy No. | Hot Processing Property | Cold Processing Property | Torsion Strength 1° Permanent Deformation ($N/mm^2$) | Torsion Strength 45° Permanent Deformation ($N/mm^2$) | Impact Strength ($J/cm^2$) | Bending | Wear Resistance (mg) | Press Formability Dimensional Difference | Press Formability Shear Droop | Press Formability Burr |
|---|---|---|---|---|---|---|---|---|---|---|---|
| Ex. | 401 | | ○ | | | | ○ | 31.4 | ○ | ○ | ○ |
| | 402 | | ○ | | | | ○ | 29.4 | ○ | ○ | ○ |
| | 501 | | Δ | | | | Δ | 38.9 | Δ | ○ | Δ |
| | 502 | | Δ | | | | Δ | 36.6 | ○ | ○ | Δ |
| | 503 | | Δ | | | | Δ | 34.8 | ○ | ○ | Δ |
| | 601 | | Δ | | | | ○ | 35.8 | ○ | ○ | Δ |
| | 602 | | Δ | | | | ○ | 32.9 | ○ | ○ | Δ |
| | 701 | | ○ | | | | ○ | 34.3 | Δ | ○ | ○ |
| | 702 | | ○ | | | | ○ | 32.6 | Δ | ○ | ○ |
| | 801 | | ○ | | | | x | 40.6 | Δ | ○ | x |
| | 802 | | ○ | | | | x | 37.8 | ○ | ○ | x |
| | 901 | | ○ | | | | ○ | 38.4 | ○ | ○ | Δ |
| | 902 | | ○ | | | | ○ | 36.1 | ○ | ○ | Δ |
| | 1001 | | | 181 | 292 | 51 | | | | | |
| | 1002 | | | 172 | 279 | 51.5 | | | | | |
| | 1003 | | | 184 | 293 | 48.6 | | | | | |
| | 1004 | | | 182 | 293 | 48 | | | | | |
| | 1005 | | | 183 | 285 | 46.5 | | | | | |
| | 1006 | | | 184 | 292 | 51 | | | | | |
| | 1007 | | | 183 | 293 | 50.8 | | | | | |
| | 1101 | | | 185 | 294 | 48.9 | | | | | |
| | 1102 | | | 178 | 285 | 47.6 | | | | | |

TABLE 17

| | Alloy No. | Hot Processing Property | Cold Processing Property | Torsion Strength 1° Permanent Deformation (N/mm$^2$) | Torsion Strength 45° Permanent Deformation (N/mm$^2$) | Impact Strength (J/cm$^2$) | Bending | Wear Resistance (mg) | Press Formability Dimensional Difference | Press Formability Shear Droop | Press Formability Burr |
|---|---|---|---|---|---|---|---|---|---|---|---|
| Ex. | 1103 | | | 183 | 295 | 47.3 | | | | | |
| | 1104 | | | 180 | 291 | 47 | | | | | |
| | 1105 | | | 182 | 285 | 45 | | | | | |
| | 1106 | | | 183 | 293 | 49.2 | | | | | |
| | 1107 | | | 187 | 295 | 49 | | | | | |
| | 1108 | | | 185 | 290 | 47 | | | | | |
| | 1201 | | | 153 | 273 | 33.8 | | | | | |
| | 1202 | | | 157 | 276 | 29.8 | | | | | |
| | 1301 | | | 165 | 276 | 40.3 | | | | | |
| | 1302 | | | 167 | 281 | 38.4 | | | | | |
| | 1401 | | ○ | 175 | 285 | 52.6 | | | | | |
| | 1402 | | ○ | 165 | 268 | 53.5 | | | | | |
| | 1403 | | ○ | 182 | 287 | 49.8 | | | | | |
| | 1404 | | ○ | 180 | 285 | 49.2 | ○ | | ○ | ○ | ○ |
| | 1405 | | ○ | 180 | 280 | 47.7 | | | | | |
| | 1406 | | ○ | 182 | 286 | 52.5 | | | | | |
| | 1407 | | ○ | 184 | 288 | 52.5 | | | | | |
| | 1408 | | ○ | 183 | 285 | 51.2 | | | | | |
| | 1501 | | ○ | 177 | 288 | 50.3 | | | | | |
| | 1502 | | ○ | 173 | 278 | 50.5 | | | | | |
| | 1503 | | ○ | 181 | 286 | 48.7 | | | | | |
| | 1504 | | ○ | 173 | 274 | 46.7 | ○ | | ○ | ○ | ○ |

TABLE 18

| | Alloy No. | Hot Processing Property | Cold Processing Property | Torsion Strength 1° Permanent Deformation (N/mm$^2$) | Torsion Strength 45° Permanent Deformation (N/mm$^2$) | Impact Strength (J/cm$^2$) | Bending | Wear Resistance (mg) | Press Formability Dimensional Difference | Press Formability Shear Droop | Press Formability Burr |
|---|---|---|---|---|---|---|---|---|---|---|---|
| Ex. | 1505 | | ○ | 170 | 271 | 47.9 | ○ | | ○ | ○ | ○ |
| | 1506 | | ○ | 180 | 287 | 45.8 | | | | | |
| | 1507 | | ○ | 183 | 288 | 50 | | | | | |
| | 1508 | | ○ | 183 | 287 | 50.4 | | | | | |
| | 1509 | | ○ | 185 | 286 | 49.5 | | | | | |
| | 1601 | | Δ | 150 | 271 | 34.5 | | | | | |
| | 1602 | | ○ | 153 | 270 | 31.5 | | | | | |
| | 1701 | | ○ | | | | ○ | 30.1 | ○ | ○ | ○ |
| | 1702 | | ○ | | | | ○ | 28.5 | ○ | ○ | ○ |
| | 1703 | | ○ | | | | ○ | 28.2 | ○ | ○ | ○ |
| | 1704 | | ○ | | | | ○ | 31.1 | ○ | ○ | ○ |
| | 1705 | | ○ | | | | ○ | 29 | ○ | ○ | ○ |
| | 1706 | | ○ | | | | ○ | 28.5 | ○ | ○ | ○ |
| | 1801 | | ○ | | | | ○ | 29.2 | ○ | ○ | ○ |
| | 1802 | | ○ | | | | ○ | 31.1 | ○ | ○ | ○ |
| | 1803 | | ○ | | | | ○ | 33.3 | ○ | ○ | ○ |
| | 1804 | | ○ | | | | ○ | 28.6 | ○ | ○ | ○ |
| | 1805 | | ○ | | | | ○ | 27.7 | ○ | ○ | ○ |
| | 1806 | | ○ | | | | ○ | 27.4 | ○ | ○ | ○ |
| | 1807 | | ○ | | | | ○ | 30 | ○ | ○ | ○ |
| | 1808 | | ○ | | | | ○ | 30.1 | ○ | ○ | ○ |
| | 1809 | | ○ | | | | ○ | 29.7 | ○ | ○ | ○ |
| | 1810 | | ○ | | | | ○ | 28.8 | ○ | ○ | ○ |

TABLE 19

| | Alloy No. | Hot Processing Property | Cold Processing Property | Torsion Strength: 1° Permanent Deformation (N/mm²) | Torsion Strength: 45° Permanent Deformation (N/mm²) | Impact Strength (J/cm²) | Bending | Wear Resistance (mg) | Press Formability: Dimensional Difference | Press Formability: Shear Droop | Press Formability: Burr |
|---|---|---|---|---|---|---|---|---|---|---|---|
| Ex. | 1811 | | ○ | | | | ○ | 27.5 | ○ | ○ | ○ |
| | 1812 | | ○ | | | | ○ | 28.3 | ○ | ○ | ○ |
| | 1813 | | ○ | | | | ○ | 27.7 | ○ | ○ | ○ |
| | 1901 | | ○ | | | | ○ | 30.7 | ○ | ○ | ○ |
| | 1902 | | ○ | | | | ○ | 28.5 | ○ | ○ | ○ |
| | 2001 | | ○ | | | | ○ | 32.5 | ○ | ○ | ○ |
| | 2002 | | ○ | | | | ○ | 35 | ○ | ○ | ○ |
| | 2003 | | ○ | | | | ○ | 30.6 | ○ | ○ | ○ |
| | 2101 | | x | | | | Δ | 39.6 | Δ | ○ | ○ |
| | 2102 | | Δ | | | | ○ | 39.8 | ○ | Δ | ○ |
| | 2103 | | x | | | | Δ | 36 | Δ | ○ | ○ |
| | 2104 | | Δ | | | | Δ | 34 | ○ | ○ | ○ |
| | 2105 | | Δ | | | | ○ | 36.6 | ○ | ○ | Δ |
| | 2201 | | Δ | | | | Δ | 35.1 | Δ | ○ | ○ |
| | 2202 | | x | | | | Δ | 32.5 | ○ | ○ | ○ |
| | 2301 | | Δ | | | | ○ | 35.8 | ○ | Δ | ○ |
| | 2302 | | Δ | | | | ○ | 33.9 | ○ | Δ | ○ |
| | 2401 | | ○ | | | | x | 41.2 | Δ | ○ | Δ |
| | 2402 | | ○ | | | | Δ | 39.5 | Δ | ○ | Δ |
| | 2403 | | ○ | | | | x | 37 | Δ | ○ | Δ |
| | 2501 | | ○ | | | | Δ | 39.7 | ○ | ○ | Δ |
| | 2502 | | ○ | | | | Δ | 37.2 | ○ | ○ | Δ |

TABLE 20

| | Alloy No. | Machinability: Torque of Drill (N · cm) | Machinability: Tool Life (Times) | Stress Corrosion Cracking Resistance | Color Tone L | Color Tone a | Color Tone b | Color Tone After Test L | Color Tone After Test a | Color Tone After Test b | Color Difference Before and After Test |
|---|---|---|---|---|---|---|---|---|---|---|---|
| Ex. | 101 | | | ○ | 83.28 | −0.13 | 9.83 | 74.80 | 1.04 | 12.09 | 8.85 |
| | 102 | | | ○ | | | | | | | |
| | 103 | | | ○ | | | | | | | |
| | 104 | | | ○ | | | | | | | |
| | 201 | | | ○ | 83.64 | −0.14 | 9.78 | 75.08 | 0.99 | 11.51 | 8.81 |
| | 202 | | | ○ | 83.54 | 0.38 | 10.81 | 74.34 | 1.33 | 14.51 | 9.96 |
| | 203 | | | ○ | 85.34 | −0.50 | 9.74 | 77.31 | 0.61 | 10.99 | 8.20 |
| | 204 | | | ○ | 83.51 | −0.10 | 9.08 | 74.81 | 0.83 | 11.87 | 9.18 |
| | 205 | | | ○ | 83.10 | −0.23 | 10.57 | 75.13 | 1.44 | 12.69 | 8.41 |
| | 206 | | | ○ | 84.89 | −0.51 | 9.65 | 77.01 | 0.99 | 10.85 | 8.11 |
| | 207 | | | ○ | 85.16 | −0.35 | 9.78 | 76.87 | 0.43 | 10.72 | 8.38 |
| | 208 | | | ○ | 84.92 | −0.19 | 9.50 | 76.30 | 0.81 | 10.89 | 8.79 |
| | 209 | | | ○ | 83.98 | 0.23 | 10.06 | 75.78 | 2.04 | 12.83 | 8.84 |
| | 210 | | | ○ | 85.87 | 0.18 | 9.91 | 78.09 | 1.13 | 11.84 | 8.07 |
| | 211 | | | ○ | 84.04 | −0.08 | 9.76 | 76.22 | 1.28 | 12.61 | 8.43 |
| | 212 | | | ○ | 85.05 | −0.14 | 9.82 | 77.18 | 0.87 | 11.33 | 8.08 |
| | 213 | | | ○ | | | | | | | |
| | 214 | | | ○ | | | | | | | |
| | 215 | | | ○ | | | | | | | |
| | 301 | | | ○ | | | | | | | |
| | 302 | | | ○ | | | | | | | |
| | 303 | | | ○ | | | | | | | |

TABLE 21

| | Alloy No. | Machinability: Torque of Drill (N · cm) | Machinability: Tool Life (Times) | Stress Corrosion Cracking Resistance | Color Tone L | Color Tone a | Color Tone b | Color Tone After Test L | Color Tone After Test a | Color Tone After Test b | Color Difference Before and After Test |
|---|---|---|---|---|---|---|---|---|---|---|---|
| Ex. | 401 | | | ○ | | | | | | | |
| | 402 | | | ○ | | | | | | | |
| | 501 | | | Δ | 83.28 | −0.13 | 9.80 | 74.78 | 1.13 | 12.41 | 8.98 |

TABLE 21-continued

| Alloy No. | Machinability: Torque of Drill (N · cm) | Machinability: Tool Life (Times) | Stress Corrosion Cracking Resistance | Color Tone L | Color Tone a | Color Tone b | Color Tone After Test L | Color Tone After Test a | Color Tone After Test b | Color Difference Before and After Test |
|---|---|---|---|---|---|---|---|---|---|---|
| 502 | | | ○ | | | | | | | |
| 503 | | | Δ | | | | | | | |
| 601 | | | ○ | | | | | | | |
| 602 | | | ○ | | | | | | | |
| 701 | | | ○ | | | | | | | |
| 702 | | | ○ | | | | | | | |
| 801 | | | Δ | 83.17 | −0.17 | 9.77 | 74.68 | 1.23 | 12.38 | 8.99 |
| 802 | | | Δ | | | | | | | |
| 901 | | | ○ | | | | | | | |
| 902 | | | ○ | | | | | | | |
| 1001 | 92 | | | | | | | | | |
| 1002 | 96 | | | | | | | | | |
| 1003 | 90 | | | | | | | | | |
| 1004 | 92 | | | | | | | | | |
| 1005 | 87 | | | | | | | | | |
| 1006 | 91 | | | | | | | | | |
| 1007 | 92 | | | | | | | | | |
| 1101 | 93 | | | | | | | | | |
| 1102 | 89 | | | | | | | | | |

TABLE 22

| | Alloy No. | Machinability: Torque of Drill (N · cm) | Machinability: Tool Life (Times) | Stress Corrosion Cracking Resistance | Color Tone L | Color Tone a | Color Tone b | Color Tone After Test L | Color Tone After Test a | Color Tone After Test b | Color Difference Before and After Test |
|---|---|---|---|---|---|---|---|---|---|---|---|
| Ex. | 1103 | 90 | | | | | | | | | |
| | 1104 | 92 | | | | | | | | | |
| | 1105 | 89 | | | | | | | | | |
| | 1106 | 92 | | | | | | | | | |
| | 1107 | 92 | | | | | | | | | |
| | 1108 | 90 | | | | | | | | | |
| | 1201 | 98 | | | | | | | | | |
| | 1202 | 98 | | | | | | | | | |
| | 1301 | 97 | | | | | | | | | |
| | 1302 | 98 | | | | | | | | | |
| | 1401 | 92 | 20UP | | | | | | | | |
| | 1402 | 94 | 20UP | | | | | | | | |
| | 1403 | 90 | 20UP | | | | | | | | |
| | 1404 | 93 | 20UP | ○ | | | | | | | |
| | 1405 | 88 | 20UP | | | | | | | | |
| | 1406 | 91 | 20UP | | | | | | | | |
| | 1407 | 92 | 20UP | | | | | | | | |
| | 1408 | 90 | 20UP | | | | | | | | |
| | 1501 | 92 | 20UP | | | | | | | | |
| | 1502 | 93 | 20UP | | | | | | | | |
| | 1503 | 90 | 20UP | | | | | | | | |
| | 1504 | 92 | 20UP | ○ | | | | | | | |

TABLE 23

| | Alloy No. | Machinability: Torque of Drill (N · cm) | Machinability: Tool Life (Times) | Stress Corrosion Cracking Resistance | Color Tone L | Color Tone a | Color Tone b | Color Tone After Test L | Color Tone After Test a | Color Tone After Test b | Color Difference Before and After Test |
|---|---|---|---|---|---|---|---|---|---|---|---|
| Ex. | 1505 | 95 | 20UP | ○ | | | | | | | |
| | 1506 | 88 | 20UP | | | | | | | | |
| | 1507 | 91 | 20UP | | | | | | | | |
| | 1508 | 92 | 20UP | | | | | | | | |
| | 1509 | 90 | 20UP | | | | | | | | |
| | 1601 | 100 | 15 | | | | | | | | |
| | 1602 | 97 | 18 | | | | | | | | |

TABLE 23-continued

| Alloy No. | Machinability: Torque of Drill (N · cm) | Machinability: Tool Life (Times) | Stress Corrosion Cracking Resistance | Color Tone L | Color Tone a | Color Tone b | Color Tone After Test L | Color Tone After Test a | Color Tone After Test b | Color Difference Before and After Test |
|---|---|---|---|---|---|---|---|---|---|---|
| 1701 | | | ○ | 83.51 | −0.15 | 9.70 | 74.9 | 1.01 | 11.47 | 8.87 |
| 1702 | | | ○ | | | | | | | |
| 1703 | | | ○ | | | | | | | |
| 1704 | | | ○ | | | | | | | |
| 1705 | | | ○ | | | | | | | |
| 1706 | | | ○ | | | | | | | |
| 1801 | | | ○ | 83.38 | −0.18 | 9.81 | 74.86 | 0.94 | 11.87 | 8.84 |
| 1802 | | | ○ | | | | | | | |
| 1803 | | | ○ | | | | | | | |
| 1804 | | | ○ | | | | | | | |
| 1805 | | | ○ | | | | | | | |
| 1806 | | | ○ | | | | | | | |
| 1807 | | | ○ | | | | | | | |
| 1808 | | | ○ | | | | | | | |
| 1809 | | | ○ | | | | | | | |
| 1810 | | | ○ | | | | | | | |

TABLE 24

| | Alloy No. | Machinability: Torque of Drill (N · cm) | Machinability: Tool Life (Times) | Stress Corrosion Cracking Resistance | Color Tone L | Color Tone a | Color Tone b | Color Tone After Test L | Color Tone After Test a | Color Tone After Test b | Color Difference Before and After Test |
|---|---|---|---|---|---|---|---|---|---|---|---|
| Ex. | 1811 | | | ○ | | | | | | | |
| | 1812 | | | ○ | | | | | | | |
| | 1813 | | | ○ | | | | | | | |
| | 1901 | | | ○ | | | | | | | |
| | 1902 | | | ○ | | | | | | | |
| | 2001 | | | ○ | | | | | | | |
| | 2002 | | | ○ | | | | | | | |
| | 2003 | | | ○ | | | | | | | |
| | 2101 | | | ○ | | | | | | | |
| | 2102 | | | ○ | | | | | | | |
| | 2103 | | | Δ | | | | | | | |
| | 2104 | | | ○ | | | | | | | |
| | 2105 | | | ○ | | | | | | | |
| | 2201 | | | ○ | | | | | | | |
| | 2202 | | | ○ | | | | | | | |
| | 2301 | | | ○ | | | | | | | |
| | 2302 | | | ○ | | | | | | | |
| | 2401 | | | Δ | | | | | | | |
| | 2402 | | | Δ | | | | | | | |
| | 2403 | | | Δ | | | | | | | |
| | 2501 | | | ○ | | | | | | | |
| | 2502 | | | ○ | | | | | | | |

TABLE 25

| | Alloy No. | Hot Processing Property | Cold Processing Property | Torsion Strength: 1° Permanent Deformation ($N/mm^2$) | Torsion Strength: 45° Permanent Deformation ($N/mm^2$) | Impact Strength ($J/cm^2$) | Bending | Wear Resistance (mg) | Press Formability: Dimensional Difference | Press Formability: Shear Droop | Press Formability: Burr |
|---|---|---|---|---|---|---|---|---|---|---|---|
| Comp. | 3001 | | ○ | | | | Δ | 39 | Δ | ○ | Δ |
| Ex. | 3002 | | Δ | | | | ○ | 69.5 | x | ○ | Δ |
| | 3003 | | Δ | | | | x | 37.1 | ○ | ○ | x |
| | 3004 | | ○ | | | | ○ | 52.1 | Δ | x | ○ |
| | 3005 | | ○ | | | | ○ | 40.5 | Δ | x | ○ |
| | 3006 | | ○ | | | | Δ | 41.6 | Δ | ○ | x |
| | 3007 | | Δ | | | | x | 64.5 | Δ | ○ | x |
| | 3008 | | ○ | | | | ○ | 45.8 | Δ | Δ | ○ |
| | 3101 | Δ | Δ | | | | Δ | 45.8 | Δ | Δ | Δ |

TABLE 25-continued

| Alloy No. | Hot Processing Property | Cold Processing Property | Torsion Strength 1° Permanent Deformation ($N/mm^2$) | Torsion Strength 45° Permanent Deformation ($N/mm^2$) | Impact Strength ($J/cm^2$) | Bending | Wear Resistance (mg) | Press Formability Dimensional Difference | Press Formability Shear Droop | Press Formability Burr |
|---|---|---|---|---|---|---|---|---|---|---|
| 3102 | x | x | | | | Δ | 70.5 | x | ○ | Δ |
| 3103 | ○ | x | | | | x | 47.3 | Δ | ○ | x |
| 3104 | x | ○ | | | | ○ | 59 | Δ | x | ○ |
| 3105 | ○ | Δ | | | | Δ | 44.4 | ○ | Δ | ○ |
| 3106 | Δ | Δ | | | | x | 46.3 | Δ | Δ | Δ |
| 3107 | ○ | x | | | | x | 65.5 | x | ○ | Δ |
| 3108 | ○ | Δ | | | | Δ | 47.5 | Δ | ○ | Δ |
| 3201 | | | 172 | 283 | 48.3 | | | | | |
| 3202 | | | 178 | 295 | 31.5 | | | | | |
| 3203 | | | 163 | 272 | 49.2 | | | | | |
| 3301 | | | 183 | 281 | 22.8 | | | | | |
| 3302 | | | 156 | 268 | 32.0 | | | | | |

TABLE 26

| | Alloy No. | Hot Processing Property | Cold Processing Property | Torsion Strength 1° Permanent Deformation ($N/mm^2$) | Torsion Strength 45° Permanent Deformation ($N/mm^2$) | Impact Strength ($J/cm^2$) | Bending | Wear Resistance (mg) | Press Formability Dimensional Difference | Press Formability Shear Droop | Press Formability Burr |
|---|---|---|---|---|---|---|---|---|---|---|---|
| Comp. Ex. | 3401 | | | 168 | 270 | 46.5 | | | | | |
| | 3402 | | | 177 | 281 | 39.5 | | | | | |
| | 3501 | | | 181 | 254 | 25.6 | | | | | |
| | 3502 | | | 162 | 255 | 56.8 | | | | | |
| | 3503 | | | 164 | 266 | 43.4 | | | | | |
| | 3601 | | | 155 | 268 | 33.6 | | | | | |
| | 3602 | | | 145 | 264 | 27.0 | | | | | |
| | 3603 | | | 136 | 260 | 33.0 | | | | | |
| | 3701 | | ○ | | | | ○ | 41.7 | Δ | ○ | Δ |
| | 3702 | | Δ | | | | ○ | 70.8 | x | ○ | Δ |
| | 3703 | | Δ | | | | x | 39.4 | ○ | ○ | x |
| | 3704 | | | | | | ○ | 54.6 | Δ | x | ○ |
| | 3705 | | ○ | | | | ○ | 42.3 | Δ | x | ○ |
| | 3706 | | ○ | | | | Δ | 43.7 | Δ | ○ | x |
| | 3707 | | Δ | | | | x | 66.8 | Δ | ○ | x |
| | 3801 | | Δ | | | | Δ | 51.2 | Δ | Δ | ○ |
| | 3901 | | | | | | x | 95.5 | Δ | Δ | ○ |
| | 3902 | | | | | | x | 38.4 | Δ | Δ | ○ |
| | 3903 | | | | | | Δ | 45.6 | ○ | x | Δ |
| | 3904 | | | 111 | 183 | 19.8 | | | | | |
| | 3905 | | | 106 | 176 | 21.3 | | | | | |
| | 3906 | | | 113 | 187 | 55.4 | | | | | |

TABLE 27

| | Alloy No. | Machinability Torque of Drill (N · cm) | Machinability Tool Life (Times) | Stress Corrosion Cracking Resistance | Color Tone L | Color Tone a | Color Tone b | Color Tone After Test L | Color Tone After Test a | Color Tone After Test b | Color Difference Before and After Test |
|---|---|---|---|---|---|---|---|---|---|---|---|
| Comp. Ex. | 3001 | | | Δ | 82.87 | −0.08 | 9.81 | 72.21 | 2.02 | 12.47 | 11.19 |
| | 3002 | | | ○ | 83.88 | 1.27 | 12.94 | 74.09 | 1.32 | 15.21 | 10.05 |
| | 3003 | | | Δ | 84.46 | −0.14 | 9.34 | 73.12 | 1.28 | 13.46 | 12.15 |
| | 3004 | | | ○ | 83.02 | −0.23 | 11.87 | 73.11 | 3.24 | 13.78 | 10.67 |
| | 3005 | | | ○ | 84.13 | 1.09 | 12.89 | 72.55 | 2.34 | 12.01 | 11.68 |
| | 3006 | | | Δ | 83.18 | −0.21 | 9.54 | 73.89 | 2.79 | 13.77 | 10.64 |
| | 3007 | | | ○ | 84.15 | 1.01 | 11.89 | 73.41 | 2.71 | 17.08 | 12.05 |
| | 3008 | | | Δ | 84.49 | 0.27 | 12.76 | 71.17 | 4.22 | 13.9 | 13.94 |
| | 301 | | | Δ | 82.42 | −0.05 | 9.90 | 71.81 | 2.10 | 12.99 | 11.26 |
| | 3102 | | | ○ | 83.76 | 1.10 | 12.81 | 73.95 | 1.43 | 15.35 | 10.14 |
| | 3103 | | | Δ | 84.86 | −0.17 | 9.50 | 73.03 | 1.10 | 13.87 | 12.68 |
| | 3104 | | | ○ | 82.99 | −0.21 | 11.57 | 73.33 | 3.38 | 14.73 | 10.78 |

TABLE 27-continued

| Alloy No. | Machinability: Torque of Drill (N · cm) | Machinability: Tool Life (Times) | Stress Corrosion Cracking Resistance | Color Tone L | Color Tone a | Color Tone b | Color Tone After Test L | Color Tone After Test a | Color Tone After Test b | Color Difference Before and After Test |
|---|---|---|---|---|---|---|---|---|---|---|
| 3105 | | | Δ | 83.71 | 1.20 | 12.70 | 72.04 | 2.43 | 11.81 | 11.77 |
| 3106 | | | Δ | 82.85 | −0.24 | 9.35 | 73.61 | 2.87 | 13.98 | 10.79 |
| 3107 | | | Δ | 84.59 | 0.98 | 12.03 | 73.87 | 2.90 | 17.31 | 12.10 |
| 3108 | | | Δ | 84.31 | 0.29 | 11.87 | 71.06 | 4.71 | 14.04 | 14.14 |
| 3201 | 103 | | | | | | | | | |
| 3202 | 113 | | | | | | | | | |
| 3203 | 97 | | | | | | | | | |
| 3301 | 114 | | | | | | | | | |
| 3302 | 101 | | | | | | | | | |

TABLE 28

| | Alloy No. | Machinability: Torque of Drill (N · cm) | Machinability: Tool Life (Times) | Stress Corrosion Cracking Resistance | Color Tone L | Color Tone a | Color Tone b | Color Tone After Test L | Color Tone After Test a | Color Tone After Test b | Color Difference Before and After Test |
|---|---|---|---|---|---|---|---|---|---|---|---|
| Comp. Ex. | 3401 | 101 | 15 | | | | | | | | |
| | 3402 | 112 | 15 | | | | | | | | |
| | 3501 | 97 | 15 | | | | | | | | |
| | 3502 | 106 | 17 | | | | | | | | |
| | 3503 | 104 | 16 | | | | | | | | |
| | 3601 | 111 | 13 | | | | | | | | |
| | 3602 | 115 | 13 | | | | | | | | |
| | 3603 | 99 | 16 | | | | | | | | |
| | 3701 | | | Δ | | | | | | | |
| | 3702 | | | ○ | | | | | | | |
| | 3703 | | | Δ | | | | | | | |
| | 3704 | | | ○ | | | | | | | |
| | 3705 | | | ○ | | | | | | | |
| | 3706 | | | Δ | | | | | | | |
| | 3707 | | | ○ | | | | | | | |
| | 3801 | | | Δ | | | | | | | |
| | 3901 | | | Δ | 85.66 | 0.35 | 6.91 | 71.54 | 1.05 | 13.54 | 15.61 |
| | 3902 | | | x | 84.15 | 1.75 | 22.94 | 47.82 | 7.70 | 18.01 | 37.14 |
| | 3903 | | | x | 87.68 | 0.39 | 23.27 | 44.27 | 8.10 | 12.84 | 45.31 |
| | 3904 | 72 | | | | | | | | | |
| | 3905 | 51 | | | | | | | | | |
| | 3906 | 66 | | | | | | | | | |

The invention claimed is:

1. A silver-white copper alloy comprising:

47.5 to 50.5 mass % of Cu;

7.8 to 9.8 mass % of Ni;

4.7 to 6.3 mass % of Mn; and the remainder including Zn, wherein the silver-white copper alloy has an alloy composition satisfying relationships of f1=[Cu]+1.4×[Ni]+0.3×[Mn]=62.0 to 64.0, f2=[Mn]/[Ni]=0.49 to 0.68, and f3=[Ni]+[Mn]=13.0 to 15.5 among a content [Cu] mass % of Cu, a content [Ni] mass % of Ni, and a content [Mn] mass % of Mn, and has a metal structure in which (3 phases at an area ratio of 2 to 17% are dispersed in an α-phase matrix.

2. The silver-white copper alloy according to claim 1, further comprising one or more elements selected from 0.01 to 0.5 mass % of Al, 0.001 to 0.09 mass % of P, 0.005 to 0.035 mass % of Zr, and 0.001 to 0.03 mass % of Mg.

3. The silver-white copper alloy according to any one of claim 1 or 2, which is used as a constituent material of a key, a key blank, or a press product.

4. The silver-white copper alloy according to any one claim 1 or 2, wherein, for a hot processing raw material or a continuous casting raw material subjected to a first heat treatment, a content (area ratio) of the β phases is 3 to 24%, an average value of long side/short side of the β phases is 2 to 18, and a ratio of the β phases having a value of long side/short side that is 20 or more to the total β phases is 30% or less or the number of β phases having a long side that is 0.5 mm or more is not more than 10 per 1 $mm^2$.

5. The silver-white copper alloy according to any one of claim 1 or 2, wherein an average grain size of α phases is 0.003 to 0.018 mm, an average area of the 13 phases is $4\times10^{-6}$ to $80\times10^{-6}$ $mm^2$, an average value of long side/short side of β phases is 2 to 7, and a ratio of the β phases having a value of long side/short side of 12 or less to the total β phases is 95% or more or the number of β phases having a long side that is 0.06 mm or more is not more than 10 per 0.1 $mm^2$.

6. A method of producing the silver-white copper alloy according to claim 1, wherein a hot processing material that is the copper alloy is obtained by performing one or more heat treatments (heating temperature: 550 to 760° C., heating time: 2 to 36 hours, average cooling rate to 500° C.: 1° C./minute or less) and cold processes on a hot processing raw material or a continuous casting raw material.

7. The method of producing the silver-white copper alloy according to claim 6, wherein the method includes a heating process in which the second heat treatment or the later heat treatment is performed under conditions of a heating temperature of 550 to 625° C. and a heating time of 2 to 36 hours, and a processing rate of the cold process performed after the last heat treatment is 50% or less.

8. A silver-white copper alloy comprising:

47.5 to 50.5 mass % of Cu;

7.8 to 9.8 mass % of Ni;

4.7 to 6.3 mass % of Mn;

one or more elements selected from 0.001 to 0.08 mass % of Pb, 0.001 to 0.08 mass % of Bi, 0.0001 to 0.009 mass % of C, and 0.0001 to 0.007 mass % of S; and the remainder including Zn, wherein the silver-white copper alloy has an alloy composition satisfying relationships of $f1=[Cu]+1.4\times[Ni]+0.3\times[Mn]=62.0$ to 64.0, $f2=[Mn]/[Ni]=0.49$ to 0.68, and $f3=[Ni]+[Mn]=13.0$ to 15.5 among a content [Cu] mass % of Cu, a content [Ni] mass % of Ni, and a content [Mn] mass % of Mn, and has a metal structure in which β phases at an area ratio of 2 to 17% are dispersed in an α-phase matrix.

9. The silver-white copper alloy according to claim 8, wherein a relationship of $f5=[\beta]+10\times([Pb]-0.001)^{1/2}+10\times([Bi]-0.001)^{1/2}+15\times([C]-0.0001)^{1/2}+15\times([S]-0.0001)^{1/2}=2$ to 19 is satisfied among a content [β]% based on the area ratio of the β phases, a content [Pb] mass % of Pb, a content [Bi] mass % of Bi, a content [C] mass % of C, and a content [S] mass % of S.

10. The silver-white copper alloy according to claim 9, further comprising one or more elements selected from 0.01 to 0.5 mass % of Al, 0.001 to 0.09 mass % of P, 0.005 to 0.035 mass % of Zr, and 0.001 to 0.03 mass % of Mg.

11. The silver-white copper alloy according to claim 8, further comprising one or more elements selected from 0.01 to 0.5 mass % of Al, 0.001 to 0.09 mass % of P, 0.005 to 0.035 mass % of Zr, and 0.001 to 0.03 mass % of Mg.

12. The silver-white copper alloy according to claim 8, wherein an average grain size of α phases is 0.003 to 0.018 mm, an average area of the β phases is $4\times10^{-6}$ to $80\times10^{-6}$ $mm^2$, an average value of long side/short side of β phases is 2 to 7, and a ratio of the β phases having a value of long side/short side of 12 or less to the total β phases is 95% or more or the number of β phases having a long side that is 0.06 mm or more is not more than 10 per 0.1 $mm^2$.

13. The silver-white copper alloy according to claim 8, wherein, for a hot processing raw material or a continuous casting raw material subjected to a first heat treatment, a content (area ratio) of the β phases is 3 to 24%, an average value of long side/short side of the β phases is 2 to 18, and a ratio of the β phases having a value of long side/short side that is 20 or more to the total β phases is 30% or less or the number of β phases having a long side that is 0.5 mm or more is not more than 10 per 1 $mm^2$.

14. The silver-white copper alloy according to claim 8, which is used as a constituent material of a key, a key blank, or a press product.

15. A method of producing the silver-white copper alloy according to claim 8, wherein a hot processing material that is the copper alloy is obtained by performing one or more heat treatments (heating temperature: 550 to 760° C., heating time: 2 to 36 hours, average cooling rate to 500° C.: 1° C./minute or less) and cold processes on a hot processing raw material or a continuous casting raw material.

16. The method of producing the silver-white copper alloy according to claim 15, wherein the method includes a heating process in which the second heat treatment or the later heat treatment is performed under conditions of a heating temperature of 550 to 625° C. and a heating time of 2 to 36 hours, and a processing rate of the cold process performed after the last heat treatment is 50% or less.

* * * * *